US005974380A

United States Patent [19]

Smyth et al.

[11] Patent Number: 5,974,380

[45] Date of Patent: Oct. 26, 1999

[54] MULTI-CHANNEL AUDIO DECODER

[75] Inventors: Stephen Malcolm Smyth, Thousand Oaks; Michael Henry Smyth, Agoura; William Paul Smith, Woodland Hills, all of Calif.

[73] Assignee: Digital Theater Systems, Inc., Agoura Hills, Calif.

[21] Appl. No.: 08/991,533

[22] Filed: Dec. 16, 1997

Related U.S. Application Data

[62] Division of application No. 08/642,254, May 2, 1996.
[60] Provisional application No. 60/007,896, Dec. 1, 1995.

[51] Int. Cl.[6] ..... G10L 3/02

[52] U.S. Cl. ..... 704/229; 704/500; 704/503; 704/201

[58] Field of Search ..... 704/201, 229, 704/230

[56] References Cited

U.S. PATENT DOCUMENTS

| | | | |
|---|---|---|---|
| 4,464,783 | 8/1984 | Beraud et al. | 381/31 |
| 4,535,472 | 8/1985 | Tomcik | 381/31 |
| 4,538,234 | 8/1985 | Honda et al. | 364/513.5 |
| 4,622,680 | 11/1986 | Zinser | 375/25 |
| 4,757,536 | 7/1988 | Szczutkowski | 380/48 |
| 4,815,074 | 3/1989 | Jacobsen | 370/112 |
| 4,817,146 | 3/1989 | Szczutkowski | 380/48 |
| 4,896,362 | 1/1990 | Veldhuis et al. | 381/30 |
| 4,899,384 | 2/1990 | Crouse et al. | 381/31 |
| 4,972,484 | 11/1990 | Theile et al. | 381/37 |
| 5,115,240 | 5/1992 | Fujiwara et al. | 341/51 |

(List continued on next page.)

FOREIGN PATENT DOCUMENTS

| | | | |
|---|---|---|---|
| 1550673 | 8/1979 | European Pat. Off. . | |
| 0084125 | 7/1983 | European Pat. Off. . | |
| 492862 A3 | 12/1991 | European Pat. Off. | H04J 3/16 |
| 535890 A3 | 9/1992 | European Pat. Off. | H06N 7/14 |
| 0549451 | 6/1993 | European Pat. Off. . | |
| H6-6313 | 1/1994 | Japan . | |

OTHER PUBLICATIONS

"Information technology—Coding of moving picture and associated audio for digital storage media at up to about 1.5 Mbit/s", ISO/IEC, Mar. 1993.

Todd et al., AC–3: Flexible Perceptual Coding for Audio Transmission and Storage, *Convention of the Audio Engineering Society,* Feb. 26, 1994–Mar. 1, 1994, pp. 1–16.

Smyth et al., APT–X100: A Low–Delay, Low Bit–Rate, Sub–Band ADPCM Audio Coder for Broadcasting, *Proceeding of the 10th International AES Conference,* Sep. 7–9, 1991, pp. 41–56.

James D. Johnston, Transition Coding of Audio Signals Using Perceptual Noise Criteria, *IEEE Journal on Selected Areas in Communications,* vol. 6, No. 2, Feb. 1988, pp. 314–323.

MPEGI Compression Standard ISO/IEC DIS 11172, Information technology—Coding of moving pictures and associated audio storage media up to about 1,5 Mbit/s, *International Organization for Standardization,* 1992, pp. 290–298.

*Primary Examiner*—David R . Hudspeth
*Assistant Examiner*—Michael N. Opsasnick
*Attorney, Agent, or Firm*—Koppel & Jacobs

[57] ABSTRACT

A subband audio coder employs perfect/non-perfect reconstruction filters, predictive/non-predictive subband encoding, transient analysis, and psycho-acoustic/minimum mean-square-error (mmse) bit allocation over time, frequency and the multiple audio channels to encode/decode a data stream to generate high fidelity reconstructed audio. The audio coder windows the multi-channel audio signal such that the frame size, i.e. number of bytes, is constrained to lie in a desired range, and formats the encoded data so that the individual subframes can be played back as they are received thereby reducing latency. Furthermore, the audio coder processes the baseband portion (0–24 kHz) of the audio bandwidth for sampling frequencies of 48 kHz and higher with the same encoding/decoding algorithm so that audio coder architecture is future compatible.

22 Claims, 26 Drawing Sheets

U.S. PATENT DOCUMENTS 5,136,377 8/1992 Johnston et al. ..... 358/136
5,159,611 10/1992 Tomita et al. ..... 375/34
5,235,623 8/1993 Sugiyama et al. ..... 375/122
5,241,535 8/1993 Yoshikawa ..... 369/70
5,263,088 11/1993 Hazu et al. ..... 381/30
5,268,685 12/1993 Fujiwara ..... 341/76
5,285,498 2/1994 Johnstown ..... 381/2
5,365,553 11/1994 Veldhuis et al. ..... 375/122
5,388,181 2/1995 Anderson et al. ..... 395/212
5,394,473 2/1995 Davidson ..... 381/36
5,408,580 4/1995 Stautner ..... 704/205
5,414,795 5/1995 Tsutsui et al. ..... 395/2.13
5,414,796 5/1995 Jacobs et al. ..... 395/2.3
5,436,940 7/1995 Nguyen ..... 375/240
5,438,643 8/1995 Akagiri et al. ..... 395/2.1
5,440,596 8/1995 Kneepkens et al. ..... 375/240
5,451,954 9/1995 Davis et al. ..... 341/200
5,469,474 11/1995 Kitzbatake ..... 375/243
5,471,206 11/1995 Bolliek et al. ..... 341/51
5,481,614 1/1996 Johnston ..... 381/2
5,488,665 1/1996 Johnston et al. ..... 381/2
5,490,170 2/1996 Akagiri et al. ..... 375/240
5,491,773 2/1996 Veldhuis ..... 395/2.38
5,535,300 7/1996 Hall, II et al. ..... 395/2.36
5,583,962 12/1996 Davis ..... 395/2.38
5,588,024 12/1996 Takano ..... 375/242
5,592,584 1/1997 Ferreira et al. ..... 395/2.12
5,596,676 1/1997 Swaminathan et al. ..... 395/2.17
5,606,642 2/1997 Stautner et al. ..... 395/2.14
5,608,713 3/1997 Akagiri et al. ..... 369/124
5,617,145 4/1997 Huang et al. ..... 348/423
5,621,856 4/1997 Akagiri ..... 395/2.38
5,627,938 5/1997 Johnston ..... 395/2.39
5,636,324 6/1997 Teh ..... 315/2.35
5,682,461 10/1997 Silzle ..... 704/205
5,717,764 2/1998 Johnston ..... 381/2
5,748,903 5/1998 Agarwal ..... 395/200.07

109

108

| | Subframe Buffer | | | |
|---|---|---|---|---|
| TMODE | Sub-subframe 1 | Sub-subframe 2 | Sub-subframe 3 | Sub-subframe 4 |
| 0 | | | | |
| 1 | | | X X | X X |
| 2 | | | | X X |
| 3 | | | | |

FIG.14a

109

110

| | Subframe Buffer | | | |
|---|---|---|---|---|
| TMODE | Sub-subframe 1 | Sub-subframe 2 | Sub-subframe 3 | Sub-subframe 4 |
| 0 | RMS 1 or Peak 1 | | | |
| 1 | RMS 1 or Peak 1 | RMS 2 or Peak 2 | | |
| 2 | RMS 1 or Peak 1 | | RMS 2 or Peak 2 | |
| 3 | RMS 1 or Peak 1 | | | RMS 2 or Peak 2 |

FIG.14b 186
188
192
194
196
198
SYNC WORD 0x7ffe8001
Frame Headers
Optional Data Bytes
Audio Headers
200
202
204
206
208
210
256
190
Audio Side Information
High Frequency VQ Codes
Low Frequency Effects
Sub-subframe 1 Audio Codes
Sub-subframe 2 Audio Codes
Sub-subframe 3 Audio Codes
Sub-subframe 4 Audio Codes
Optional Over-sampled Audio
Unpack Sync
Audio Subframe 1
Audio Subframe 2
Audio Subframe 3
Audio Subframe 4
FRAME END

MULTI-CHANNEL AUDIO DECODER

RELATED APPLICATION

This application is a divisional of application Ser. No. 08/642,254 filed May 2, 1996 entitled MULTI-CHANNEL PREDICTIVE SUBBAND AUDIO CODER USING PSYCHOACOUSTIC ADAPTIVE BIT ALLOCATION IN FREQUENCY, TIME AND OVER THE MULTIPLE CHANNELS, which is hereby incorporated by reference and which is itself a continuation-in-part of provisional application Ser. No. 60/007,896 filed Dec. 1, 1995.

BACKGROUND OF THE INVENTION

1. Field of the Invention

This invention relates to high quality encoding and decoding of multi-channel audio signals and more specifically to a subband encoder that employs perfect/non-perfect reconstruction filters, predictive/non-predictive subband encoding, transient analysis, and psycho-acoustic/minimum mean-square-error (mmse) bit allocation over time, frequency and the multiple audio channels to generate a data stream with a constrained decoding computational load.

2. Description of the Related Art

Pulse code modulation (PCM) based speech coders were first developed in the 1960's. In the early 1970's, low bit-rate speech coders were developed for use with the digital telephone networks, which had a restricted bandwidth of approximately 3.5 kHz. In 1979 Johnston outlined a 7.5 kHz sub-band differential PCM (DPCM) that was suitable for speech and music signals. In the early 1980's this work was developed using more sophisticated adaptive DPCM techniques (ADPCM), but it was not until 1988 that a true wideband high quality ADPCM coder was discussed.

In the mid-late 1980's new methods for coding very high quality audio signals were developed based on high resolution filter-banks and/or transform coders, in which the quantizer bit-allocations were determined by a psychoacoustic masking model. In general, the psychoacoustic masking model tries to establish a quantization noise audibility threshold at all frequencies. The threshold is used to allocate quantization bits to reduce the likelihood that the quantization noise will become audible. The quantization noise threshold is calculated in the frequency domain from the absolute energy of the frequency-transformed audio signal. The dominant frequency components of the audio signal tend to mask the audibility of other components which are close in the bark scale (human auditory frequency scale) to the dominant signal.

Thus, the known high quality audio and music coders can be divided into two broad classes of schemes.

1) Medium to high frequency resolution subband/transform coders which adaptively quantize the subband or coefficient samples within the analysis window according to a psychoacoustic mask calculation.

These coders exploit the large short-term spectral variances of general music signals by allowing the bit-allocations to adapt according to the spectral energy of the signal. The high resolution of these coders allows the frequency transformed signal to be applied directly to the psychoacoustic model, which is based on a critical band theory of hearing. Dolby's AC-3 audio coder, Todd et al., "AC-3: Flexible Perceptual Coding for Audio Transmission and Storage" Convention of the Audio Engineering Society, February, 1994, typically computes 1024-ffts on the respective PCM signals and applies a psychoacoustic model to the 1024 frequency coefficients in each channel to determine the bit rate for each coefficient. The Dolby system uses a transient analysis that reduces the window size to 256 samples to isolate the transients. The AC-3 coder uses a proprietary backward adaptation algorithm to decode the bit allocation. This reduces the amount of bit allocation information that is sent along side the encoded audio data. As a result, the bandwidth available to audio is increased over forward adaptive schemes which leads to an improvement in sound quality.

2) Low resolution subband coders which make-up for their poor frequency resolution by processing the subband samples using ADPCM. The quantization of the differential subband signals is either fixed or adapts to minimize the quantization noise power across all or some of the subbands, without any explicit reference to psychoacoustic masking theory. It is commonly accepted that a direct psychoacoustic distortion threshold cannot be applied to predictive/differential subband signals because of the difficulty in estimating the predictor performance ahead of the bit allocation process. The problems is further compounded by the interaction of quantization noise on the prediction process.

These coders work because perceptually critical audio signals are generally periodic over long periods of time. This periodicity is exploited by predictive differential quantization. Splitting the signal into a small number of sub-bands reduces the audible effects of noise modulation and allows the exploitation of long-term spectral variances in audio signals. If the number of subbands is increased, the prediction gain within each sub-band is reduced and at some point the prediction gain will tend to zero.

Digital Theater Systems, L.P. (DTS) makes use of an audio coder in which each PCM audio channel is filtered into four subbands and each subband is encoded using a backward ADPCM encoder that adapts the predictor coefficients to the sub-band data. The bit allocation is fixed and the same for each channel, with the lower frequency subbands being assigned more bits than the higher frequency subbands. The bit allocation provides a fixed compression ratio, for example, 4:1. The DTS coder is described by Mike Smyth and Stephen Smyth, "APT-X100: A LOW-DELAY, LOW BIT-RATE, SUB-BAND ADPCM AUDIO CODER FOR BROADCASTING," Proceedings of the 10th International AES Conference 1991, pp. 41–56.

Both types of audio coders have other common limitations. First, known audio coders encode/decode with a fixed frame size, i.e. the number of samples or period of time represented by a frame is fixed. As a result, as the encoded transmission rate increases relative to the sampling rate, the amount of data (bytes) in the frame also increases. Thus, the decoder buffer size must be designed to accommodate the worst case scenario to avoid data overflow. This increases the amount of RAM, which is a primary cost component of the decoder. Secondly, the known audio coders are not easily expandable to sampling frequencies greater than 48 kHz. To do so would make the existing decoders incompatible with the format required for the new encoders. This lack of future compatibility is a serious limitation. Furthermore, the known formats used to encode the PCM data require that the entire frame be read in by the decoder before playback can be initiated. This requires that the buffer size be limited to approximately 100 ms blocks of data such that the delay or latency does not annoy the listener.

In addition, although these coders have encoding capability up to 24 kHz, often times the higher subbands are dropped. This reduces the high frequency fidelity or ambiance of the reconstructed signal. Known encoders typically employ one of two types of error detection schemes. The most common is Read Solomon coding, in which the encoder adds error detection bits to the side information in the data stream. This facilitates the detection and correction of any errors in the side information. However, errors in the audio data go undetected. Another approach is to check the frame and audio headers for invalid code states. For example, a particular 3-bit parameter may have only 3 valid states. If one of the other 5 states is identified then an error must have occurred. This only provides detection capability and does not detect errors in the audio data.

SUMMARY OF THE INVENTION

In view of the above problems, the present invention provides a multi-channel audio coder with the flexibility to accommodate a wide range of compression levels with better than CD quality at high bit rates and improved perceptual quality at low bit rates, with reduced playback latency, simplified error detection, improved pre-echo distortion, and future expandability to higher sampling rates.

This is accomplished with a subband coder that windows each audio channel into a sequence of audio frames, filters the frames into baseband and high frequency ranges, and decomposes each baseband signal into a plurality of subbands. The subband coder normally selects a non-perfect filter to decompose the baseband signal when the bit rate is low, but selects a perfect filter when the bit rate is sufficiently high. A high frequency coding stage encodes the high frequency signal independently of the baseband signal. A baseband coding stage includes a VQ and an ADPCM coder that encode the higher and lower frequency subbands, respectively. Each subband frame includes at least one subframe, each of which are further subdivided into a plurality of sub-subframes. Each subframe is analyzed to estimate the prediction gain of the ADPCM coder, where the prediction capability is disabled when the prediction gain is low, and to detect transients to adjust the pre and post-transient SFs.

A global bit management (GBM) system allocates bits to each subframe by taking advantage of the differences between the multiple audio channels, the multiple subbands, and the subframes within the current frame. The GBM system initially allocates bits to each subframe by calculating its SMR modified by the prediction gain to satisfy a psychoacoustic model. The GBM system then allocates any remaining bits according to a MMSE approach to either immediately switch to a MMSE allocation, lower the overall noise floor, or gradually morph to a MMSE allocation.

A multiplexer generates output frames that include a sync word, a frame header, an audio header and at least one subframe, and which are multiplexed into a data stream at a transmission rate. The frame header includes the window size and the size of the current output frame. The audio header indicates a packing arrangement and a coding format for the audio frame. Each audio subframe includes side information for decoding the audio subframe without reference to any other subframe, high frequency VQ codes, a plurality of baseband audio sub-subframes, in which audio data for each channel's lower frequency subbands is packed and multiplexed with the other channels, a high frequency audio block, in which audio data in the high frequency range for each channel is packed and multiplexed with the other channels so that the multi-channel audio signal is decodable at a plurality of decoding sampling rates, and an unpack sync for verifying the end of the subframe.

The window size is selected as a function of the ratio of the transmission rate to the encoder sampling rate so that the size of the output frame is constrained to lie in a desired range. When the amount of compression is relatively low the window size is reduced so that the frame size does not exceed an upper maximum. As a result, a decoder can use an input buffer with a fixed and relatively small amount of RAM. When the amount of compression is relatively high, the window size is increased. As a result, the GBM system can distribute bits over a larger time window thereby improving encoder performance.

These and other features and advantages of the invention will be apparent to those skilled in the art from the following detailed description of preferred embodiments, taken together with the accompanying drawings and tables, in which:

BRIEF DESCRIPTION OF THE DRAWINGS

FIGS. 12*a* through 12*e* are frequency response plots illustrating the joint frequency coding process shown in FIG. 5;

FIGS. 14*a* and 14*b* transient detection and scale factor computation, respectively, for a subframe;

BRIEF DESCRIPTION OF THE TABLES

Table 1 tabulates the maximum frame size versus sampling rate and transmission rate;

Table 2 tabulates the maximum allowed frame size (bytes) versus sampling rate and transmission rate;

Table 3 tabulates the prediction efficiency factor versus quantization levels;

Table 4 illustrates the relationship between ABIT index value, the number of quantization levels and the resulting subband SNR;

Table 5 tabulates typical nominal word lengths for the possible entropy ABIT indexes;

Table 6 indicates which channels are joint frequency coded and where the coded signal is located;

Table 7 selects the appropriate entropy codebook for a given ABIT and SEL index;

Table 8 selects the physical output channel assignments; and

Table 9 is a fixed down matrix table for an 8-ch decoded audio signal.

DETAILED DESCRIPTION OF THE INVENTION

Multi-Channel Audio Coding System

Figure 1:
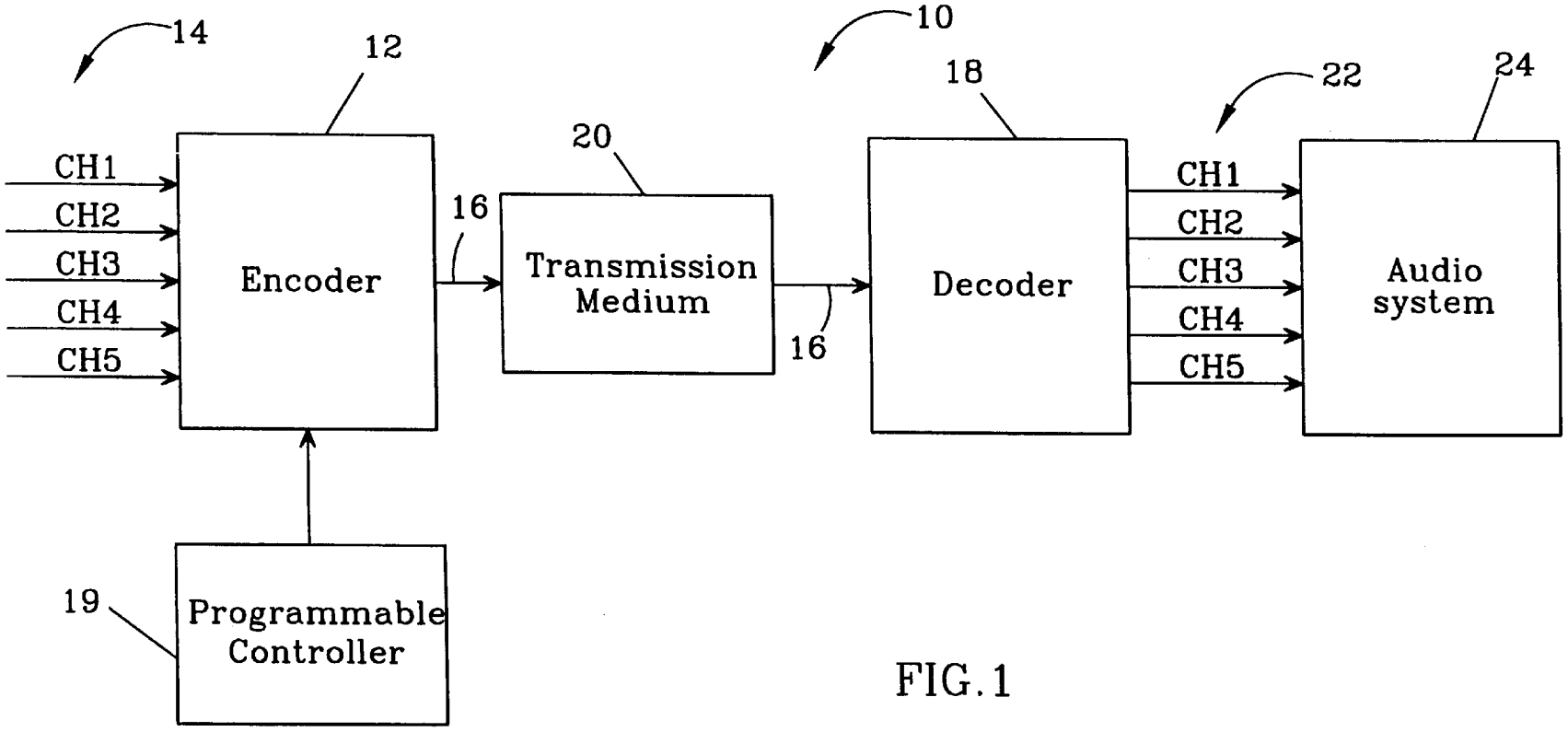
FIG. 1 is a block diagram of a 5-channel audio coder in accordance with the present invention.

As shown in FIG. 1, the present invention combines the features of both of the known encoding schemes plus additional features in a single multi-channel audio coder 10. The encoding algorithm is designed to perform at studio quality levels i.e. "better than CD" quality and provide a wide range of applications for varying compression levels, sampling rates, word lengths, number of channels and perceptual quality. An important objective in designing the audio coder was to ensure that the decoding algorithm is relatively simple and future compatible. This reduces the cost of contemporary decoding equipment and allows consumers to benefit from future improvements in the encoding stage such as higher sampling rates or bit allocation routines.

The encoder 12 encodes multiple channels of PCM audio data 14, typically sampled at 48 kHz with word lengths between 16 and 24 bits, into a data stream 16 at a known transmission rate, suitably in the range of 32–4096 kbps. Unlike known audio coders, the present architecture can be expanded to higher sampling rates (48–192 kHz) without making the existing decoders, which were designed for the baseband sampling rate or any intermediate sampling rate, incompatible. Furthermore, the PCM data 14 is windowed and encoded a frame at a time where each frame is preferably split into 1–4 subframes. The size of the audio window, i.e. the number of PCM samples, is based on the relative values of the sampling rate and transmission rate such that the size of an output frame, i.e. the number of bytes, read out by the decoder 18 per frame is constrained, suitably between 5.3 and 8 kbytes.

As a result, the amount of RAM required at the decoder to buffer the incoming data stream is kept relatively low, which reduces the cost of the decoder. At low rates larger window sizes can be used to frame the PCM data, which improves the coding performance. At higher bit rates, smaller window sizes must be used to satisfy the data constraint. This necessarily reduces coding performance, but at the higher rates it is insignificant. Also, the manner in which the PCM data is framed allows the decoder 18 to initiate playback before the entire output frame is read into the buffer. This reduces the delay or latency of the audio coder.

The encoder 12 uses a high resolution filterbank, which preferably switches between non-perfect (NPR) and perfect (PR) reconstruction filters based on the bit rate, to decompose each audio channel 14 into a number of subband signals. Predictive and vector quantization (VQ) coders are used to encode the lower and upper frequency subbands, respectively. The start VQ subband can be fixed or may be determined dynamically as a function of the current signal properties. Joint frequency coding may be employed at low bit rates to simultaneously encode multiple channels in the higher frequency subbands.

The predictive coder preferably switches between APCM and ADPCM modes based on the subband prediction gain. A transient analyzer segments each subband subframe into pre and post-echo signals (sub-subframes) and computes respective scale factors for the pre and post-echo sub-subframes thereby reducing pre-echo distortion. The encoder adaptively allocates the available bit rate across all of the PCM channels and subbands for the current frame according to their respective needs (psychoacoustic or mse) to optimize the coding efficiency. By combining predictive coding and psychoacoustic modeling, the low bit rate coding efficiency is enhanced thereby lowering the bit rate at which subjective transparency is achieved. A programmable controller 19 such as a computer or a key pad interfaces with the encoder 12 to relay audio mode information including parameters such as the desired bit rate, the number of channels, PR or NPR reconstruction, sampling rate and transmission rate.

The encoded signals and sideband information are packed and multiplexed into the data stream 16 such that the decoding computational load is constrained to lie in the desired range. The data stream 16 is encoded on or broadcast over a transmission medium 20 such as a CD, a digital video disk (DVD), or a direct broadcast satellite. The decoder 18 decodes the individual subband signals and performs the inverse filtering operation to generate a multi-channel audio signal 22 that is subjectively equivalent to the original multi-channel audio signal 14. An audio system 24 such as a home theater system or a multimedia computer play back the audio signal for the user.

Multi-Channel Encoder

Figure 2:
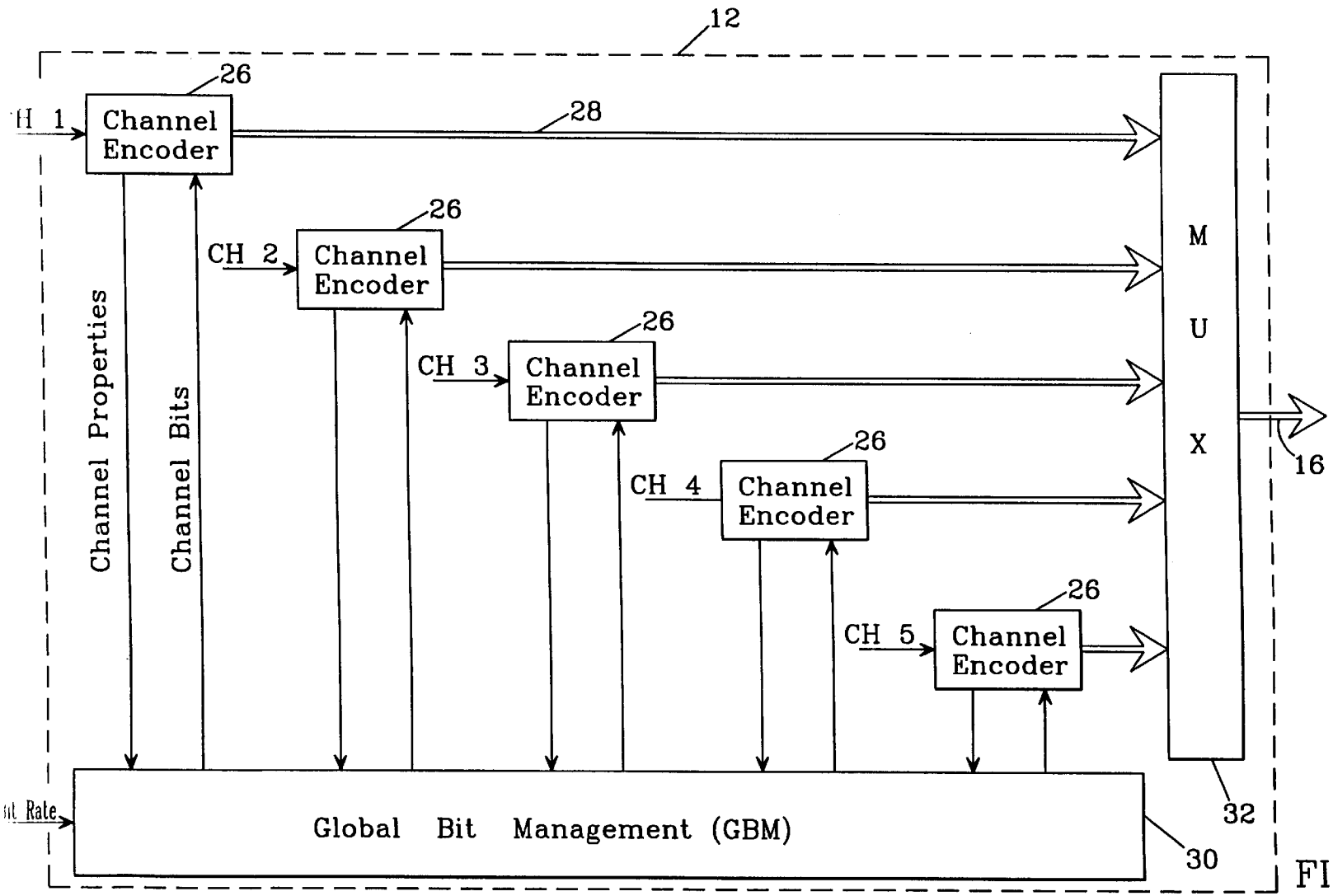
FIG. 2 is a block diagram of a multi-channel encoder.

As shown in FIG. 2, the encoder 12 includes a plurality of individual channel encoders 26, suitably five (left front, center, right front, left rear and right rear), that produce respective sets of encoded subband signals 28, suitably 32 subband signals per channel. The encoder 12 employs a global bit management (GBM) system 30 that dynamically allocates the bits from a common bit-pool among the channels, between the subbands within a channel, and within an individual frame in a given subband. The encoder 12 may also use joint frequency coding techniques to take advantage of inter-channel correlations in the higher frequency subbands. Furthermore, the encoder 12 can use VQ on the higher frequency subbands that are not specifically perceptible in order to provide a basic high frequency fidelity or ambiance at a very low bit rate. In this way, the coder takes advantage of the disparate signal demands, e.g. the subbands' rms values and psychoacoustic masking levels, of the multiple channels and the non-uniform distribution of signal energy over frequency in each channel and over time in a given frame.

Bit Allocation Overview

Figure 25:
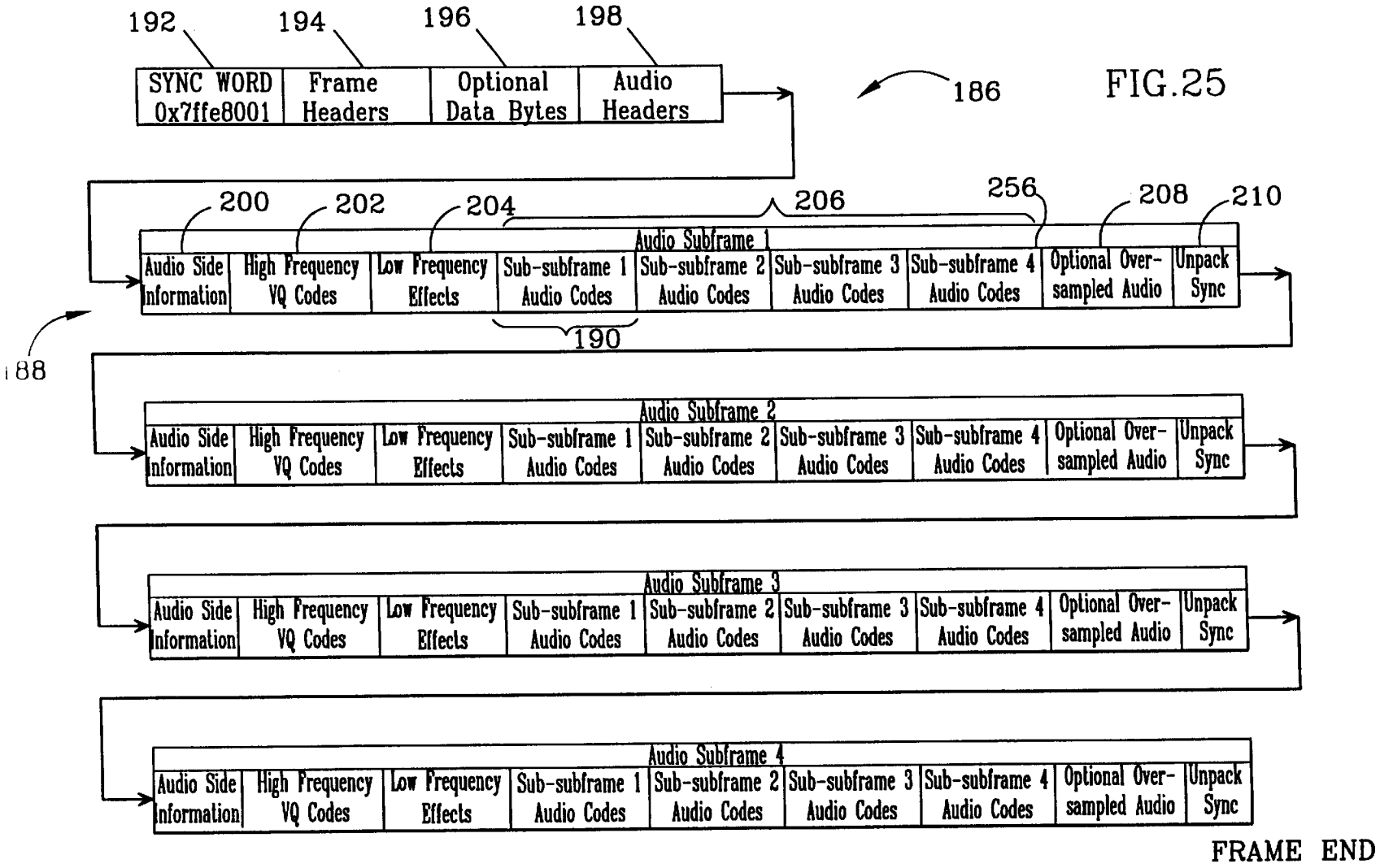
FIG. 25 is a block diagram of a single frame in the data stream.

The GBM system 30 first decides which channels' subbands will be joint frequency coded and averages that data, and then determines which subbands will be encoded using VQ and subtracts those bits from the available bit rate. The decision of which subbands to VQ can be made a priori in that all subbands above a threshold frequency are VQ or can be made based on the psychoacoustic masking effects of the individual subbands in each frame. Thereafter, the GBM system 30 allocates bits (ABIT) using psychoacoustic masking on the remaining subbands to optimize the subjective quality of the decoded audio signal. If additional bits are available, the encoder can switch to a pure mmse scheme, i.e. "waterfilling", and reallocate all of the bits based on the subbands relative rms values to minimize the rms value of the error signal. This is applicable at very high bit rates. The preferred approach is to retain the psychoacoustic bit allocation and allocate only the additional bits according to the mmse scheme. This maintains the shape of the noise signal created by the psychoacoustic masking, but uniformly shifts the noise floor downwards. Alternately, the preferred approach can be modified such that the additional bits are allocated according to the difference between the rms and psychoacoustic levels. As a result, the psychoacoustic allocation morphs to a mmse allocation as the bit rate increases thereby providing a smooth transition between the two techniques. The above techniques are specifically applicable for fixed bit rate systems. Alternately, the encoder 12 can set a distortion level, subjective or mse, and allow the overall bit rate to vary to maintain the distortion level. A multiplexer 32 multiplexes the subband signals and side information into the data stream 16 in accordance with a specified data format. Details of the data format are discussed in FIG. 25 below.

Baseband Encoding

Figure 3:
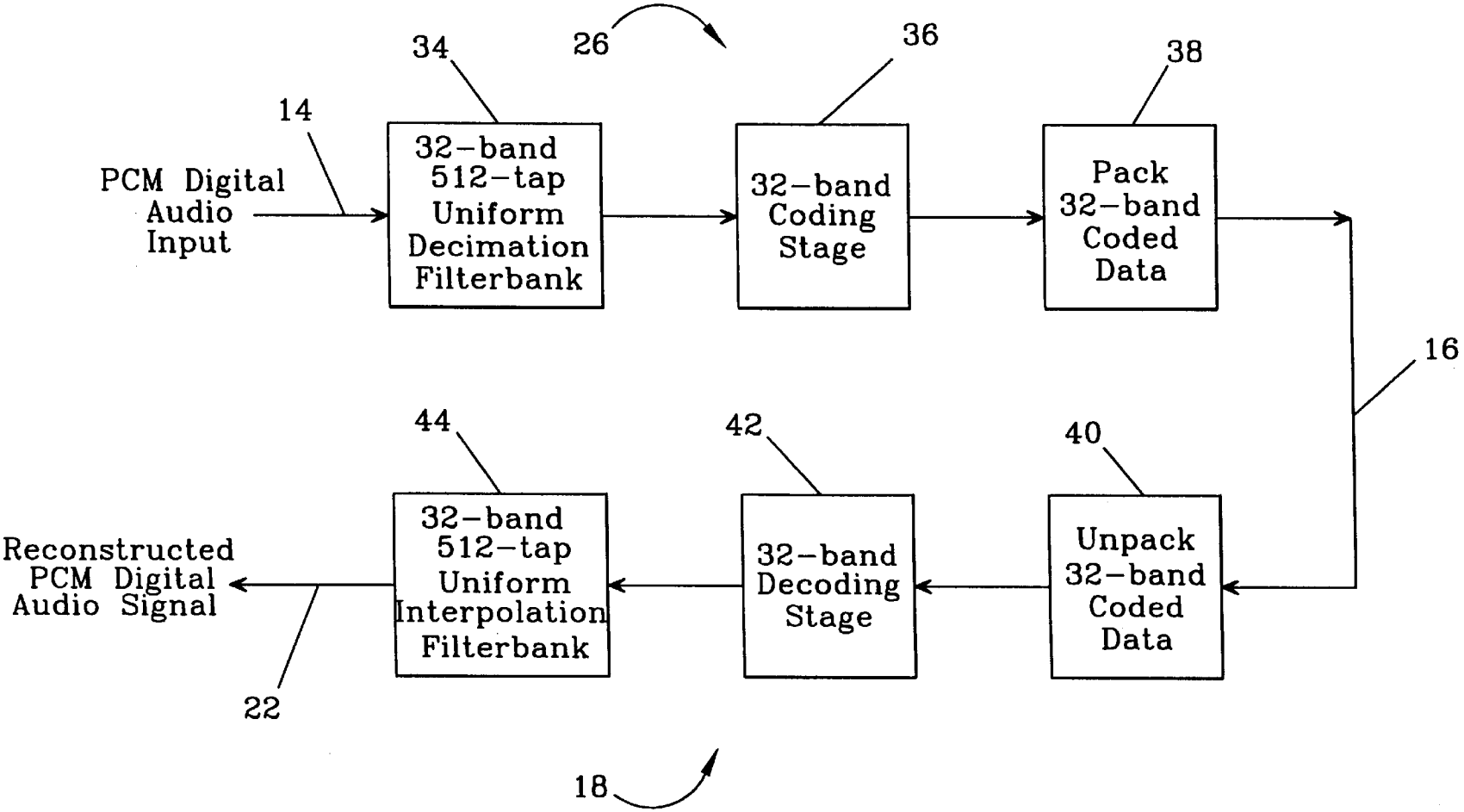
FIG. 3 is a block diagram of the baseband encoder and decoder.

For sampling rates in the range 8–48 kHz, the channel encoder 26, as shown in FIG. 3, employs a uniform 512-tap 32-band analysis filter bank 34 operating at a sampling rate of 48 kHz to split the audio spectrum, 0–24 kHz, of each channel into 32 subbands having a bandwidth of 750 Hz per subband. The coding stage 36 codes each subband signal and multiplexes 38 them into the compressed data stream 16. The decoder 18 receives the compressed data stream, separates out the coded data for each subband using an unpacker 40, decodes each subband signal 42 and reconstructs the PCM digital audio signals (Fsamp=48 kHz) using a 512-tap 32-band uniform interpolation filter bank 44 for each channel.

In the present architecture, all of the coding strategies, e.g. sampling rates of 48, 96 or 192 kHz, use the 32-band encoding/decoding process on the lowest (baseband) audio frequencies, for example between 0–24 kHz. Thus, decoders that are designed and built today based upon a 48 kHz sampling rate will be compatible with future encoders that are designed to take advantage of higher frequency components. The existing decoder would read the baseband signal (0–24 kHz) and ignore the encoded data for the higher frequencies.

High Sampling Rate Encoding

Figure 4A:
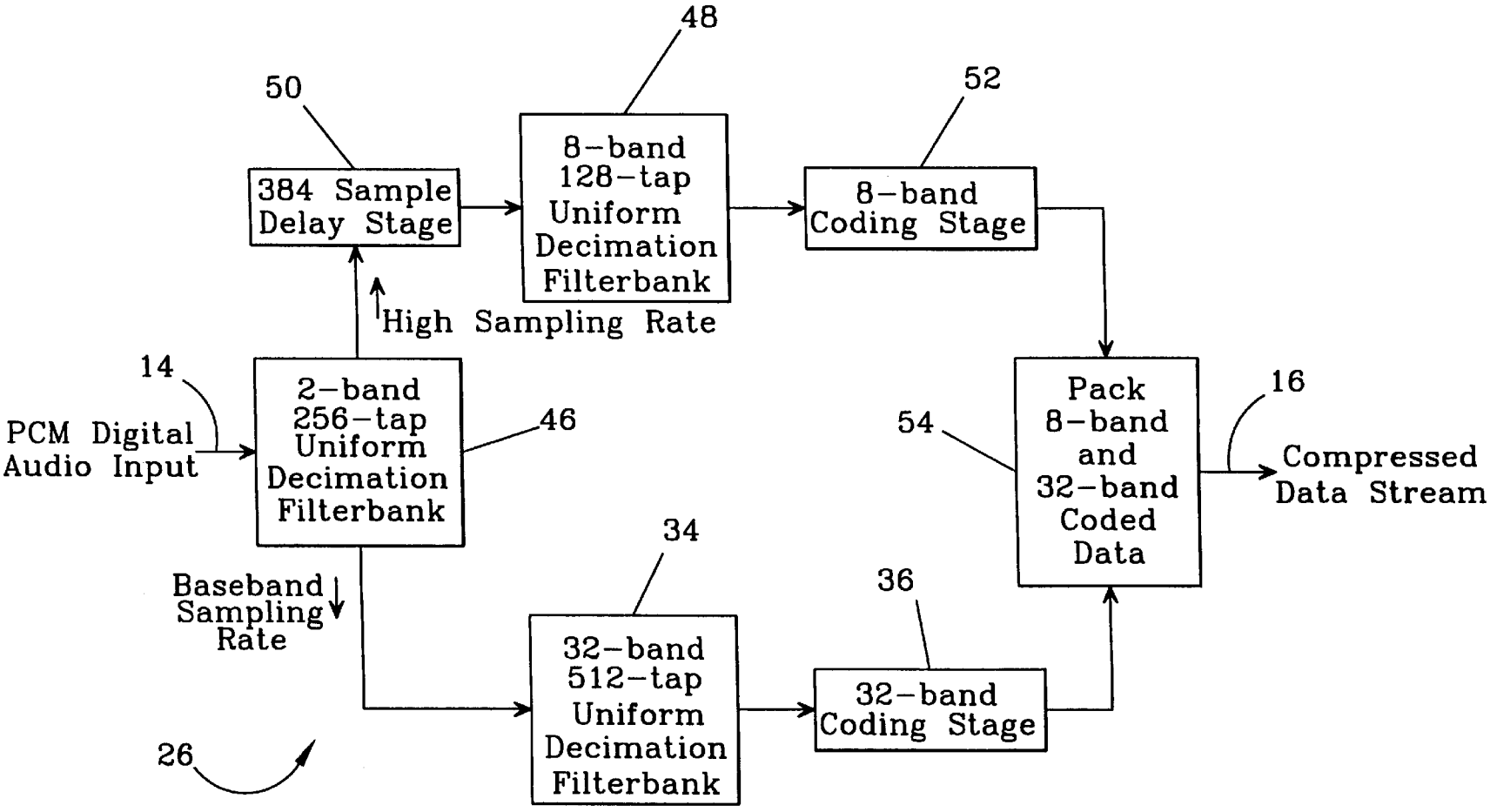
FIGS. 4*a* and 4*b* are block diagrams of an encoder and a decoder, respectively, at high sampling rates.
Figure 4B:
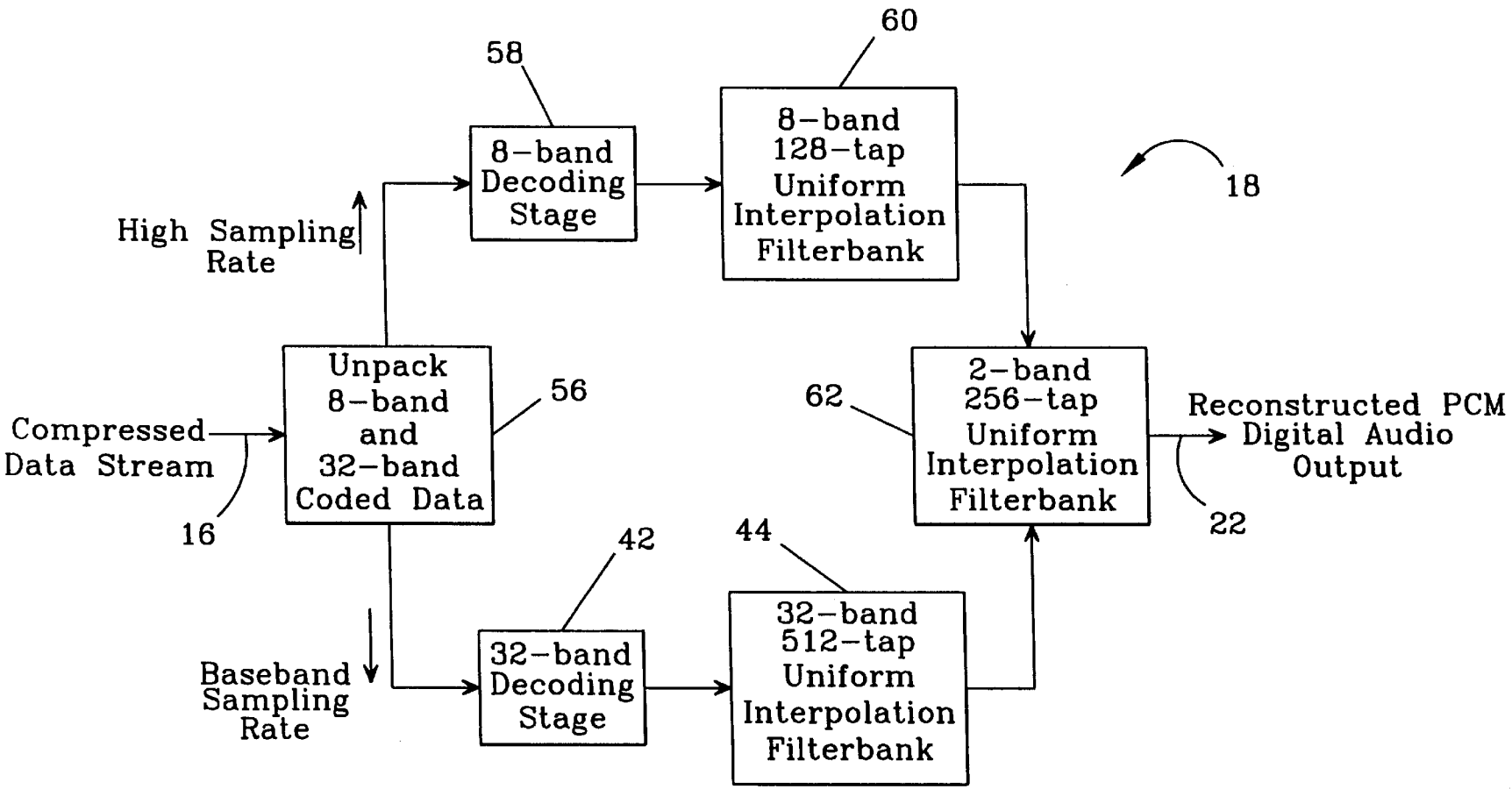

For sampling rates in the range 48–96 kHz, the channel encoder 26 preferably splits the audio spectrum in two and employs a uniform 32-band analysis filter bank for the bottom half and an 8-band analysis filter bank for the top half. As shown in FIGS. 4*a* and 4*b*, the audio spectrum, 0–48 kHz, is initially split using a 256-tap 2-band decimation pre-filter bank 46 giving an audio bandwidth of 24 kHz per band. The bottom band (0–24 kHz) is split and encoded in 32 uniform bands in the manner described above in FIG. 3. The top band (24–48 kHz) however, is split and encoded in 8 uniform bands. If the delay of the 8-band decimation/interpolation filter bank 48 is not equal to that of the 32-band filter banks then a delay compensation stage 50 must be employed somewhere in the 24–48 kHz signal path to ensure that both time waveforms line up prior to the 2-band recombination filter bank at the decoder. In the 96 kHz sampling encoding system, the 24–48 kHz audio band is delayed by 384 samples and then split into the 8 uniform bands using a 128-tap interpolation filter bank. Each of the 3 kHz subbands is encoded 52 and packed 54 with the coded data from the 0–24 kHz band to form the compressed data stream 16.

On arrival at the decoder 18, the compressed data stream 16 is unpacked 56 and the codes for both the 32-band decoder (0–24 kHz region) and 8-band decoder (24–48 kHz) are separated out and fed to their respective decoding stages 42 and 58, respectively. The eight and 32 decoded subbands are reconstructed using 128-tap and 512-tap uniform interpolation filter banks 60 and 44, respectively. The decoded subbands are subsequently recombined using a 256-tap 2-band uniform interpolation filter bank 62 to produce a single PCM digital audio signal with a sampling rate of 96 kHz. In the case when it is desirable for the decoder to operate at half the sampling rate of the compressed data stream, this can be conveniently carried out by discarding the upper band encoded data (24–48 kHz) and decoding only the 32-subbands in the 0–24 kHz audio region.

For sampling rates in the range 96–192 kHz the coding system splits the audio spectrum into four uniform bands and employs a uniform 32-band analysis filter bank for the first band, an 8-band analysis filter bank for the second band, and single band coding processes for both the third and fourth bands. The audio spectrum, 0–96 kHz, is initially split using a 256-tap 4-band decimation pre-filter bank giving an audio bandwidth of 24 kHz per band. The first band (0–24 kHz) is split and encoded in 32 uniform bands in the same manner as described above for sampling rates below 48 kHz. The second band (24–48 kHz) is split, delayed and encoded in 8 uniform bands in the same manner as described above for sampling rates between 48–96 kHz. The third and fourth bands are processed directly. In order to ensure that the time waveforms for these bands line up with those for the first and second bands prior to the 4-band recombination filter bank at the decoder, delays must be placed somewhere in the 48–72 kHz and 72–96 kHz signal paths. In the 192 kHz sampling coding system, both 48–72 kHz and 72–96 kHz bands are delayed by 511 samples to match the delay of the 32-band decimation/interpolation filter bank. The two upper bands are encoded and packed with the coded data from the 24–48 kHz and 0–24 kHz bands to form the compressed data stream.

On arrival at the decoder, the compressed data stream is unpacked and the codes for both the 32-band decoder (0–24 kHz region), the 8-band (24–48 kHz) and the single band decoders (48–72 kHz and 72–96 kHz regions) separated out and fed to their respective decoding stages. The single bands are recombined with the 0–24 kHz and 24–48 kHz bands using a 256-tap 4-band uniform interpolation filter bank to produce a single PCM digital audio signal with a sampling rate of 192 kHz. In the case when it is desirable for the decoder to operate at half the sampling rate of the compressed data stream, this can be conveniently carried out by discarding the encoded data associated with the two upper bands (48–72 kHz and 72–96 kHz) and decoding only the 8-subband data (24–48 kHz) and 32-subband data (0–24 kHz). In the case when it is desirable for the decoder to operate at one quarter the sampling rate of the compressed data stream, this can be conveniently carried out by discarding the encoded data associated with the two upper bands (48–72 kHz and 72–96 kHz) and that for the 8-subband decoder data (24–48 kHz), decoding only the 32-subband data (0–24 kHz).

The coding strategies discussed above for sampling frequencies greater than 48 kHz are the best contemplated at this time. However, the preferred strategy may change as they are actually implemented. The importance of the described strategies is to illustrate the expandability of the encoder architecture and data stream format.

Channel Encoder

Figure 5:
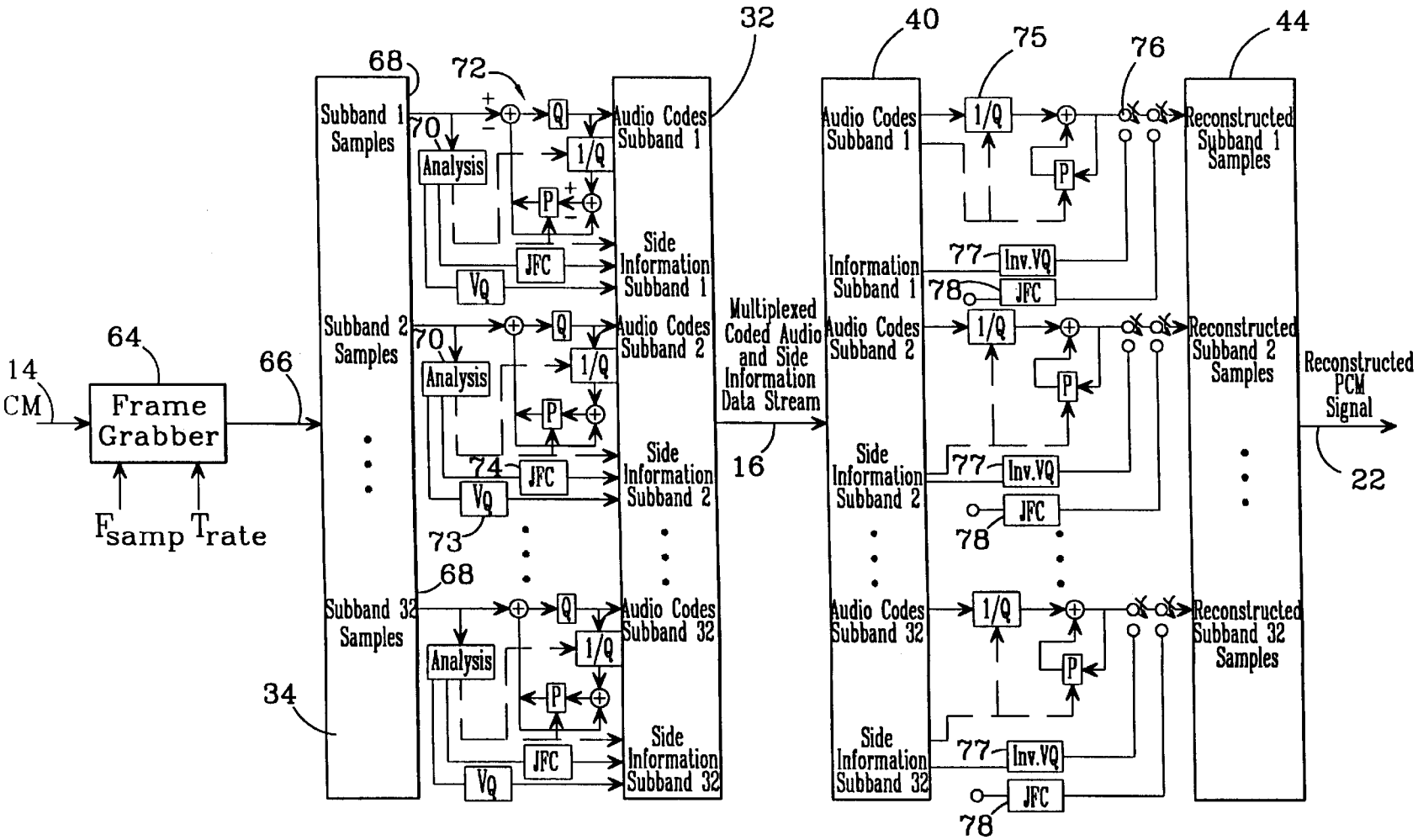
FIG. 5 is a block diagram of a single channel encoder.

In all the coding strategies described, the 32-band encoding/decoding process is carried out for the baseband portion of the audio bandwidth between 0–24 kHz for either 48 kHz, 96 kHz or 192 kHz sampling frequencies, and thus will be discussed in detail. As shown in FIG. 5, a frame grabber 64 windows the PCM audio channel 14 to segment it into successive data frames 66. The PCM audio window defines the number of contiguous input samples for which the encoding process generates an output frame in the data stream. The window size is set based upon the amount of compression, i.e. the ratio of the transmission rate to the sampling rate, such that the amount of data encoded in each frame is constrained. Each successive data frame 66 is split into 32 uniform frequency bands 68 by a 32-band 512-tap FIR decimation filter bank 34. The samples output from each subband are buffered and applied to the 32-band coding stage 36.

An analysis stage 70 (described in detail in FIGS. 12–24) generates optimal predictor coefficients, differential quantizer bit allocations and optimal quantizer scale factors for the buffered subband samples. The analysis stage 70 can also decide which subbands will be VQ and which will be joint frequency coded if these decisions are not fixed. This data, or side information, is fed forward to the selected ADPCM stage 72, VQ stage 73 or Joint Frequency Coding (JFC) stage 74, and to the data multiplexer 32 (packer). The subband samples are then encoded by the ADPCM or VQ process and the quantization codes input to the multiplexer. The JFC stage 74 does not actually encode subband samples but generates codes that indicate which channels' subbands are joined and where they are placed in the data stream. The quantization codes and the side information from each subband are packed into the data stream 16 and transmitted to the decoder.

On arrival at the decoder 18, the data stream is demultiplexed 40, or unpacked, back into the individual subbands. The scale factors and bit allocations are first installed into the inverse quantizers 75 together with the predictor coefficients for each subband. The differential codes are then reconstructed using either the ADPCM process 76 or the inverse VQ process 77 directly or the inverse JFC process 78 for designated subbands. The subbands are finally amalgamated back to a single PCM audio signal 22 using the 32-band interpolation filter bank 44.

PCM Signal Framing

Figure 6:
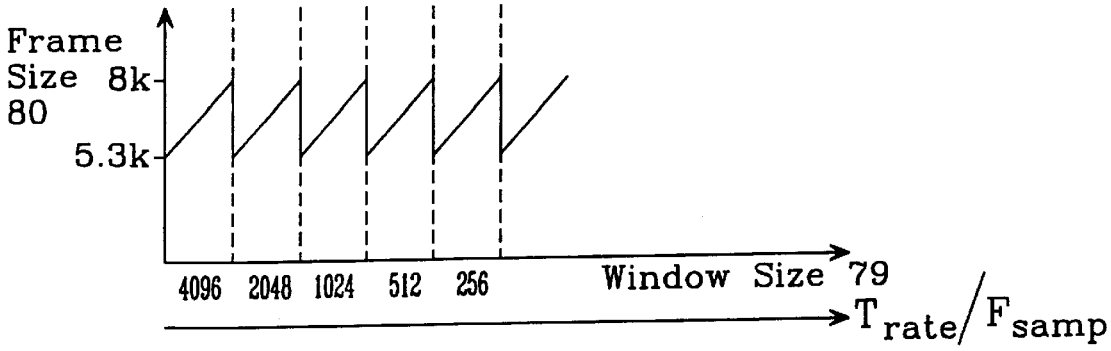
FIG. 6 is a plot of the bytes per frame versus frame size for variable transmission rates.

As shown in FIG. 6, the frame grabber 64 shown in FIG. 5 varies the size of the window 79 as the transmission rate changes for a given sampling rate so that the number of bytes per output frame 80 is constrained to lie between, for example, 5.3 k bytes and 8 k bytes. Tables 1 and 2 are design tables that allow a designer to select the optimum window size and decoder buffer size (frame size), respectively, for a given sampling rate and transmission rate. At low transmission rates the frame size can be relatively large. This allows the encoder to exploit the non-flat variance distribution of the audio signal over time and improve the audio coder's performance. For example, at a sampling rate of 48 kHz and a transmission rate of 384 kbps the optimum frame size is 4096 samples, which is split into 4 subframes of 1024 samples. At high rates, the frame size is reduced so that the total number of bytes does not overflow the decoder buffer. For example, at a sampling rate of 48 kHz and a transmission rate of 2048 kbps, the optimum frame size is 1024 samples, which constitutes a single subframe. As a result, a designer can provide the decoder with 8 k bytes of RAM to satisfy all transmission rates. This reduces the cost of the decoder. In general, the size of the audio window is given by:

$$\text{Audio Window} = (\text{Frame Size}) * F_{samp} * \left(\frac{8}{T_{rate}}\right)$$

where Frame Size is the size of the decoder buffer, $F_{samp}$ is the sampling rate, and $T_{rate}$ is the transmission rate. The size of the audio window is independent of the number of audio channels. However, as the number of channels is increased the amount of compression must also increase to maintain the desired transmission rate.

TABLE 1

| | $F_{samp}$ (kHz) | | | | |
|---|---|---|---|---|---|
| $T_{rate}$ | 8–12 | 16–24 | 32–48 | 64–96 | 128–192 |
| ≦512 kbps | 1024 | 2048 | 4096 | * | * |
| ≦1024 kbps | * | 1024 | 2048 | * | * |
| ≦2048 kbps | * | * | 1024 | 2048 | * |
| ≦4096 kbps | * | * | * | 1024 | 2048 |

TABLE 2

| | $F_{samp}$ (kHz) | | | | |
|---|---|---|---|---|---|
| $T_{rate}$ | 8–12 | 16–24 | 32–48 | 64–96 | 128–192 |
| <512 kbps | 8–5.3 k | 8–5.3 k | 8–5.3 k | * | * |
| <1024 kbps | * | 8–5.3 k | 8–5.3 k | * | * |
| <2048 kbps | * | * | 8–5.3 k | 8–5.3 k | * |
| <4096 kbps | * | * | * | 8–5.3 k | 8–5.3 k |

The 32-band 512-tap uniform decimation filterbank 34 selects from two polyphase filterbanks to split the data frames 66 into the 32 uniform subbands 68 shown in FIG. 6. The two filterbanks have different reconstruction properties that trade off subband coding gain against reconstruction precision. One class of filters is called perfect reconstruction (PR) filters. When the PR decimation (encoding) filter and its interpolation (decoding) filter are placed back-to-back the reconstructed signal is "perfect," where perfect is defined as being within 0.5 lsb at 24 bits of resolution. The other class of filters is called non-perfect reconstruction (NPR) filters because the reconstructed signal has a non-zero noise floor that is associated with the non-perfect aliasing cancellation properties of the filtering process.

Figure 7:
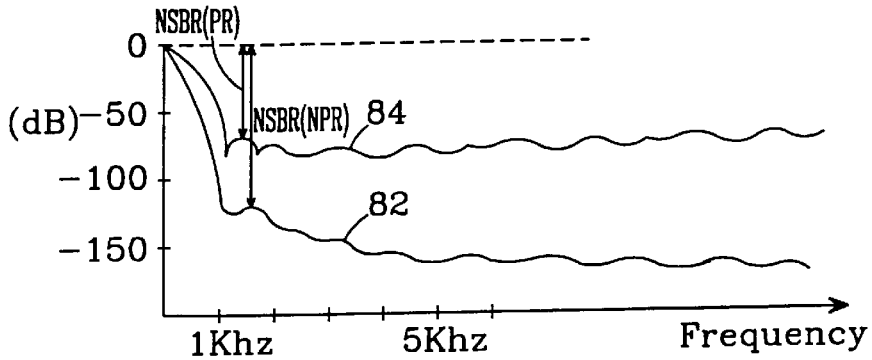
FIG. 7 is a plot of the amplitude response for the NPR and PR reconstruction filters.
Figure 8:
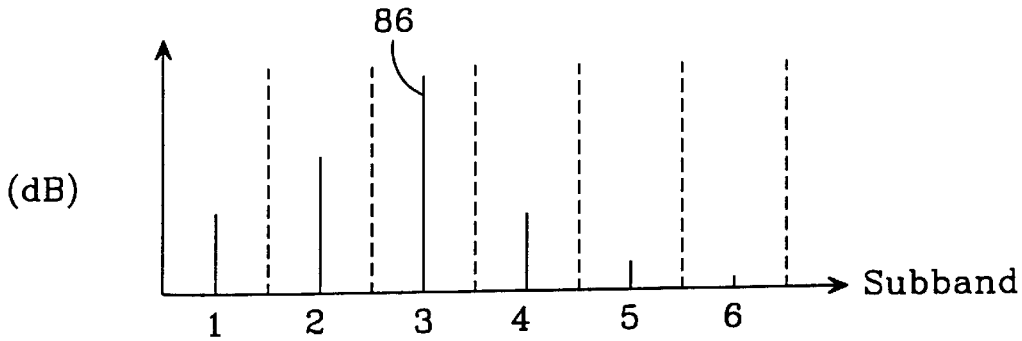
FIG. 8 is a plot of the subband aliasing for a reconstruction filter.

The transfer functions 82 and 84 of the NPR and PR filters, respectively, for a single subband are shown in FIG. 7. Because the NPR filters are not constrained to provide perfect reconstruction, they exhibit much larger near stop band rejection (NSBR) ratios, i.e. the ratio of the passband to the first side lobe, than the PR filters (110 dB v. 85 dB). As shown in FIG. 8, the sidelobes of the filter cause a signal 86 that naturally lies in the third subband to alias into the neighboring subbands. The subband gain measures the rejection of the signal in the neighboring subbands, and hence indicates the filter's ability to decorrelate the audio signal. Because the NPR filters, have a much larger NSBR ratio than the PR filters they will also have a much larger subband gain. As a result, the NPR filters provide better encoding efficiency.

Figure 9:
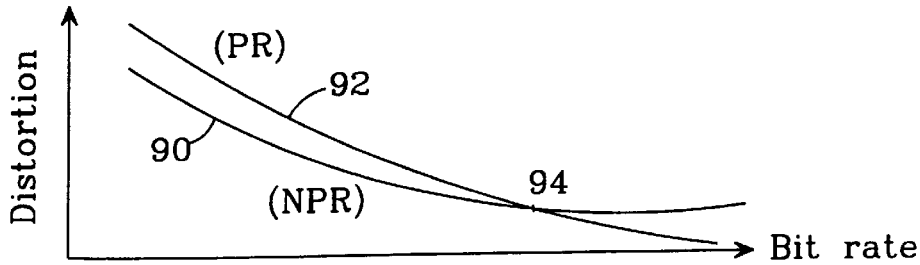
FIG. 9 is a plot of the distortion curves for the NPR and PR filters.

As shown in FIG. 9, the total distortion in the compressed data stream is reduced as the overall bit rate increases for both the PR and NPR filters. However, at low rates the difference in subband gain performance between the two filter types is greater than the noise floor associated with NPR filter. Thus, the NPR filter's associated distortion curve 90 lies below the PR filter's associated distortion curve 92. Hence, at low rates the audio coder selects the NPR filter bank. At some point 94, the encoder's quantization error falls below the NPR filter's noise floor such that adding additional bits to the ADPCM coder provides no additional benefits. At this point, the audio coder switches to the PR filter bank.

Although it is possible to switch the filter banks on the fly, the currently preferred, and simpler approach, is to select one filter type to encode the entire audio signal. The selection is roughly based on the total bit rate divided by the number of channels. If the bit rate per channel lies below the point 94 where the NPR and PR distortion curves cross than the NPR filterbank is selected. Otherwise, the PR filterbank is selected. However, in practice, the crossover point only provides a reference point. For example, a designer may decide to switch to PR filters at a lower rate due to the designer's personal preference or because the particular audio signal has a relatively high transient content. PR filters, by definition, perfectly reconstruct the transient components whereas the NPR filters will introduce transient distortion. Thus, the optimum switching point based on subjective quality may occur at a lower bit rate.

ADPCM Encoding

Figure 10:
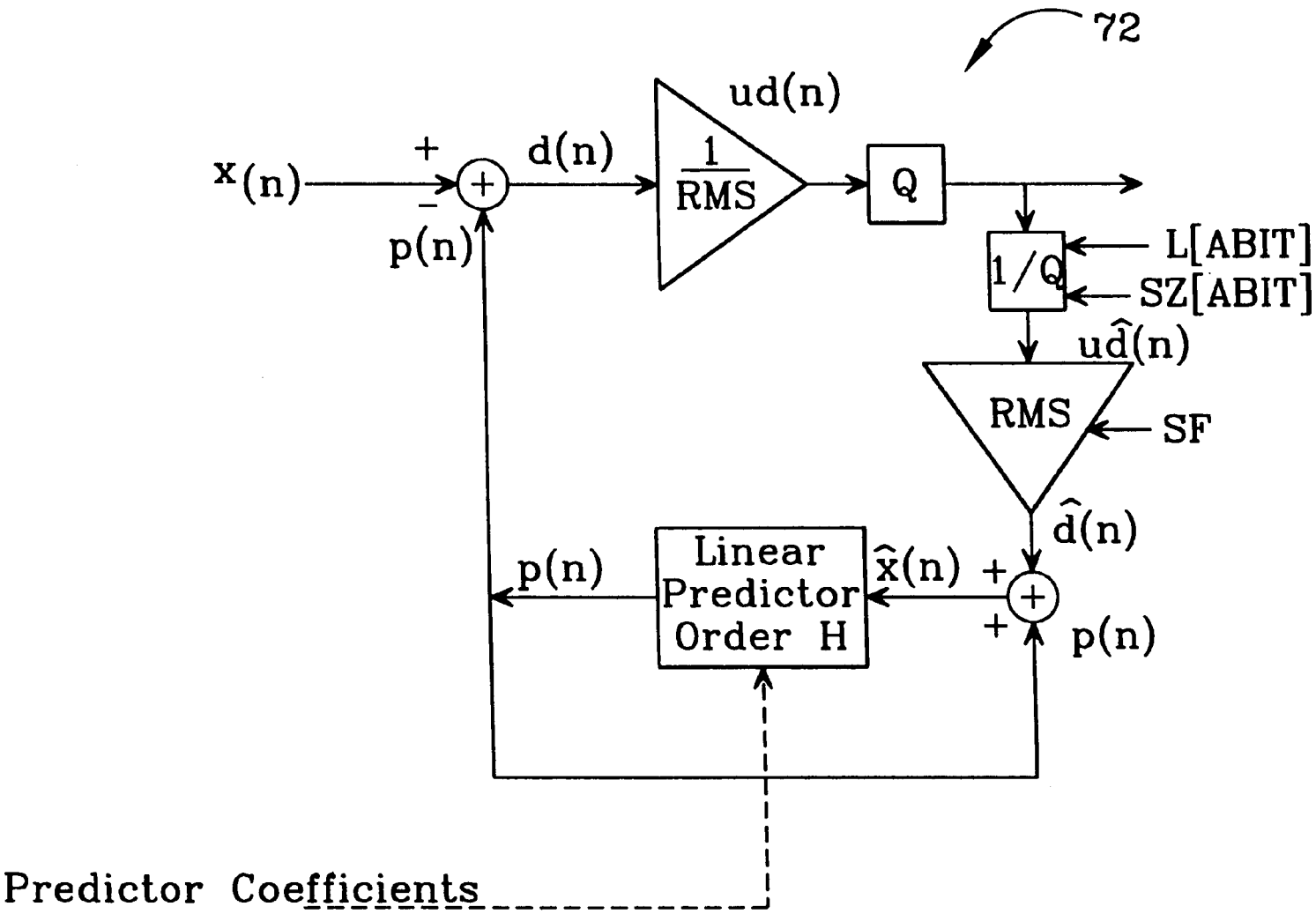
FIG. 10 is a schematic diagram of the forward ADPCM encoding block shown in FIG. 5.

The operation of the ADPCM encoder 72 is illustrated in FIG. 10 together with the following algorithmic steps 1–7. The first step is to generate a predicted sample p(n) from a linear combination of H previous reconstructed samples. This prediction sample is then subtracted from the input x(n) to give a difference sample d(n). The difference samples are scaled by dividing them by the RMS (or PEAK) scale factor to match the RMS amplitudes of the difference samples to that of the quantizer characteristic Q. The scaled difference sample ud(n) is applied to a quantizer characteristic with L levels of step-size SZ, as determined by the number of bits ABIT allocated for the current sample. The quantizer produces a level code QL(n) for each scaled difference sample ud(n). These level codes are ultimately transmitted to the decoder ADPCM stage. To update the predictor history, the quantizer level codes QL(n) are locally decoded using an inverse quantizer 1/Q with identical characteristics to that of Q to produce a quantized scaled difference sample $\hat{ud}(n)$. The sample $\hat{ud}(n)$ is rescaled by multiplying it with the RMS (or PEAK) scale factor, to produce $\hat{d}(n)$. A quantized version $\hat{x}(n)$ of the original input sample x(n) is reconstructed by adding the initial prediction sample p(n) to the quantized difference sample $\hat{d}(n)$. This sample is then used to update the predictor history.

ADPCM Decoding

Figure 11:
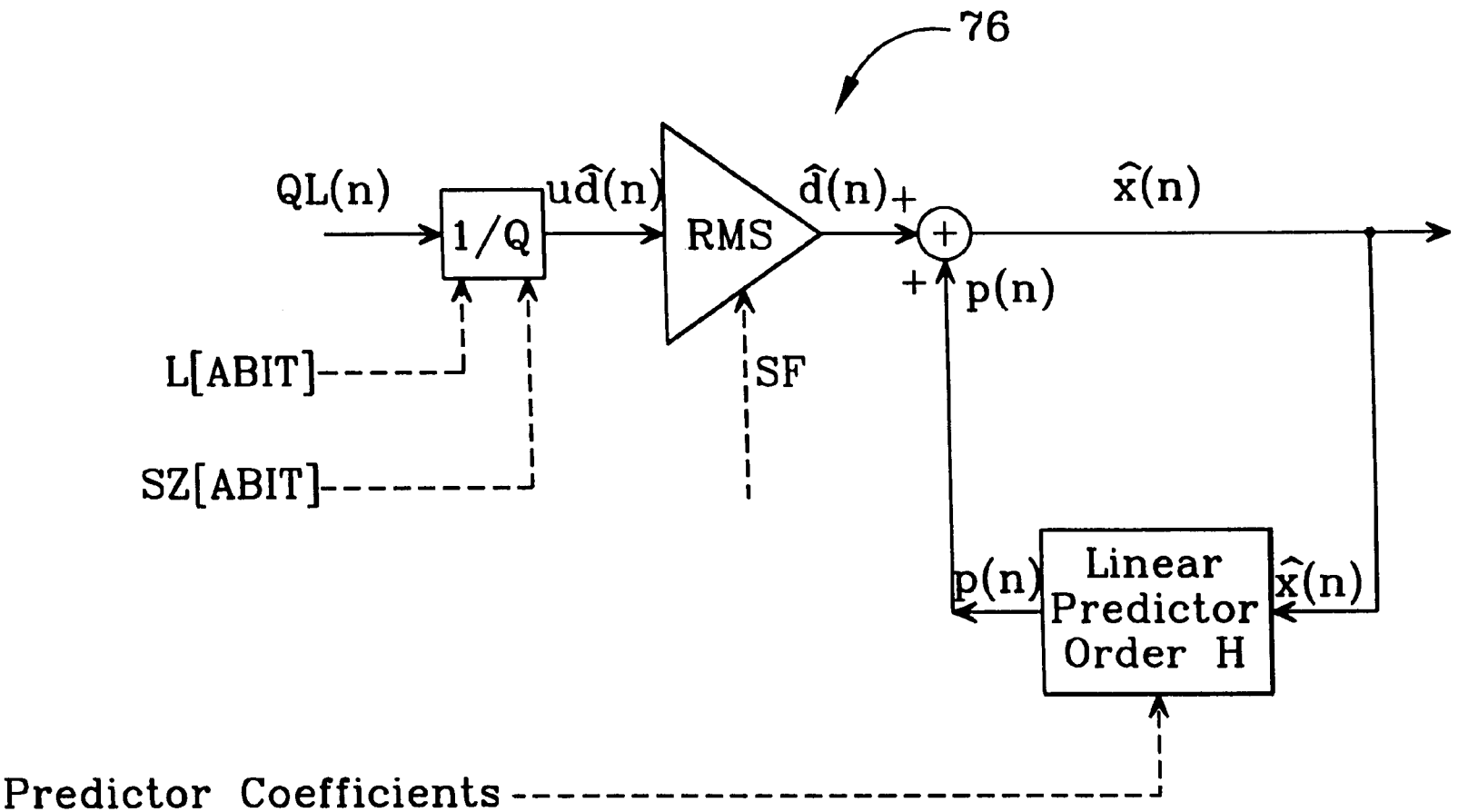
FIG. 11 is a schematic diagram of the forward ADPCM decoding block shown in FIG. 5.

The operation of the ADPCM decoder 76 is illustrated in FIG. 11 together with the algorithmic steps 1–4. The first step is to extract the ABIT, RMS (or PEAK) and $A_H$ predictor coefficients from the incoming data stream. Next a predicted sample p(n) is generated from a linear combination of H previous reconstructed samples. During normal operation both the previous reconstructed samples and the predictor coefficients are identical at encoder and decoder. Hence, the predicted samples p(n) are identical. The received quantizer level code QL(n) is inverse quantized using 1/Q. Since the ABIT allocations will be the same at encoder and decoder, the quantized scaled difference samples $\hat{ud}(n)$ are identical to those at the encoder. These samples are rescaled by multiplying it with the RMS (or PEAK) scale factor, producing $\hat{d}(n)$. Again, since the scale factors are equivalent at encoding and decoding ends, the decoded $\hat{d}(n)$ are the same as those at the encoder. The reconstructed samples $\hat{x}(n)$ are finally produced by adding the prediction sample p(n) to the quantized difference sample $\hat{d}(n)$ and are output as the decoded subband samples. As with the encoding ADPCM process, the reconstructed samples are also used to update the predictor history.

In summary, the performance of forward ADPCM coding depends mainly on the scale factor calculation, the bit allocation (ABIT) and the amplitude of the difference samples d(n).

1. The difference sample amplitude must on average be less than the input samples x(n) on average so that it is possible to use fewer quantization levels to code the difference signal with the same signal to quantization noise ratio (SNR). This means that the predictor must be capable of exploiting periodicity in the input samples.

2. The RMS or PEAK scale factors must be adjusted such that the scaled difference sample amplitudes are optimally matched to the input range of the quantizer to maximize the SNR of the reconstructed samples $\hat{X}(n)$ for any given bit allocation ABIT. If the scale factor is over estimated, the difference samples will tend to utilize only the lower quantizer levels, and hence result in sub-optimal SNR values. If the scale factors are under estimated, the quantizer range will not adequately cover the difference samples excursions and the occurrence of clipping will rise, leading also to a reduction in the reconstruction SNR.

3. The bit allocation ABIT determines the number of quantizer steps and the step-size within any characteristic, and hence the quantization noise level induced in the reconstructed signal (assuming optimal scaling). Generally speaking, the reconstruction SNR rises by approximately 6 dB for every doubling in the number of quantization levels.

Vector Ouantization

Vector Quantization Principles

The high frequency subband samples as well as the predictor coefficients are encoded using vector quantization (VQ). The VQ start subband can be fixed or may vary dynamically as a function of signal characteristics. VQ works by allocating codes for a group, or vector, of input samples, rather than operating on the individual samples. According to Shannon's theory, better performance/bit-rate ratios can always be obtain by coding in vectors.

The encoding of an input sample vector in a VQ is essentially a pattern matching process. The input vector is compared with all the patterns (codevectors) from a designed database (codebook). The closest match is then selected to represent the input vector based on one of several popular criteria such as mse that measure similarity. By sending the address of the matching codevector in the codebook rather than the vector itself the bit rate can be reduced. The decoding process of VQ is simply to retrieve the closest match codevector from the same codebook using the received address. The final codebook size M (number of codevectors) is related to the vector dimension N (number of samples in a codevector), and bit rate r as $M=2^{Nr}$.

Both N and r can be increased to improve the performance of a VQ system. The cost, however, is a much larger codebook, which means a more intense computation and memory requirement in its implementation. Although a wide range of techniques exist for codebook generation, to reduce computational complexity while maintaining design performance the following assumptions were used the design of each VQ codebook (predictor coefficient VQ and high frequency VQ):

a) Vectors in both VQ are viewed as patterns regardless of the nature of samples in order to simplify the design;

b) A MSE distortion measure is used as the similarity criterion;

c) Tree search techniques are used to reduce encoding computations; and d) Adequate bit rates are given to maintain the designed performance.

Design of Predictor Coefficient VQ Codebook

The predictor VQ has a vector dimension of 4 samples and a bit rate of 3 bits per sample. The final codebook therefore consists of 4096 codevectors of dimension 4. The search of matching vectors is structured as a two level tree with each node in the tree having 64 branches. The top level stores 64 node codevectors which are only needed at the encoder to help the searching process. The bottom level contacts 4096 final codevectors, which are required at both the encoder and the decoder. For each search, 128 MSE computations of dimension 4 are required. The codebook and the node vectors at the top level are trained using the LBG method, with over 5 million prediction coefficient training vectors. The training vectors are accumulated for all subband which exhibit a positive prediction gain while coding a wide range of audio material. For test vectors in a training set, average SNRs of approximately 30 dB are obtained.

Design of High Frequency Subband Sample VQ Codebook

The high frequency VQ has a vector dimension of 32 samples (the length of a subframe) and a bit rate of 0.3125 bits per sample. The final codebook therefore consists of 1024 codevectors of dimension 32. The search of matching vectors is structured as a two level tree with each node in the tree having 32 branches. The top level stores 32 node codevectors, which are only needed at the encoder. The bottom level contains 1024 final codevectors which are required at both the encoder and the decoder. For each search, 64 MSE computations of dimension 32 are required. The codebook and the node vectors at the top level are trained using the LBG method with over 7 million high frequency subband sample training vectors. The samples which make up the vectors are accumulated from the outputs of subbands 16 through 32 for a sampling rate of 48 kHz for a wide range of audio material. At a sampling rate of 48 kHz, the training samples represent audio frequencies in the range 12 to 24 kHz. For test vectors in the train set, an average SNR of about 3 dB is expected.

Although 3 dB is a small SNR, it is sufficient to provide high frequency fidelity or ambiance at these high frequencies. It is perceptually much better than the known techniques which simple drop the high frequency subbands.

Joint Frequency Coding

In very low bit rate applications overall reconstruction fidelity can be improved by coding only a summation of high frequency subband signals from two or more audio channels instead of coding them independently. Joint frequency coding is possible because the high frequency subbands oftentimes have similar energy distributions and because the human auditory system is sensitive primarily to the "intensity" of the high frequency components, rather than their fine structure. Thus, the reconstructed average signal provides good overall fidelity since at any bit rate more bits are available to code the perceptually important low frequencies.

Figure 12B:
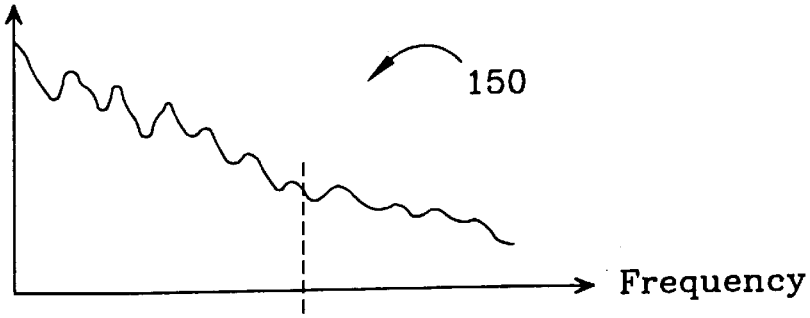
Figure 12B:
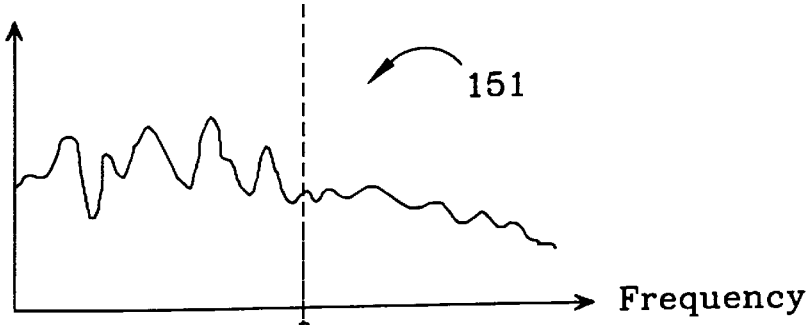
Figure 12C:
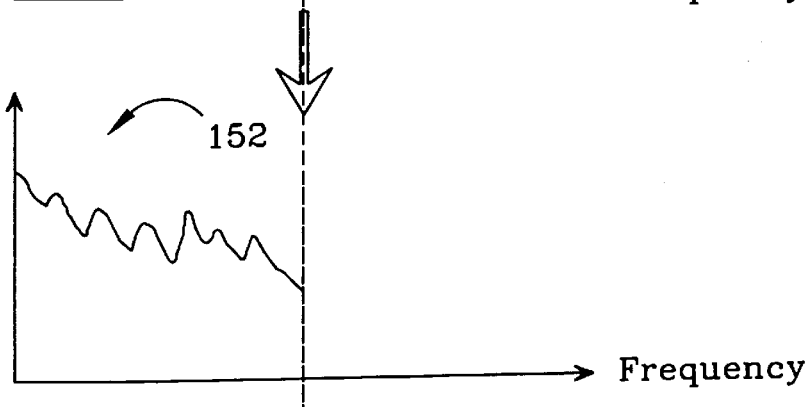
Figure 12D:
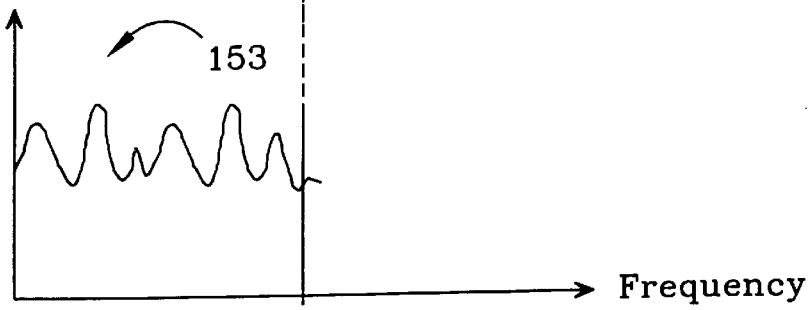
Figure 12E:
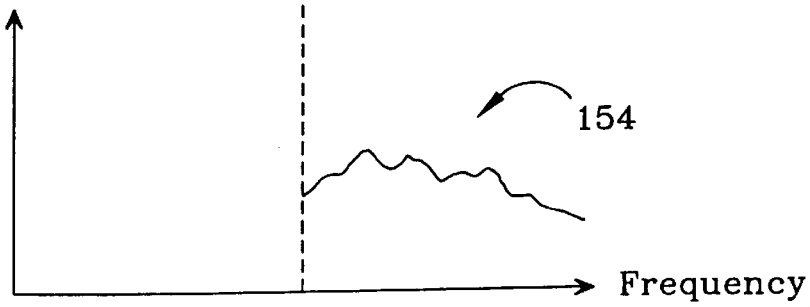

As shown in FIGS. 12*a* and 12*b,* the frequency responses 150 and 151 of two audio channels have very similar shapes above 10 kHz. Thus, the lower 16 subbands 152 and 153 shown in FIGS. 12*c* and 12*d,* respectively, are encoded separately and the averaged upper 16 subbands 154 shown in FIG. 12*e* are encoded using either the ADPCM or VQ encoding algorithms. Joint frequency coding indexes (JOINX) are transmitted directly to the decoder to indicate which channels and subbands have been joined and where the encoded signal is positioned in the data stream. The decoder reconstructs the signal in the designated channel and then copies it to each of the other channels. Each channel is then scaled in accordance with its particular RMS scale factor. Because joint frequency coding averages the time signals based on the similarity of their energy distributions, the reconstruction fidelity is reduced. Therefore, its application is typically limited to low bit rate applications and mainly to the 10–20 kHz signals. In the medium to high bit rate applications joint frequency coding is typically disabled.

Subband Encoder

Figure 13:
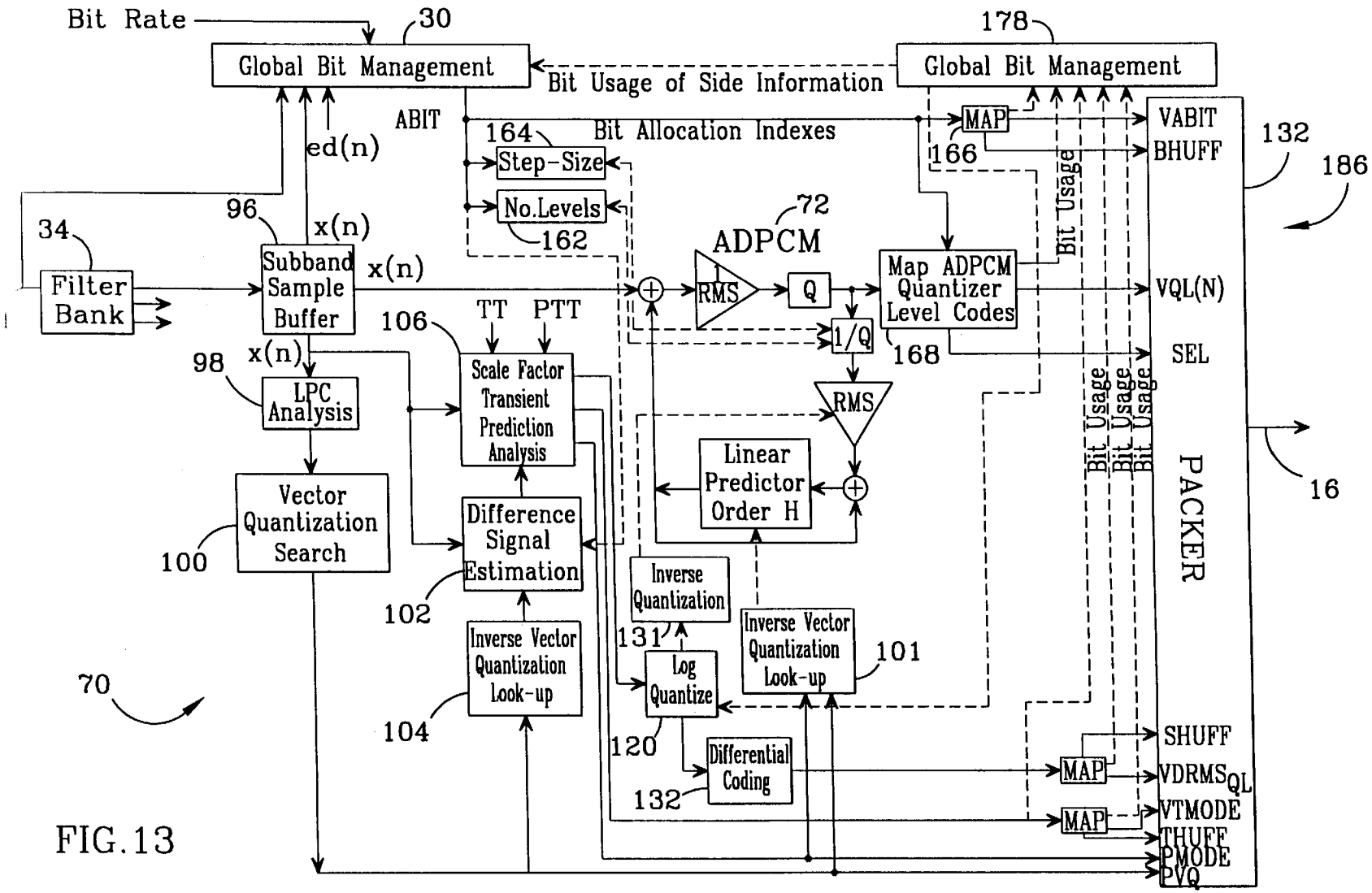
FIG. 13 is a schematic diagram of a single subband encoder.

The encoding process for a single sideband that is encoded using the ADPCM/APCM processes, and specifically the interaction of the analysis stage 70 and ADPCM coder 72 shown in FIG. 5 and the global bit management system 30 shown in FIG. 2, is illustrated in detail in FIG. 13. FIGS. 14–24 detail the component processes shown in FIG. 13. The filterbank 34 splits the PCM audio signal 14 into 32 subband signals x(n) that are written into respective subband sample buffers 96. Assuming a audio window size of 4096 samples, each subband sample buffer 96 stores a complete frame of 128 samples, which are divided into 4 32-sample subframes. A window size of 1024 samples would produce a single 32-sample subframe. The samples x(n) are directed to the analysis stage 70 to determine the prediction coefficients, the predictor mode (PMODE), the transient mode (TMODE) and the scale factors (SF) for each subframe. The samples x(n) are also provided to the GBM system 30, which determines the bit allocation (ABIT) for each subframe per subband per audio channel. Thereafter, the samples x(n) are passed to the ADPCM coder 72 a subframe at a time.

Estimation of Optimal Prediction Coefficients

The H, suitably $4^{th}$ order, prediction coefficients are generated separately for each subframe using the standard autocorrelation method 98 optimized over a block of subband samples x(n), i.e. the Weiner-Hopf or Yule-Walker equations. The analysis block may be overlapped with previous blocks and/or windowed using a function such as a Hamming or Blackman window. Windowing reduces the sample amplitudes at the block edges in order to improve the frequency resolution of the block. In a 4096 PCM sample coding window where the signal is decimated into 128 samples per subband, the subband predictor coefficients are updated and transmitted to the decoder for each of the four subframes.

Quantization of Optimal Prediction Coefficients

Each set of four predictor coefficients is preferably quantized using a 4-element tree-search 12-bit vector codebook (3 bits per coefficient) described above. The 12-bit vector codebook contains 4096 coefficient vectors that are optimized for a desired probability distribution using a standard clustering algorithm. A vector quantization (VQ) search 100 selects the coefficient vector which exhibits the lowest weighted mean squared error between itself and the optimal coefficients. The optimal coefficients for each subframe are then replaced with these "quantized" vectors. An inverse VQ LUT 101 is used to provide the quantized predictor coefficients to the ADPCM coder 72.

Alternately, the codebook may contain a range of PARCOR vectors where the matching procedure aims to locate the vector which exhibits the lowest weighted mean squared error between itself and the PARCOR representation of the optimal predictor coefficients. The minimal PARCOR vector is then converted back to quantized predictor coefficients which are used locally in the ADPCM loops. The PARCOR-to-quantized prediction coefficient conversion is best achieved using another look-up table to ensure that the prediction coefficient values are identical to those in the decoder look-up table. As another alternative, the quantizer table may contain a range of log-area vectors where the matching procedure aims to locate the vector which exhibits the lowest weighted mean squared error between itself and the log-area representation of the optimal coefficients. The minimal log-area vector is then converted back to quantized predictor coefficients which are used locally in the ADPCM loops. The log-area to quantized prediction coefficient conversion is best achieved using another look-up table to ensure that the coefficient values are identical to those in the decoder look-up table.

In all cases the respective code book addresses PVQ are transmitted to the decoder where they will be used to extract identical prediction coefficient vectors using a locally resident vector table. These predictor coefficients will be used in the decoding ADPCM loops.

Estimation of Prediction Difference Signal d(n)

A significant quandary with ADPCM is that the difference sample sequence d(n) cannot be easily predicted ahead of the actual recursive process 72 illustrated in FIGS. 10 and 13. A fundamental requirement of forward adaptive subband ADPCM is that the difference signal energy be known ahead of the ADPCM coding in order to calculate an appropriate bit allocation for the quantizer which will produce a known quantization error, or noise level in the reconstructed samples. Knowledge of the difference signal energy is also required to allow an optimal difference scale factor to be determined prior to encoding.

Unfortunately, the difference signal energy not only depends on the characteristics of the input signal but also on the performance of the predictor. Apart from the known limitations such as the predictor order and the optimality of the predictor coefficients, the predictor performance is also affected by the level of quantization error, or noise, induced in the reconstructed samples. Since the quantization noise is dictated by the final bit allocation ABIT and the difference scale factor RMS (or PEAK) values themselves, the difference signal energy estimate must be arrived at iteratively 102.

Step 1. Assume Zero Quantization Error

The first difference signal estimation is made by passing the buffered subband samples x(n) through an ADPCM process which does not quantize the difference signal. This is accomplished by disabling the quantization and RMS scaling in the ADPCM encoding loop. By estimating the difference signal d(n) in this way, the effects of the scale factor and the bit allocation values are removed from the calculation. However, the effect of the quantization error on the predictor coefficients is taken into account by the process by using the vector quantized prediction coefficients. An inverse VQ LUT 104 is used to provide the quantized prediction coefficients. To further enhance the accuracy of the estimate predictor, the history samples from the actual ADPCM predictor that were accumulated at the end of the previous block are copied into the predictor prior to the calculation. This ensures that the predictor starts off from where the real ADPCM predictor left off at the end of the previous input buffer.

The main discrepancy between this estimate ed(n) and the actual process d(n) is that the effect of quantization noise on the reconstructed samples x(n) and on the reduced prediction accuracy is ignored. For quantizers with a large number of levels the noise level will generally be small (assuming proper scaling) and therefore the actual difference signal energy will closely match that calculated in the estimate. However, when the number of quantizer levels is small, as is the case for typical low bit rate audio coders, the actual predicted signal, and hence the difference signal energy, may differ significantly from the estimated one. This produces coding noise floors that are different from those predicted earlier in the adaptive bit allocation process.

Despite this, the variation in prediction performance may not be significant for the application or bit rate. Thus, the estimate can be used directly to calculate the bit allocations and the scale factors without iterating. An additional refinement would be to compensate for the performance loss by deliberately over-estimating the difference signal energy if it is likely that a quantizer with a small number of levels is to be allocated to that subband. The over-estimation may also be graded according to the changing number of quantizer levels for improved accuracy.

Step 2. Recalculate using Estimated Bit Allocations and Scale Factors

Once the bit allocations (ABIT) and scale factors (SF) have been generated using the first estimation difference signal, their optimality may be tested by running a further ADPCM estimation process using the estimated ABIT and RMS (or PEAK) values in the ADPCM loop 72. As with the first estimate, the estimate predictor history is copied from the actual ADPCM predictor prior to starting the calculation to ensure that both predictors start from the same point. Once the buffered input samples have all passed through this second estimation loop, the resulting noise floor in each subband is compared to the assumed noise floor in the adaptive bit allocation process. Any significant discrepancies can be compensated for by modifying the bit allocation and/or scale factors.

Step 2 can be repeated to suitably refine the distributed noise floor across the subbands, each time using the most current difference signal estimate to calculate the next set of bit allocations and scale factors. In general, if the scale factors would change by more than approximately 2–3 dB, then they are recalculated. Otherwise the bit allocation would risk violating the signal-to-mask ratios generating by the psychoacoustic masking process, or alternately the mmse process. Typically, a single iteration is sufficient.

Calculation of Subband Prediction Modes (PMODE)

To improve the coding efficiency, a controller 106 can arbitrarily switch the prediction process off when the prediction gain in the current subframe falls below a threshold by setting a PMODE flag. The PMODE flag is set to one when the prediction gain (ratio of the input signal energy and the estimated difference signal energy), measured during the estimation stage for a block of input samples, exceeds some positive threshold. Conversely, if the prediction gain is measured to be less than the positive threshold the ADPCM predictor coefficients are set to zero at both encoder and decoder, for that subband, and the respective PMODE is set to zero. The prediction gain threshold is set such that it equals the distortion rate of the transmitted predictor coefficient vector overhead. This is done in an attempt to ensure that when PMODE=1, the coding gain for the ADPCM process is always greater than or equal to that of a forward adaptive PCM (APCM) coding process. Otherwise by setting PMODE to zero and resetting the predictor coefficients, the ADPCM process simply reverts to APCM.

The PMODEs can be set high in any or all subbands if the ADPCM coding gain variations are not important to the application. Conversely, the PMODES can be set low if, for example, certain subbands are not going to be coded at all, the bit rate of the application is high enough that prediction gains are not required to maintain the subjective quality of the audio, the transient content of the signal is high, or the splicing characteristic of ADPCM encoded audio is simply not desirable, as might be the case for audio editing applications.

Separate prediction modes (PMODEs) are transmitted for each subband at a rate equal to the update rate of the linear predictors in the encoder and decoder ADPCM processes. The purpose of the PMODE parameter is to indicate to the decoder if the particular subband will have any prediction coefficient vector address associated with its coded audio data block. When PMODE=1 in any subband then a predictor coefficient vector address will always be included in the data stream. When PMODE=0 in any subband then a predictor coefficient vector address will never be included in the data stream and the predictor coefficients are set to zero at both encoder and decoder ADPCM stages.

The calculation of the PMODEs begins by analyzing the buffered subband input signal energies with respect to the corresponding buffered estimated difference signal energies obtained in the first stage estimation, i.e. assuming no quantization error. Both the input samples x(n) and the estimated difference samples ed(n) are buffered for each subband separately. The buffer size equals the number of samples contained in each predictor update period, e.g. the size of a subframe. The prediction gain is then calculated as:

$$P_{gain}\ (\text{dB})=20.0*\text{Log}_{10}(\text{RMS}_{x(n)}/\text{RMS}_{ed(n)})$$

where $\text{RMS}_{x(n)}$=root mean square value of the buffered input samples x(n) and $\text{RMS}_{ed(n)}$=root mean square value of the buffered estimated difference samples ed(n).

For positive prediction gains, the difference signal is, on average, smaller than the input signal, and hence a reduced reconstruction noise floor may be attainable using the ADPCM process over APCM for the same bit rate. For negative gains, the ADPCM coder is making the difference signal, on average, greater than the input signal, which results in higher noise floors than APCM for the same bit rate. Normally, the prediction gain threshold, which switches PMODE on, will be positive and will have a value which takes into account the extra channel capacity consumed by transmitting the predictor coefficients vector address.

For example, if the predictors were updated every 50 ms by transmitting a 12-bit prediction coefficient vector, then for a 32-band filter bank the predictor overhead in each subband for which PMODE=1 is 12 bits/75 samples, or 0.16 bits per sample. Theoretically the loss of 0.16 bits per subband sample translates to an average increase in noise in the reconstructed subband samples of approximately 1 dB (assuming linear quantization). Hence, the prediction gain threshold in this example would be at least 1 dB in an attempt to keep the predictor off during periods when differential coding gains are not possible. Higher thresholds may be necessary if, for example, the differential scale factor quantizer cannot accurately resolve the scale factors.

As discussed earlier, it may be desirable to estimate the difference signal energy more than once (i.e. use Step 2) in order to better predict the interaction between the quantization noise and the predictor performance with the ADPCM loop. Likewise, the validity of the PMODE flag can also be rechecked at the same time. This would ensure that any subband, which experiences a loss in prediction gain as a result of using the quantizer requested by the bit allocation such that the new gain value fell below the threshold, will have its PMODE reset to zero.

Calculation of Subband Transient Modes (TMODE)

The controller 106 calculates the transient modes (TMODE) for each subframe in each subband. The TMODEs indicate the number of scale factors and the samples in the estimated difference signal ed(n) buffer when PMODE=1 or in the input subband signal x(n) buffer when PMODE=0, for which they are valid. The TMODEs are updated at the same rate as the prediction coefficient vector addresses and are transmitted to the decoder. The purpose of the transient modes is to reduce audible coding "pre-echo" artifacts in the presence of signal transients.

A transient is defined as a rapid transition between a low amplitude signal and a high amplitude signal. Because the scale factors are averaged over a block of subband difference samples, if a rapid change in signal amplitude takes place in a block, i.e. a transient occurs, the calculated scale factor tends to be much larger than would be optimal for the low amplitude samples preceding the transient. Hence, the quantization error in samples preceding transients can be very high. This noise is perceived as pre-echo distortion.

In practice, the transient mode is used to modify the subband scale factor averaging block length to limit the influence of a transient on the scaling of the differential samples immediately preceding it. The motivation for doing this is the pre-masking phenomena inherent in the human auditory system, which suggests that in the presence of transients noise can be masked prior to a transient provided that its duration is kept short.

Depending on the value of PMODE either the contents, i.e. the subframe, of the subband sample buffer x(n) or that of the estimated difference buffer ed(n) are copied into a transient analysis buffer. Here the buffer contents are divided uniformly into either 2, 3 or 4 sub-subframes depending on the sample size of the analysis buffer. For example, if the analysis buffer contains 32 subband samples (21.3 ms @1500 Hz), the buffer is partitioned into 4 sub-subframes of 8 samples each, giving a time resolution of 5.3 ms for a subband sampling rate of 1500 Hz. Alternately, if the analysis window was configured at 16 subband samples, then the buffer need only be divided into two sub-subframes to give the same time resolution.

The signal in each sub-subframe is analyzed and the transient status of each, other than the first, is determined. If any sub-subframes are declared transient, two separate scale factors are generated for the analysis buffer, i.e. the current subframe. The first scale factor is calculated from samples in the sub-subframes preceding the transient sub-subframe. The second scale factor is calculated from samples in the transient sub-subframe together with all proceeding sub-subframes.

The transient status of the first sub-subframe is not calculated since the quantization noise is automatically limited by the start of the analysis window itself. If more than one sub-subframe is declared transient, then only the one which occurs first is considered. If no transient sub-buffers are detected at all, then only a single scale factor is calculated using all of the samples in the analysis buffer. In this way scale factor values which include transient samples are not used to scale earlier samples more than a sub-subframe period back in time. Hence, the pre-transient quantization noise is limited to a sub-subframe period.

Transient Declaration

A sub-subframe is declared transient if the ratio of its energy over the preceding sub-buffer exceeds a transient threshold (TT), and the energy in the preceding sub-subframe is below a pre-transient threshold (PTT). The values of TT and PTT will depend on the bit rate and the degree of pre-echo suppression required. They are normally varied until perceived pre-echo distortion matches the level of other coding artifacts if they exist. Increasing TT and/or decreasing PTT values will reduce the likelihood of sub-subframes being declared transient, and hence will reduce the bit rate associated with the transmission of the scale factors. Conversely, reducing TT and/or increasing PTT values will increase the likelihood of sub-subframes being declared transient, and hence will increase the bit rate associated with the transmission of the scale factors.

Since TT and PTT are individually set for each subband, the sensitivity of the transient detection at the encoder can be arbitrarily set for any subband. For example, if it is found that pre-echo in high frequency subbands is less perceptible than in lower frequency subbands, then the thresholds can be set to reduce the likelihood of transients being declared in the higher subbands. Moreover, since TMODEs are embedded in the compressed data stream, the decoder never needs to know the transient detection algorithm in use at the encoder in order to properly decode the TMODE information.

Two Sub-buffer Configuration

If the first sub-buffer is declared transient or if no transient sub-buffers are detected, then TMODE=0. Otherwise TMODE=1.

Three Sub-buffer Configuration

If the first sub-buffer is transient, or if no transient sub-buffers are detected, then TMODE=0. If the second sub-buffer is transient but not the first, then TMODE=1. If only the third sub-buffer is transient then TMODE=2.

Four Sub-buffer Configuration

As shown in FIG. 14*a,* if the first sub-subframe 108 in the subband analysis buffer 109 is transient, or if no transient sub-subframes are detected, then TMODE=0. If the second sub-subframe is transient but not the first, then TMODE=1. If the third sub-subframe is transient but not the first or second, then TMODE=2. If only the fourth sub-subframe is transient then TMODE=3.

Calculation of Scale Factors

As shown in FIG. 14*b,* when TMODE=0 the scale factors 110 are calculated over all sub-subframes. When TMODE=1, the first scale factor is calculated over the first sub-subframe and the second scale factor over all proceeding sub-subframes. When TMODE=2 the first scale factor is calculated over the first and second sub-subframes and the second scale factor over all proceeding sub-subframes. When TMODE=3 the first scale factor is calculated over the first, second and third sub-subframes and the second scale factor is calculated over the fourth sub-subframe.

ADPCM Encoding and Decoding using TMODE

When TMODE=0 the single scale factor is used to scale the subband difference samples for the duration of the entire analysis buffer, i.e. a subframe, and is transmitted to the decoder to facilitate inverse scaling. When TMODE>0 then two scale factors are used to scale the subband difference samples and both transmitted to the decoder. For any TMODE, each scale factor is used to scale the differential samples used to generate the it in the first place.

Calculation of Subband Scale Factors (RMS or PEAK)

Depending on the value of PMODE for that subband, either the estimated difference samples ed(n) or input subband samples x(n) are used to calculate the appropriate scale factor(s). The TMODEs are used in this calculation to determine both the number of scale factors and to identify the corresponding sub-subframes in the buffer.

RMS Scale Factor Calculation

For the jth subband, the rms scale factors are calculated as follows:

When TMODE=0 then the single rms value is;

$$RMS_j = \left(\sum_{n=1}^{L} e(d(n))^2 / L\right)^{0.5}$$

where L is the number of samples in the subframe. When TMODE>0 then the two rms values are;

$$RMS1_j = \left(\sum_{n=1}^{k} e(d(n))^2 / L\right)^{0.5}$$

$$RMS2_j = \left(\sum_{n=1}^{k+1} e(d(n))^2 / L\right)^{0.5}$$

where k=(TMODE*L/NSB) and NSB is the number of uniform sub-subframes.

If PMODE=0 then the $ed_j(n)$ samples are replaced with the input samples $x_j(n)$.

PEAK scale Factor Calculation

For the jth subband, the peak scale factors are calculated as follows;

When TMODE=0 then the single peak value is;

$PEAK_j$=MAX(ABS($ed_j$(n))) for n=1, L

When TMODE>0 then the two peak values are;

$PEAK1_j$=MAX(ABS($ed_j$(n))) for n=1, (TMODE*L/NSB)

$PEAK2_j$=MAX(ABS($ed_j$(n))) for n=(1+TMODE*L/NSB), L

If PMODE=0 then the $ed_j(n)$ samples are replaced with the input samples $x_j(n)$.

Ouantization of PMODE, TMODE and Scale Factors

Quantization of PMODEs

The prediction mode flags have only two values, on or off, and are transmitted to the decoder directly as 1-bit codes.

Quantization of TMODEs

The transient mode flags have a maximum of 4 values; 0, 1, 2 and 3, and are either transmitted to the decoder directly using 2-bit unsigned integer code words or optionally via a 4-level entropy table in an attempt to reduce the average word length of the TMODEs to below 2 bits. Typically the optional entropy coding is used for low-bit rate applications in order to conserve bits.

Figure 15:
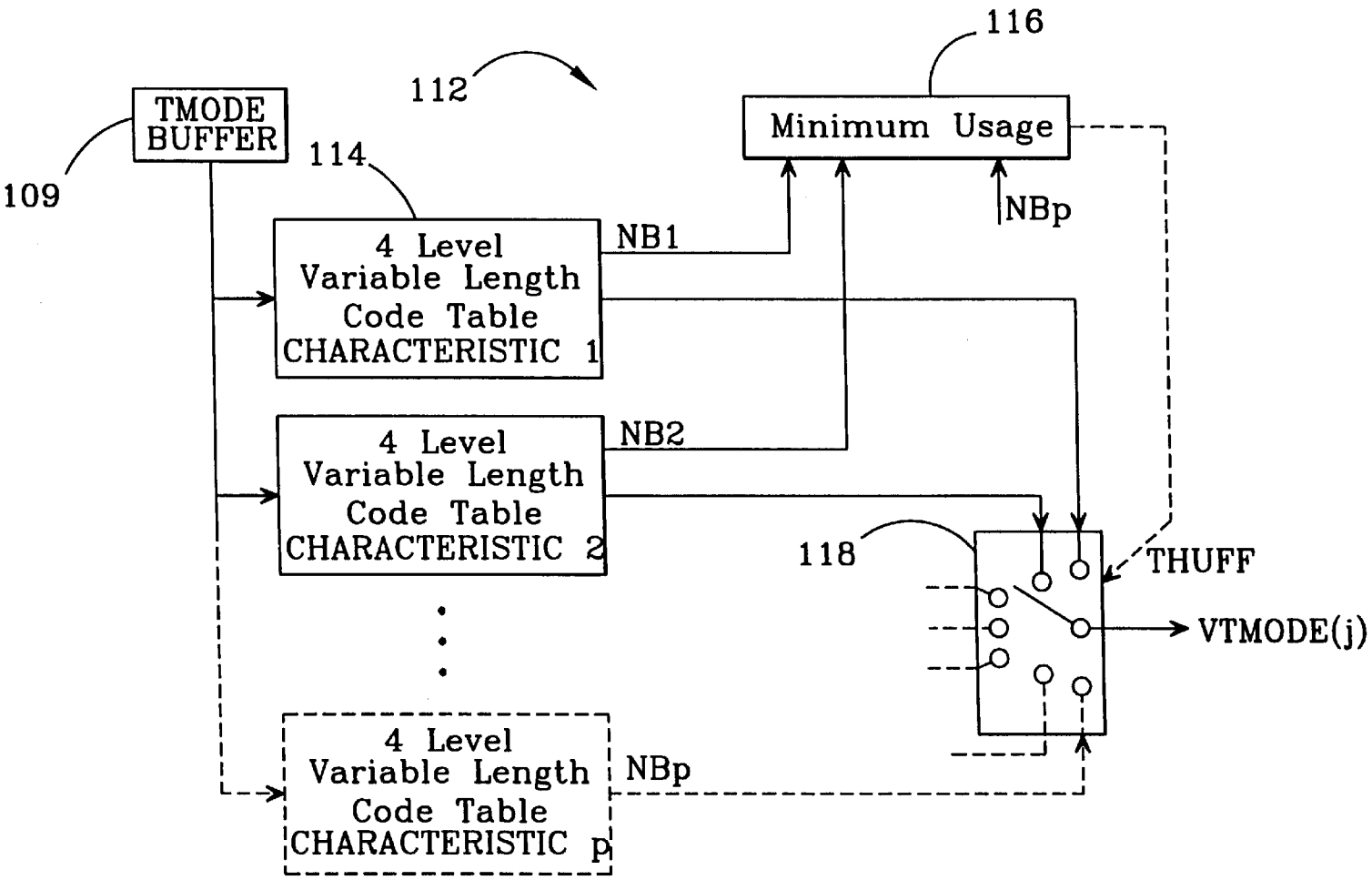
FIG. 15 illustrates the entropy coding process for the quantized TMODES.

The entropy coding process 112 illustrated in detail in FIG. 15 is as follows; the transient mode codes TMODE(j)

for the j subbands are mapped to a number (p) of 4-level mid-riser variable length code book, where each code book is optimized for a different input statistical characteristic. The TMODE values are mapped to the 4-level tables 114 and the total bit usage associated with each table ($NB_p$) is calculated 116. The table that provides the lowest bit usage over the mapping process is selected 118 using the THUFF index. The mapped codes, VTMODE(j), are extracted from this table, packed and transmitted to the decoder along with the THUFF index word. The decoder, which holds the same set of 4-level inverse tables, uses the THUFF index to direct the incoming variable length codes, VTMODE(j), to the proper table for decoding back to the TMODE indexes.

Quantization of Subband Scale Factors

In order to transmit the scale factors to the decoder they must be quantized to a known code format. In this system they are quantized using either a uniform 64-level logarithmic characteristic, a uniform 128-level logarithmic characteristic, or a variable rate encoded uniform 64-level logarithmic characteristic 120. The 64-level quantizer exhibits a 2.25 dB step-size in both cases, and the 128-level a 1.25 dB step-size. The 64-level quantization is used for low to medium bit-rates, the additional variable rate coding is used for low bit-rate applications, and the 128-level is generally used for high bit-rates.

Figure 16:
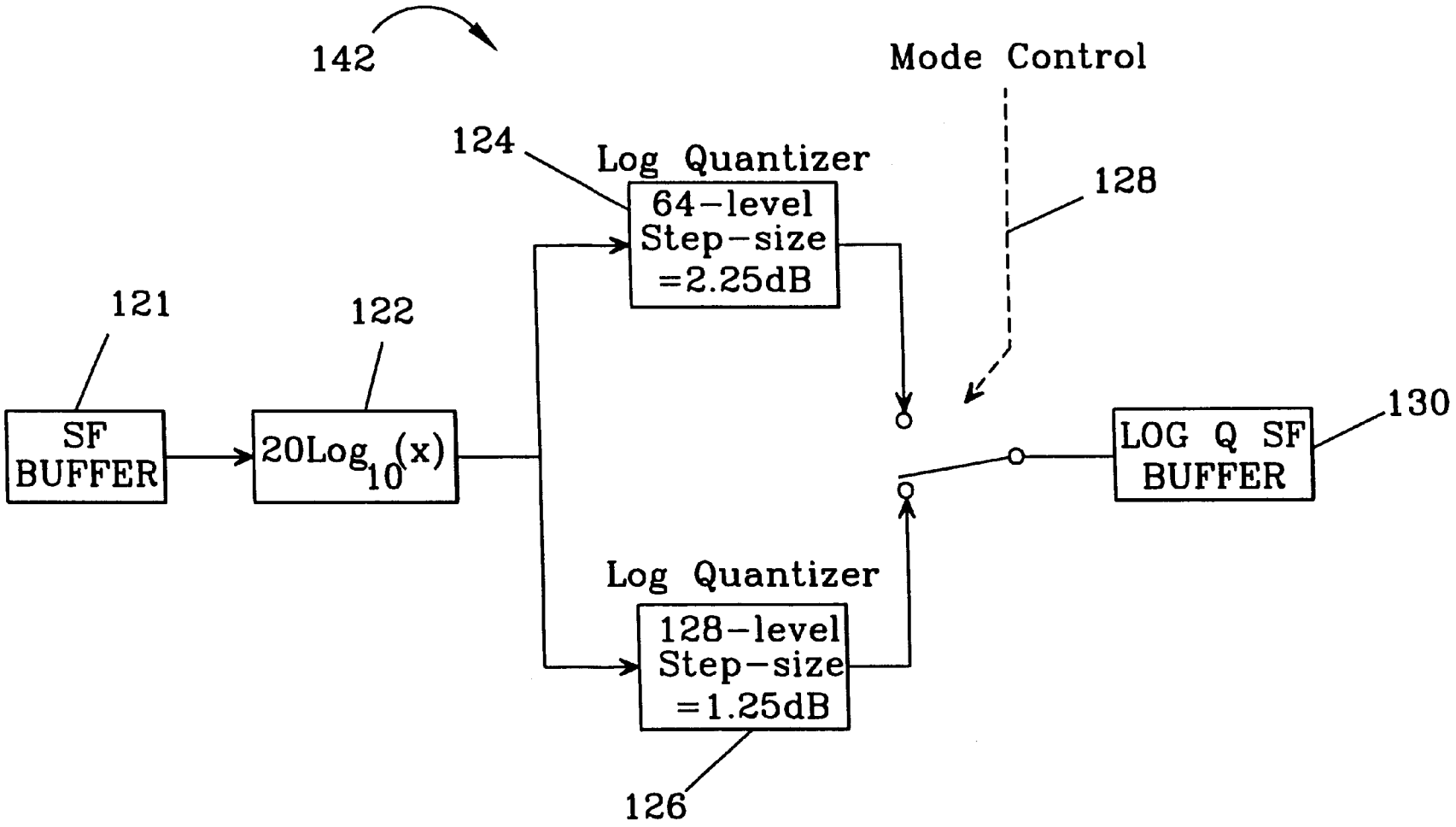
FIG. 16 illustrates the scale factor quantization process.

The quantization process 120 is illustrated in FIG. 16. The scale factors, RMS or PEAK, are read out of a buffer 121, converted to the log domain 122, and then applied either to a 64-level or 128-level uniform quantizers 124, 126 as determined by the encoder mode control 128. The log quantized scale factors are then written into a buffer 130. The range of the 128 and 64-level quantizers are sufficient to cover scale factors with a dynamic range of approximately 160 dB and 144 dB, respectively. The 128-level upper limit is set to cover the dynamic range of 24-bit input PCM digital audio signals. The 64-level upper limit is set to cover the dynamic range of 20-bit input PCM digital audio signals.

The log scale factors are mapped to the quantizer and the scale factor is replaced with the nearest quantizer level code $RMS_{QL}$ (or $PEAK_{QL}$). In the case of the 64-level quantizer these codes are 6-bits long and range between 0–63. In the case of the 128-level quantizer, the codes are 7-bits long and range between 0–127.

Inverse quantization 131 is achieved simply by mapping the level codes back to the respective inverse quantization characteristic to give $RMS_q$ (or $PEAK_q$) values. Quantized scale factors are used both at the encoder and decoder for the ADPCM (or APCM if PMODE=0) differential sample scaling, thus ensuring that both scaling and inverse scaling processes are identical.

If the bit-rate of the 64-level quantizer codes needs to be reduced, additional entropy, or variable length coding is performed. The 64-level codes are first order differentially encoded 132 across the j subbands, starting at the second subband (j=2) to the highest active subband. The process can also be used to code PEAK scale factors. The signed differential codes $DRMS_{QL}(j)$, (or $DPEAK_{QL}(j)$) have a maximum range of +/−63 and are stored in a buffer 134. To reduce their bit rate over the original 6-bit codes, the differential codes are mapped to a number (p) of 127-level mid-riser variable length code books. Each code book is optimized for a different input statistical characteristic.

Figure 17:
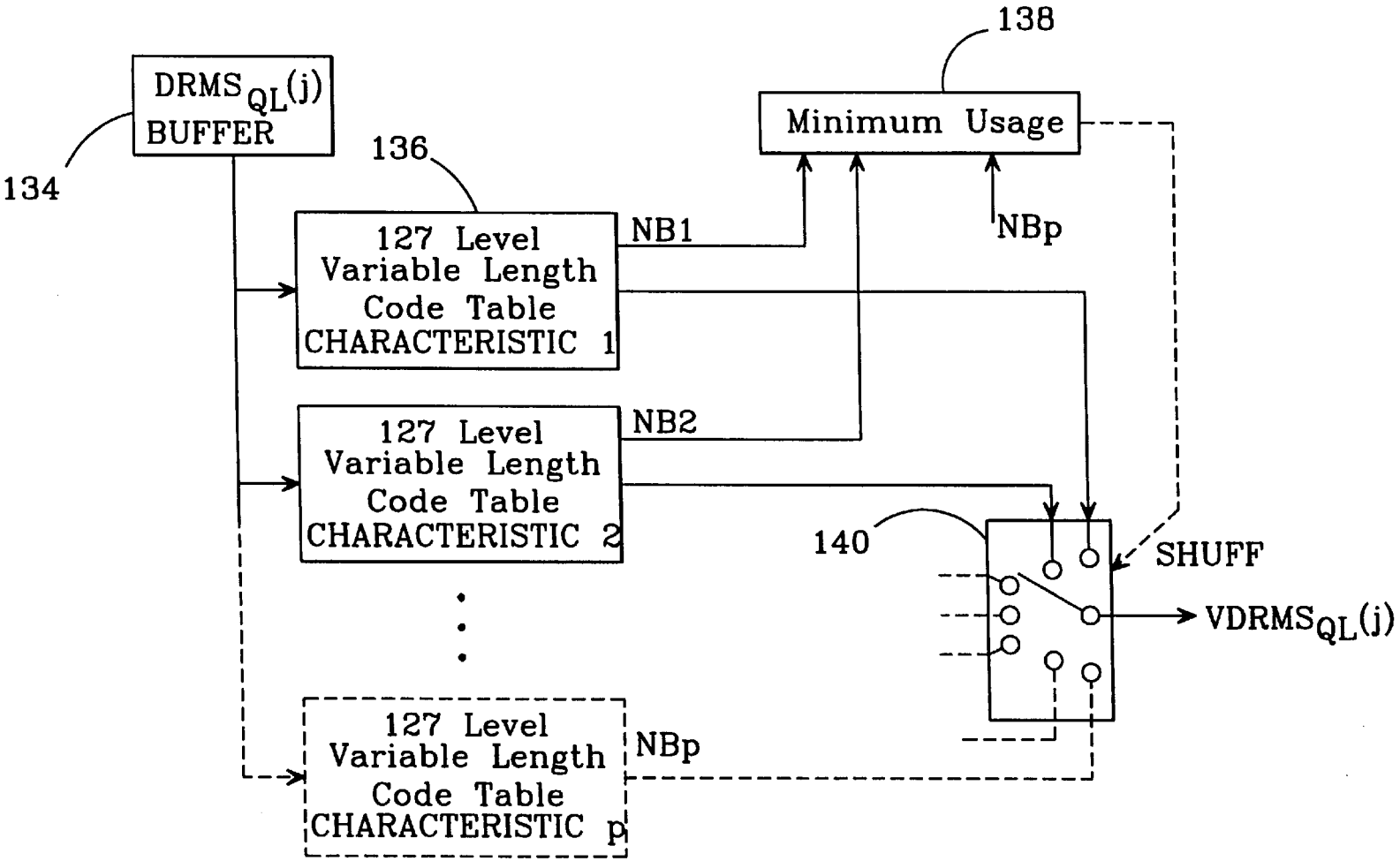
FIG. 17 illustrates the entropy coding process for the scale factors.

This process is illustrated in FIG. 17 using the differential log RMS level codes. The differential level codes are mapped to (p) 127-level tables 136 and the total bit usage associated with each table ($NB_p$) is calculated 138. The table which provides the lowest bit usage over the mapping process is selected 140 using the SHUFF index. The mapped codes $VDRMS_{QL}(j)$ are extracted from this table, packed and transmitted to the decoder along with the SHUFF index word. The decoder, which holds the same set of (p) 127-level inverse tables, uses the SHUFF index to direct the incoming variable length codes to the proper table for decoding back to differential quantizer code levels. The differential code levels are returned to absolute values using the following routines;

$RMS_{QL}(1)=DRMS_{QL}(1)$ $RMS_{QL}(j)=DRMS_{QL}(j)+RMS_{QL}(j-1)$ for j=2, . . . K and PEAK differential code levels are returned to absolute values using the following routines;

$PEAK_{QL}(1)=DPEAK_{QL}(1)$ $PEAK_{QL}(j)=DPEAK_{QL}(j)+PEAK_{QL}(j-1)$ for j=2, . . . K where in both cases K=number of active subbands.

Global Bit Allocation

The Global Bit Management system 30 shown in FIG. 13 manages the bit allocation (ABIT), determines the number of active subbands (SUBS) and the joint frequency strategy (JOINX) and VQ strategy for the multi-channel audio encoder to provide subjectively transparent encoding at a reduced bit rate. This increases the number of audio channels an d/or the playback time that can be encoded and stored on a fixed medium while maintaining or improving audio fidelity. In general, the GBM system 30 first allocates bits to each subband according to a psychoacoustic analysis modified by the prediction gain of the encoder. The remaining bits are then allocated in accordance with a mmse scheme to lower the overall noise floor. To optimize encoding efficiency, the GBM system simultaneously allocates bits over all of the audio channels, all of the subbands, and across the entire frame. Furthermore, a joint frequency coding strategy can be employed. In this manner, the system takes advantage of the non-uniform distribution of signal energy between the audio channels, across frequency, and over time.

Psychoacoustic Analysis

Psychoacoustic measurements are used to determine perceptually irrelevant information in the audio signal. Perceptually irrelevant information is defined as those parts of the audio signal which cannot be heard by human listeners, and can be measured in the time domain, the frequency domain, or in some other basis. J. D. Johnston: "Transform Coding of Audio Signals Using Perceptual Noise Criteria" IEEE Journal on Selected Areas in Communications, vol JSAC-6, no. 2, pp. 314–323, February 1988 described the general principles of psychoacoustic coding.

Two main factors influence the psychoacoustic measurement. One is the frequency dependent absolute threshold of hearing applicable to humans. The other is the masking effect that one sound has on the ability of humans to hear a second sound played simultaneously or even after the first sound. In other words the first sound prevents us from hearing the second sound, and is said to mask it out.

In a subband coder the final outcome of a psychoacoustic calculation is a set of numbers which specify the inaudible level of noise for each subband at that instant. This computation is well known and is incorporated in the MPEG 1 compression standard ISO/IEC DIS 11172 "Information technology—Coding of moving pictures and associated audio for digital storage media up to about 1.5 Mbits/s," 1992. These numbers vary dynamically with the audio signal. The coder attempts to adjust the quantization noise floor in the subbands by way of the bit allocation process so that the quantization noise in these subbands is less than the audible level.

An accurate psychoacoustic calculation normally requires a high frequency resolution in the time-to-frequency transform. This implies a large analysis window for the time-to-frequency transform. The standard analysis window size is 1024 samples which corresponds to a subframe of compressed audio data. The frequency resolution of a length 1024 fft approximately matches the temporal resolution of the human ear.

The output of the psychoacoustic model is a signal-to-mask (SMR) ratio for each of the 32 subbands. The SMR is indicative of the amount of quantization noise that a particular subband can endure, and hence is also indicative of the number of bits required to quantize the samples in the subband. Specifically, a large SMR (>>1) indicates that a large number of bits are required and a small SMR (>0) indicates that fewer bits are required. If the SMR<0 then the audio signal lies below the noise mask threshold, and no bits are required for quantization.

Figure 18:
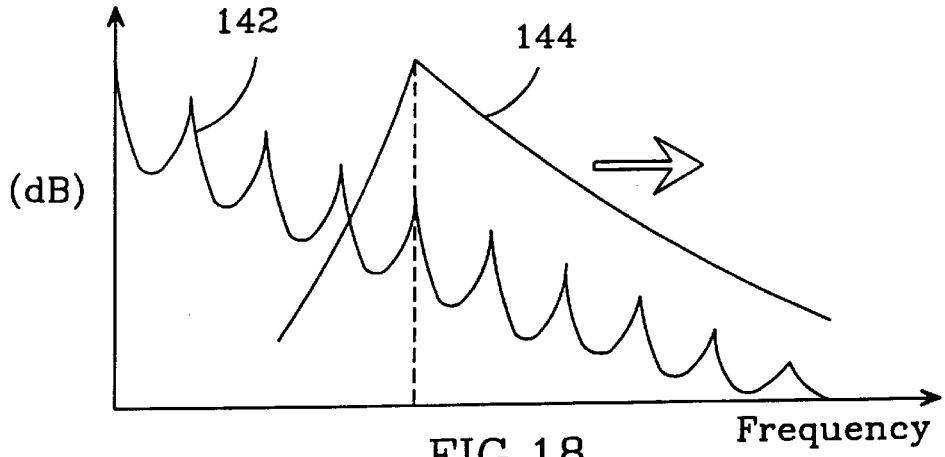
FIG. 18 illustrates the convolution of a signal mask with the signal's frequency response to generate the SMRs.
Figure 19:
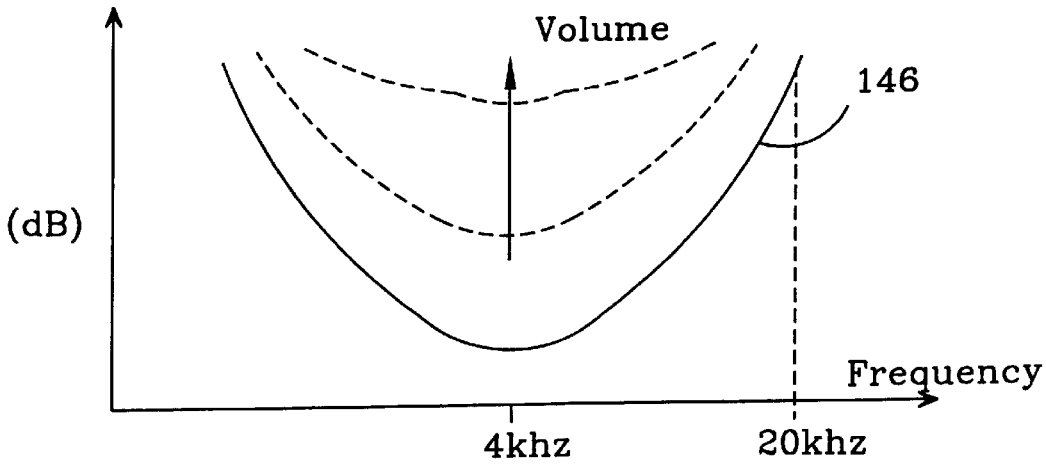
FIG. 19 is a plot of the human auditory response.

As shown in FIG. 18, the SMRs for each successive frame are generated, in general, by 1) computing an fft, preferably of length 1024, on the PCM audio samples to produce a sequence of frequency coefficients 142, 2) convolving the frequency coefficients with frequency dependent tone and noise psychoacoustic masks 144 for each subband, 3) averaging the resulting coefficients over each subband to produce the SMR levels, and 4) optionally normalizing the SMRs in accordance with the human auditory response 146 shown in FIG. 19.

Figure 20:
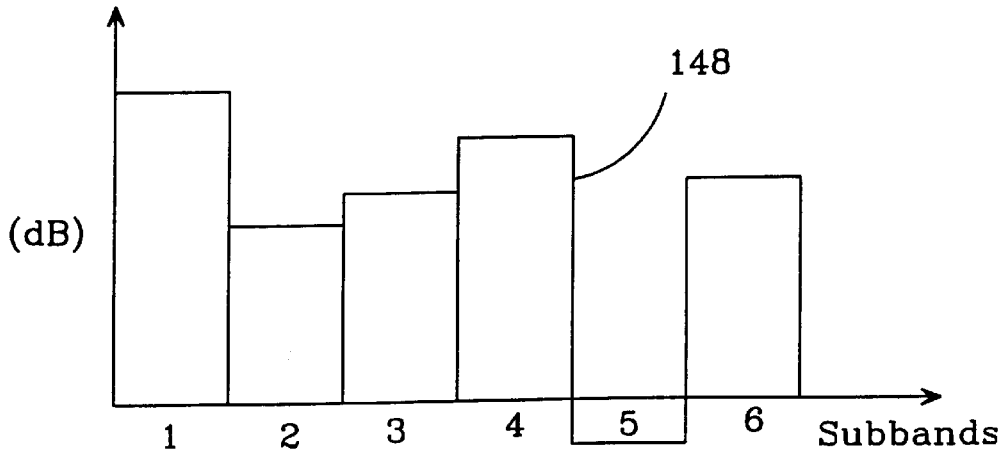
FIG. 20 is a plot of the SMRs for the subbands.

The sensitivity of the human ear is a maximum at frequencies near 4 kHz and falls off as the frequency is increased or decreased. Thus, in order to be perceived at the same level, a 20 kHz signal must be much stronger than a 4 kHz signal. Therefore, in general, the SMRs at frequencies near 4 kHz are relatively more important than the outlying frequencies. However, the precise shape of the curve depends on the average power of the signal delivered to the listener. As the volume increases, the auditory response 146 is compressed. Thus, a system optimized for a particular volume will be suboptimal at other volumes. As a result, either a nominal power level is selected for normalizing the SMR levels or normalization is disabled. The resulting SMRs 148 for the 32 subbands are shown in FIG. 20.

The specific steps for calculating the SMRs 148 are given as follows:

1 The audio signal is transformed from time domain amplitude values into frequency domain coefficients, (magnitude+phase representation).

2 Predicted values for the coefficients are calculated based on an analysis of previous values. An unpredictability measure for each coefficient is calculated based on the difference between the actual and predicted values.

3 The linear frequency coefficients are mapped to critical band coefficients, linear in Barks.

1 The energy in each critical band is determined.

1 The unpredictability of each critical band weighted by its energy is determined.

2 The energy of each critical band is 'spread' over all other frequency coefficients.

3 The energy weighted unpredictability of each critical band is 'spread' over all other frequency coefficients.

4 The 'spreading function' calculates the ability of a signal at one frequency to mask a signal at another frequency. This is calculated as a fraction of energy that is 'spread' from one coefficient (the masker) to another (the masked). The fraction of energy becomes the audible noise floor at the masked coefficient below which the masked signal cannot be heard. The spreading function takes into account the 'frequency' distance between the masker and masked coefficients (in Barks), on whether the masker is at a lower or higher frequency than the masked signal, and on the amplitude of the masking coefficient. The spread energy at each frequency can be summed linearly or nonlinearly.

5 A tonality index is generated for each critical band.

6 The signal to noise ratio, and power ratio of each critical band is calculated. These are affected by the tonality of each critical band, and on the differing abilities of pure tones to mask noise and noise to mask pure tones.

7 The actual noise energy threshold for each critical band is calculated, taking into account the absolute threshold of hearing for that frequency.

8 The critical band noise threshold is converted to subband noise thresholds.

9 The final outcome is a signal-to-noise mask ratio (SMR) for each critical band which can be used to determine the minimum bit allocation for each subband that will produce an inaudible amount of quantization noise.

This calculation can be simplified by grouping coefficients into a smaller number of wider bandwidth subbands. The subbands could be non-uniform in frequency bandwidth, and could be based on 'critical bark' bands. The tonality of the frequency coefficients can also be calculated in different ways, e.g. directly from the prediction gain within each subband, or by a direct analysis of the magnitude differences between neighboring frequency coefficients (individually or grouped within critical bands). The prediction gain within each subband can be mapped to a set of tonality ratios such that a sine wave and white noise in any subband produce prediction gains that have tonality ratios of 1.0 and 0.0 respectively.

Bit Allocation Routine

The GBM system 30 first selects the appropriate encoding strategy, which subbands will be encoded with the VQ and ADPCM algorithms and whether JFC will be enabled. Thereafter, the GBM system selects either a psychoacoustic or a MMSE bit allocation approach. For example, at high bit rates the system may disable the psychoacoustic modeling and use a true mmse allocation scheme. This reduces the computational complexity without any perceptual change in the reconstructed audio signal. Conversely, at low rates the system can activate the joint frequency coding scheme discussed above to improve the reconstruction fidelity at lower frequencies. The GBM system can switch between the normal psychoacoustic allocation and the mmse allocation based on the transient content of the signal on a frame-by-frame basis. When the transient content is high, the assumption of stationarity that is used to compute the SMRs is no longer true, and thus the mmse scheme provides better performance.

For a psychoacoustic allocation, the GBM system first allocates the available bits to satisfy the psychoacoustic effects and then allocates the remaining bits to lower the overall noise floor. The first step is to determine the SMRs for each subband for the current frame as described above. The next step is to adjust the SMRs for the prediction gain (Pgain) in the respective subbands to generate mask-to-noise rations (MNRs). The principle being that the ADPCM encoder will provide a portion of the required SMR. As a result, inaudible psychoacoustic noise levels can be achieved with fewer bits.

The MNR for the $j^{th}$ subband, assuming PMODE=1, is given by:

$$MNR(j)=SMR(j)-Pgain(j)*PEF(ABIT)$$

where PEF(ABIT) is the prediction efficiency factor of the quantizer as shown in Table 3. To calculate MNR(j), the designer must have an estimate of the bit allocation (ABIT), which can be generated by either allocating bits solely based on the SMR(j) or by assuming that PEF(ABIT)=1. At medium to high bit rates, the effective prediction gain is approximately equal to the calculated prediction gain.

However, at low bit rates the effective prediction gain is reduced. The effective prediction gain that is achieved using, for example, a 5-level quantizer is approximately 0.7 of the estimated prediction gain, while a 65-level quantizer allows the effective prediction gain to be approximately equal to the estimated prediction gain, PEF=1.0. In the limit, when the bit rate is zero, predictive encoding is essentially disabled and the effective prediction gain is zero.

TABLE 3

PEF v. Quantization levels

| Q levels | ABIT index | SNR[dB] | PEF(ABIT) |
|---|---|---|---|
| 0 | 0 | 0 | 0.00 |
| 3 | 1 | 9 | 0.65 |
| 5 | 2 | 12 | 0.70 |
| 7 | 3 | 15 | 0.75 |
| 9 | 4 | 18 | 0.80 |
| 13 | 5 | 21 | 0.85 |
| 17 | 6 | 24 | 0.90 |
| 25 | 7 | 27 | 0.95 |
| 33 | 8 | 30 | 1.00 |
| 65 | 9 | 36 | 1.00 |
| 129 | 10 | 42 | 1.00 |
| 256 | 11 | 48 | 1.00 |
| 512 | 12 | 54 | 1.00 |
| 1024 | 13 | 60 | 1.00 |
| 2048 | 14 | 66 | 1.00 |
| 4096 | 15 | 72 | 1.00 |
| 8192 | 16 | 78 | 1.00 |
| 16384 | 17 | 84 | 1.00 |
| 32768 | 18 | 90 | 1.00 |
| 65536 | 19 | 96 | 1.00 |
| 131072 | 20 | 102 | 1.00 |
| 262144 | 21 | 108 | 1.00 |
| 524288 | 22 | 114 | 1.00 |
| 1048576 | 23 | 120 | 1.00 |
| 2097152 | 24 | 126 | 1.00 |
| 4194304 | 25 | 132 | 1.00 |
| 8388608 | 26 | 138 | 1.00 |
| 16777216 | 27 | 144 | 1.00 |

In the next step, the GBM system 30 generates a bit allocation scheme that satisfies the MNR for each subband. This is done using the approximation that 1 bit equals 6 dB of signal distortion. To ensure that the encoding distortion is less than the psychoacoustically audible threshold, the assigned bit rate is the greatest integer of the MNR divided by 6 dB, which is given by:

$$ABIT(j)=\left\lceil \frac{MNR(j)}{.6\text{ dB}} \right\rceil$$

Figure 21:
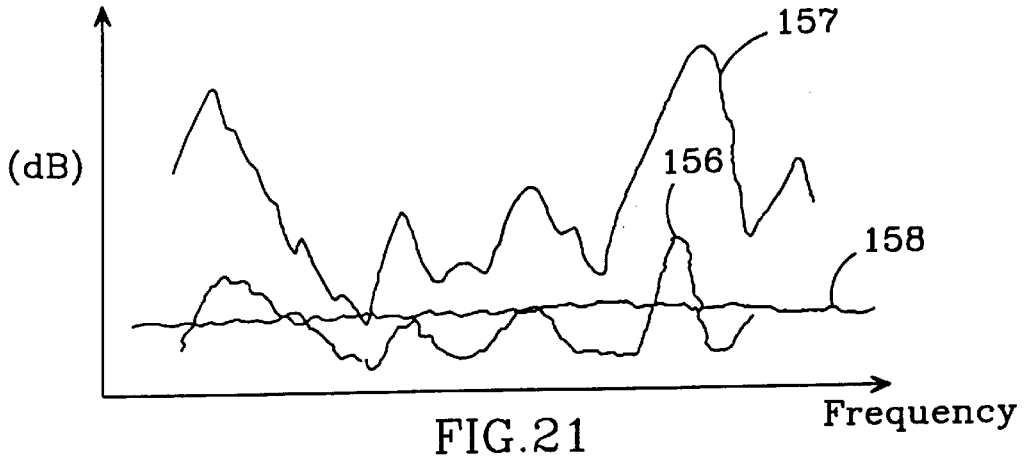
FIG. 21 is a plot of the error signals for the psychoacoustic and mmse bit allocations.

By allocating bits in this manner, the noise level 156 in the reconstructed signal will tend to follow the signal itself 157 shown in FIG. 21. Thus, at frequencies where the signal is very strong the noise level will be relatively high, but will remain inaudible. At frequencies where the signal is relatively weak, the noise floor will be very small and inaudible. The average error associated with this type of psychoacoustic modeling will always be greater than a mmse noise level 158, but the audible performance may be better, particularly at low bit rates.

In the event that the sum of the allocated bits for each subband over all audio channels is greater or less than the target bit-rate, the GBM routine will iteratively reduce or increase the bit allocation for individual subbands. Alternately, the target bit rate can be calculated for each audio channel. This is suboptimum but simpler especially in a hardware implementation. For example, the available bits can be distributed uniformly among the audio channels or can be distributed in proportion to the average SMR or RMS of each channel.

In the event that the target bit rate is exceeded by the sum of the local bit allocations, including the VQ code bits and side information, the global bit management routine will progressively reduce the local subband bit allocations. A number of specific techniques are available for reducing the average bit rate. First, the bit rates that were rounded up by the greatest integer function can be rounded down. Next, one bit can be taken away from the subbands having the smallest MNRs. Furthermore, the higher frequency subbands can be turned off or joint frequency coding can be enabled. All bit rate reduction strategies follow the general principle of gradually reducing the coding resolution in a graceful manner, with the perceptually least offensive strategy introduced first and the most offensive strategy used last.

In the event that the target bit rate is greater than the sum of the local bit allocations, including the VQ code bits and side information, the global bit management routine will progressively and iteratively increase the local subband bit allocations to reduce the reconstructed signal's overall noise floor. This may cause subbands to be coded which previously have been allocated zero bits. The bit overhead in 'switching on' subbands in this way may need to reflect the cost in transmitting any predictor coefficients if PMODE is enabled.

Figure 22A:
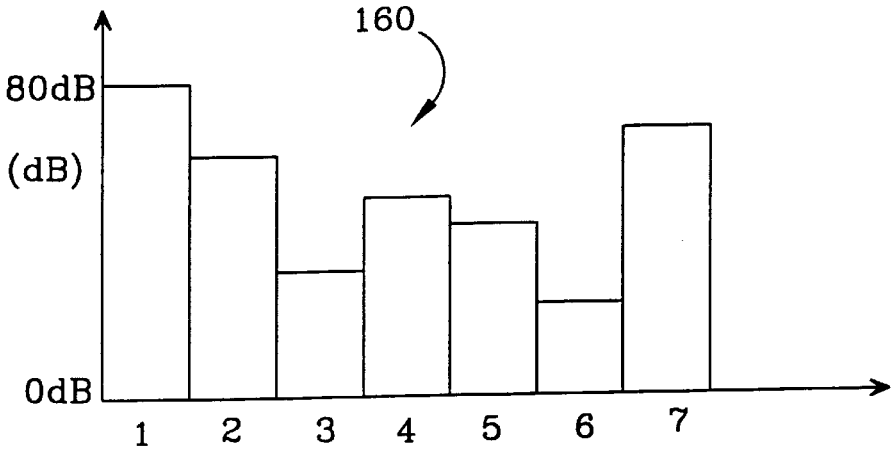
FIGS. 22*a* and 22*b* are a plot of the subband energy levels and the inverted plot, respectively, illustrating the mmse "waterfilling" bit allocation process.
Figure 22B:
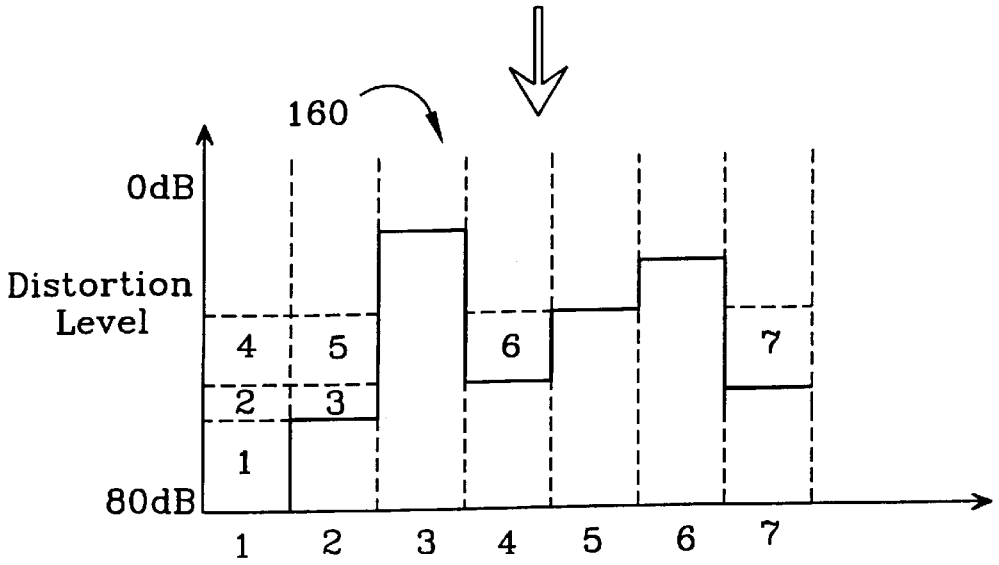

The GBM routine can select from one of three different schemes for allocating the remaining bits. One option is to use a mmse approach that reallocates all of the bits such that the resulting noise floor is approximately flat. This is equivalent to disabling the psychoacoustic modeling initially. To achieve a mmse noise floor, the plot 160 of the subbands' RMS values shown in FIG. 22*a* is turned upside down as shown in FIG. 22*b* and "waterfilled" until all of the bits are exhausted. This well known technique is called waterfilling because the distortion level falls uniformly as the number of allocated bits increases. In the example shown, the first bit is assigned to subband 1, the second and third bits are assigned to subbands 1 and 2, the fourth through seventh bits are assigned to subbands 1, 2, 4 and 7, and so forth. Alternately, one bit can be assigned to each subband to guarantee that each subband will be encoded, and then the remaining bits waterfilled.

A second, and preferred, option is to allocate the remaining bits according to the mmse approach and RMS plot described above. The effect of this method is to uniformly lower the noise floor 157 shown in FIG. 21 while maintaining the shape associated with the psychoacoustic masking. This provides a good compromise between the psychoacoustic and mse distortion.

The third approach is to allocate the remaining bits using the muse approach as applied to a plot of the difference between the RMS and MNR values for the subbands. The effect of this approach is to smoothly morph the shape of the noise floor from the optimal psychoacoustic shape 157 to the optimal (flat) mmse shape 158 as the bit rate increases.

In any of these schemes, if the coding error in any subband drops below 0.5 LSB, with respect to the source PCM, then no more bits are allocated to that subband. Optionally fixed maximum values of subband bit allocations may be used to limit the maximum number of bits allocated to particular subbands.

In the encoding system discussed above, we have assumed that the average bit rate per sample is fixed and have generated the bit allocation to maximize the fidelity of the reconstructed audio signal. Alternately, the distortion level, mse or perceptual, can be fixed and the bit rate allowed to vary to satisfy the distortion level. In the mmse approach, the RMS plot is simply waterfilled until the distortion level is satisfied. The required bit rate will vary based upon the RMS levels of the subbands. In the psychoacoustic approach, the bits are allocated to satisfy the individual MNRs. As a result, the bit rate will vary based upon the individual SMRs and prediction gains. This type of allocation is not presently useful because contemporary decoders operate at a fixed rate. However, alternative delivery systems such as ATM or random access storage media may make variable rate coding practical in the near future.

Quantization of Bit Allocation Indexes (ABIT)

The bit allocation indexes (ABIT) are generated for each subband and each audio channel by an adaptive bit allocation routine in the global bit management process. The purpose of the indexes at the encoder is to indicate the number of levels 162 shown in FIG. 13 that are necessary to quantize the difference signal to obtain a subjectively optimum reconstruction noise floor in the decoder audio. At the decoder they indicate the number of levels necessary for inverse quantization. Indexes are generated for every analysis buffer and their values can range from 0 to 27. The relationship between index value, the number of quantizer levels and the approximate resulting differential subband $SN_QR$ is shown in Table 4. Because the difference signal is normalized, the step-size 164 is set equal to one.

TABLE 4

Bit allocation index ABIT vs. quantizer levels, quantizer code length and quantized differential signal to noise ratio

| ABIT Index | # of Q Levels | Code Length (bits) | $SN_QR$ (dB) |
|---|---|---|---|
| 0 | 0 | 0 | — |
| 1 | 3 | variable | 8 |
| 2 | 5 | variable | 12 |
| 3 | 7 (or 8) | variable (or 3) | 16 |
| 4 | 9 | variable | 19 |
| 5 | 13 | variable | 21 |
| 6 | 17 (or 16) | variable (or 4) | 24 |
| 7 | 25 | variable | 27 |
| 8 | 33 (or 32) | variable (or 5) | 30 |
| 9 | 65 (or 64) | variable (or 6) | 36 |
| 10 | 129 (or 128) | variable (or 7) | 42 |
| 11 | 256 | 8 | 48 |
| 12 | 512 | 9 | 54 |
| 13 | 1024 | 10 | 60 |
| 14 | 2048 | 11 | 66 |
| 15 | 4096 | 12 | 72 |
| 16 | 8192 | 13 | 78 |
| 17 | 16384 | 14 | 84 |
| 18 | 32768 | 15 | 90 |
| 19 | 65536 | 16 | 96 |
| 20 | 131072 | 17 | 102 |
| 21 | 262144 | 18 | 108 |
| 22 | 524268 | 19 | 114 |
| 23 | 1048576 | 20 | 120 |

TABLE 4-continued

Bit allocation index ABIT vs. quantizer levels, quantizer code length and quantized differential signal to noise ratio

| ABIT Index | # of Q Levels | Code Length (bits) | $SN_QR$ (dB) |
|---|---|---|---|
| 24 | 2097152 | 21 | 126 |
| 25 | 4194304 | 22 | 132 |
| 26 | 8388608 | 23 | 138 |
| 27 | 16777216 | 24 | 144 |

The bit allocation indexes (ABIT) are either transmitted to the decoder directly using 4-bit unsigned integer code words, 5-bit unsigned integer code words, or using a 12-level entropy table. Typically, entropy coding would be employed for low-bit rate applications to conserve bits. The method of encoding ABIT is set by the mode control at the encoder and is transmitted to the decoder. The entropy coder maps 166 the ABIT indexes to a particular codebook identified by a BHUFF index and a specific code VABIT in the codebook.

4-bit Coding of ABIT Indexes

In this mode 4-bit unsigned integers are used to represent the ABIT indexes. The index range is therefore 0–15, limiting the number of quantizer levels which can be allocated in the global bit management to 4096. This mode is used for medium bit-rate applications.

5-bit Coding of ABIT Indexes

In this mode 5-bit unsigned integers are used to represent the ABIT indexes. This code length covers the entire index range. This mode is used for high bit-rate applications.

12-level Entropy Coding

The entropy coding process 166 is as follows; the bit allocation indexes ABIT(j) for the j subbands are mapped to a number (p) of 12-level variable length code books, each optimal for a different input statistical characteristic. The indexes are mapped to each of the 12-level tables and the total bit usage associated with each table ($NB_p$) is calculated. The table which provides the lowest bit usage over the mapping process is selected using the BHUFF index. The mapped codes, VABIT(j), are extracted from this table, packed and transmitted to the decoder along with the BHUFF index word. The decoder, which holds the same set of 12-level inverse tables, uses the BHUFF index to direct the incoming variable length codes, VABIT(j), to the proper table for decoding back to the ABIT indexes.

Since the entropy table uses only 12-levels, the index range is 0–11, limiting the maximum number of quantizer levels which can be allocated in the global bit management to 256. This ABIT coding mode is used for low bit-rate applications.

Entropy Coding for ADPCM Quantizer Level Codes $OL_i(n)$

The method 168 of encoding the differential quantizer level codes depends on the size of the quantizer selected as indicated by the ABIT index. For ABIT indexes ranging from 1 to 10 (3 level to 129 level) the level codes are generally encoded using entropy (variable code length) tables. Under certain circumstances the 3, 6, 8, 9 and 10 indexes can also indicate fixed length codes and may be transmitted without modification. For ABIT indexes ranging from 11 to 27 (256-level to 16777216-level) the level codes are always fixed length and are transmitted to the decoder without modification.

Entropy Coding for ABIT Indexes 0–10

Figure 23:
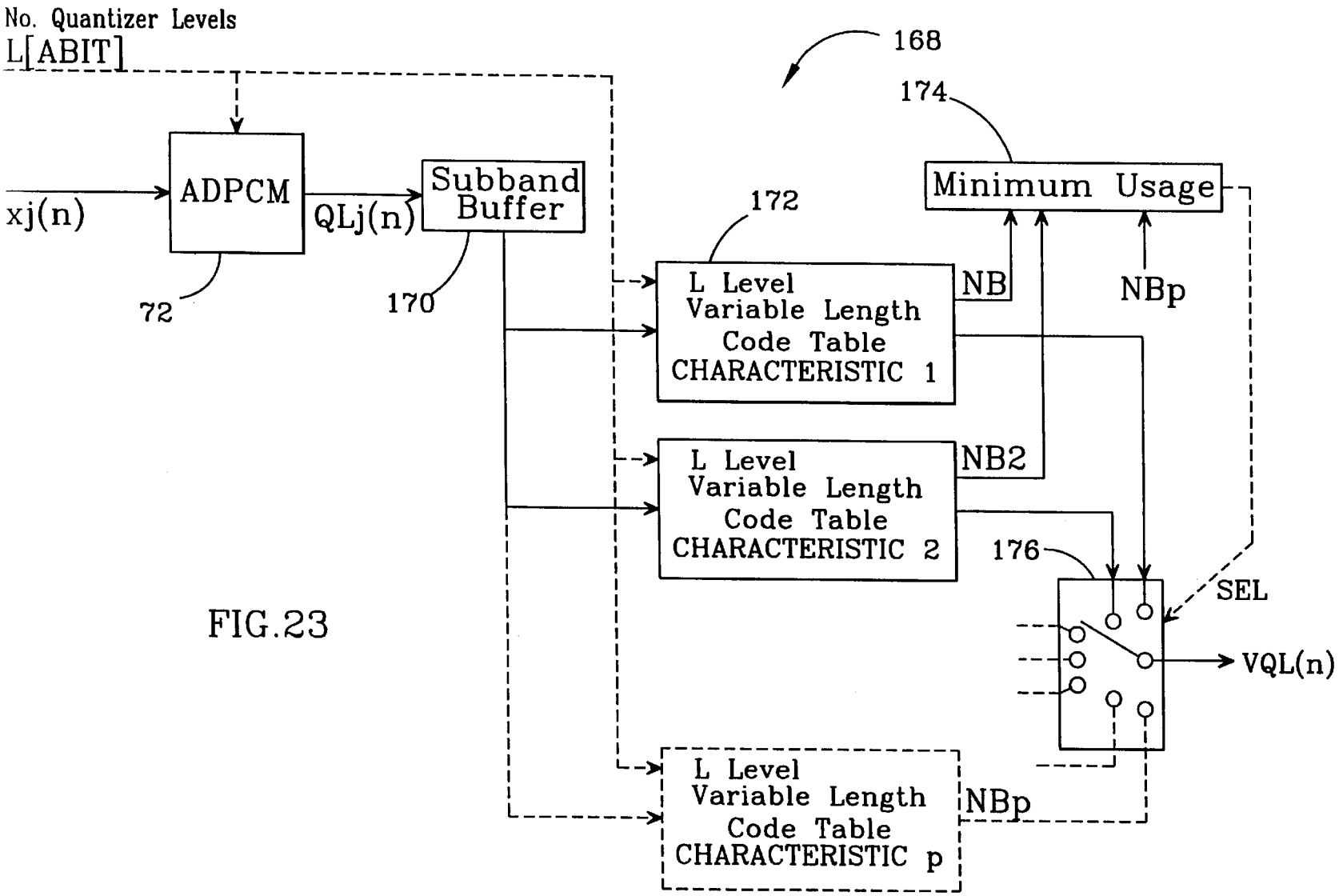
FIG. 23 illustrates the entropy coding process for the ADPCM quantizer codes.

As shown in FIG. 23, the differential quantizer level codes are encoded 168 using entropy tables in accordance with the following process. The level codes $QL_j(n)$ generated by the ADPCM encoder 72 in each subband with the same bit allocation are grouped together and mapped to a number (p) of variable length code books whose size is determined by the ABIT index, (Table 4). Each codebook is optimized for different input statistical characteristics. The level codes $QL_j(n)$ associated with the same ABIT index value are buffered 170 and mapped 172 to each of the available entropy tables. The total bit usage associated with each table ($NB_p$) is calculated 174 and the table which provides the lowest bit usage over the mapping process is selected 176 using the SEL index. The mapped codes, $VQL_j(n)$, are extracted from this table, packed and transmitted to the decoder along with the SEL index word. The decoder, which holds the same set of inverse tables, uses the ABIT (BHUFF, VABIT) and SEL indexes to direct the incoming variable length codes, $VQL_j(n)$, to the proper table for decoding back to the differential quantizer level codes $QL_j(n)$. An SEL index is generated for each variable length bit allocation index (1–10) used in an audio channel.

Fixed length coding for ABIT Indexes 3, 6, 8, 9, 10

For medium to high bit-rate applications it may be desirable to limit the use of entropy coding to reduce the computational overheads involved in unpacking the variable length codes at the decoder. In this case indexes 3, 6, 8, 9 and 10 may revert to fixed length mid-tread quantizers of 8,16, 32,64 and 128 levels respectively and indexes 4, 5 and 7 may be dropped altogether by the bit allocation routine. Indexes 1 and 2 may continue to be used for 3-level and 5-level entropy coding, or they also may be dropped also. In this case however the minimum non-zero bit allocation would be 3 bits. The choice of fixed length quantization is driven by the encoder mode control and is transmitted to the decoder to ensure the proper choice of inverse quantizer.

Global Bit Rate Control

Since both the side information and differential subband samples can optionally be encoded using entropy variable length code books, some mechanism must be employed to adjust the resulting bit rate of the encoder when the compressed bit stream is to be transmitted at a fixed rate. Because it is not normally desirable to modify the side information once calculated, bit rate adjustments are best achieved by iteratively altering the differential subband sample quantization process within the ADPCM encoder until the rate constraint is met.

In the system described, a global rate control (GRC) system 178 in FIG. 13 adjusts the bit rate, which results from the process of mapping the quantizer level codes to the entropy table, by altering the statistical distribution of the level code values. The entropy tables are all assumed to exhibit a similar trend of higher code lengths for higher level code values. In this case the average bit rate is reduced as the probability of low value code levels increases and vice-versa. In the ADPCM (or APCM) quantization process, the size of the scale factor determines the distribution, or usage, of the level code values. For example, as the scale factor size increases the differential samples will tend to be quantized by the lower levels, and hence the code values will become progressively smaller. This, in turn, will result in smaller entropy code word lengths and a lower bit rate.

The disadvantage of this method is that by increasing the scale factor size the reconstruction noise in the subband samples is also raised by the same degree. In practice, however, the adjustment of the scale factors is normally no greater than 1 dB to 3 dB. If a greater adjustment is required it would be better to return to the bit allocation and reduce the overall bit allocation rather than risk the possibility of audible quantization noise occurring in subbands which would use the inflated scale factor.

Figure 24:
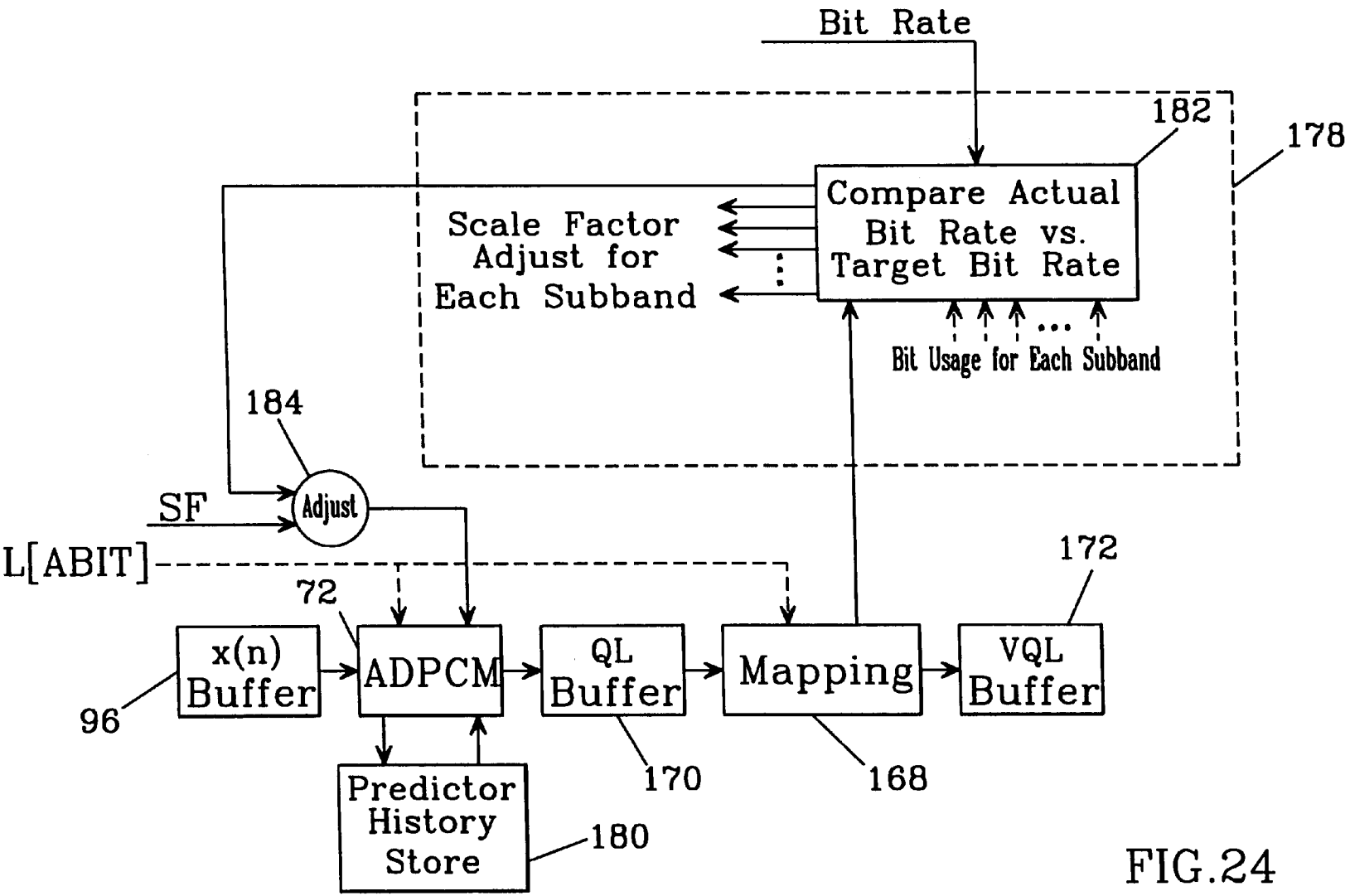
FIG. 24 illustrates the bit rate control process.

The method of adjusting the entropy encoded ADPCM bit allocation is illustrated in FIG. 24. First, the predictor history samples for each subband are stored in a temporary buffer 180 in case the ADPCM coding cycle 72 is repeated. Next, the subband sample buffers 96 are all encoded by the full ADPCM process 72 using prediction coefficients $A_H$ derived from the subband LPC analysis together with scale factors RMS (or PEAK), quantizer bit allocations ABIT, transient modes TMODE, and prediction modes PMODE derived from the estimated difference signal. The resulting quantizer level codes are buffered 170 and mapped 168 to the entropy variable length code book 172, which exhibits the lowest bit usage again using the bit allocation index to determine the code book sizes.

The GRC system 178 then analyzes 182 the number of bits used for each subband using the same bit allocation index over all indexes. For example, when ABIT=1 the bit allocation calculation in the global bit management could have assumed an average rate of 1.4 per subband sample (i.e. the average rate for the entropy code book assuming optimal level code amplitude distribution). If the total bit usage of all the subbands for which ABIT=1 is greater than 1. 4/(total number of subband samples) then the scale factors could be increased throughout all of these subbands to affect a bit rate reduction. Typical nominal word lengths for all the possible entropy ABIT indexes are shown in Table 5. The decision to adjust 184 the subband scale factors is preferably left until all the ABIT index rates have been accessed. As a result, the indexes with bit rates lower than that assumed in the bit allocation process may compensate for those with bit rates above that level. This assessment may also be extended to cover all audio channels where appropriate.

TABLE 5

Typical nominal word length of entropy code books vs. ABIT as assumed in bit allocation routine and global rate management.

| ABIT Index | Nominal Bits per Sample (Entropy) |
|---|---|
| 1 | 1.4 |
| 2 | 2.1 |
| 3 | 2.5 |
| 4 | 2.8 |
| 5 | 3.2 |
| 6 | 3.6 |
| 7 | 4.0 |
| 8 | 4.4 |
| 9 | 5.2 |
| 10 | 6.0 |

The recommended procedure for reducing overall bit rate is to start with the lowest ABIT index bit rate which exceeds the threshold and increase the scale factors in each of the subbands which have this bit allocation. The actual bit usage is reduced by the number of bits that these subbands were originally over the nominal rate for that allocation. If the modified bit usage is still in excess of the maximum allowed, then the subband scale factors for the next highest ABIT index, for which the bit usage exceeds the nominal, are increased. This process is continued until the modified bit usage is below the maximum.

Once this has been achieved, the old history data is loaded into the predictors and the ADPCM encoding process 72 is repeated for those subbands which have had their scale factors modified. Following this, the level codes are again mapped to the most optimal entropy codebooks and the bit usage is recalculated. If any of the bit usage's still exceed the nominal rates then the scale factors are further increased and the cycle is repeated.

The modification to the scale factors can be done in two ways. The first is to transmit to the decoder an adjustment factor for each ABIT index. For example a 2-bit word could signal an adjustment range of say 0, 1, 2 and 3 dB. Since the same adjustment factor is used for all subbands which use the ABIT index, and only indexes 1–10 can use entropy encoding, the maximum number of adjustment factors that need to be transmitted for all subbands is 10. Alternately, the scale factor can be changed in each subband by selecting a high quantizer level. However, since the scale factor quantizers have step-sizes of 1.25 and 2.5 dB respectively the scale factor adjustment is limited to these steps. Moreover, when using this technique the differential encoding of the scale factors and the resulting bit usage may need to be recalculated if entropy encoding is enabled.

Generally speaking the same procedure can also be used to increase the bit rate, i.e. when the bit rate is lower than the desired bit rate. In this case the scale factors would be decreased to force the differential samples to make greater use of the outer quantizer levels, and hence use longer code words in the entropy table.

If the bit usage for bit allocation indexes cannot be reduced within a reasonable number of iterations, or in the case when the scale factor adjustment factors are transmitted, the number of adjustment steps has reached the limit then two remedies are possible. First, the scale factors of subbands which are within the nominal rate may be increased, thereby lowering the overall bit rate. Alternately, the entire ADPCM encoding process can be aborted and the adaptive bit allocations across the subbands recalculated, this time using fewer bits.

Data Stream Format

The multiplexer 32 shown in FIG. 12 packs the data for each channel and then multiplexes the packed data for each channel into an output frame to form the data stream 16. The method of packing and multiplexing the data, i.e. the frame format 186 shown in FIG. 25, was designed so that the audio coder can be used over a wide range of applications and can be expanded to higher sampling frequencies, the amount of data in each frame is constrained, playback can be initiated on each sub-subframe independently to reduce latency, and decoding errors are reduced. As shown, a single frame 186 (4096 PCM samples/ch) consists of 4 subframes 188 (1024 PCM samples/ch), which in turn are each made up of 4 sub-subframes 190 (256 PCM samples/ch). Alternately, if the analysis window had a length of only 1024 samples, then a single frame would comprise only a single subframe.

A number of common phrases are abbreviated for the purpose of clarity and conciseness.

| Abbreviation | Description |
|---|---|
| ABIT | Bit Allocation Index Data Array |
| AHCRC | Audio Headers CRC Check Word |
| AMODE | Audio Channel Arrangement |
| AUDIO | Audio Data Array |
| AUXCNT | Auxiliary Data Byte Count |
| AUXD | Auxiiiary Data Bytes |
| BHUF | Bit Allocation Index Quantizer Select |
| CHIST | Copy History |
| CHS | Number of audio channels |

-continued

| Abbreviation | Description |
|---|---|
| DCOEFF | Dynamic Range Coefficients |
| DSYNC | Data Synchronization Word |
| DYNF | Embedded Dynamic Range Flag |
| FILTS | Multirate Interpolator Switch |
| FTYPE | Frame Type Identifier |
| FSIZE | Frame Byte Size |
| HCRC | Header Reed Solomon Check Word |
| HFLAG | Predictor History Flag Switch |
| HFREQ | High Frequency Vector Index Data Array |
| JOINX | Intensity Coding Index |
| LFE | Low Frequency Effects PCM Data Array |
| LFF | Low Frequency Effects Flag |
| MCOEFF | Down Mix Coefficients |
| MIX | Embedded Down Mix enabled |
| NBLKS | Number of Subframes in Current Frame |
| OCRC | Optional Reed Solomon Check Word |
| OVER_AUDIO | High frequency sampled Audio Data Array |
| PCMR | Source PCM coding Resolution |
| PMODE | Prediction Mode Array |
| PSC | Partial sub-subframe Sample Count |
| PVQ | Prediction Coefficients VQ index Array |
| RATE | Transmission Bit Rate |
| SCALES | Subband Scale Factors Data Array |
| SELxx | SEL5 - SEL129 |
| SEL5 | 5-level Quantizer Select |
| SEL7 | 7/8-level Quantizer Select |
| SEL9 | 9-level Quantizer Select |
| SEL13 | 13-level Quantizer Select |
| SEL17 | 17/16-level Quantizer Select |
| SEL25 | 25-level Quantizer Select |
| SEL33 | 33/32-level Quantizer Select |
| SEL65 | 65/64-level Quantizer Select |
| SEL129 | 129/128-level Quantizer Select |
| SFREQ | Source Sampling rate |
| SHUFF | Scale Factor Quantizer Select |
| SICRC | Side information CRC Check Word |
| SSC | Sub-subframe Count |
| SUBFS | Number of Subframes |
| SUBS | Subband Activity Count |
| SURP | Surplus Sample Count |
| SYNC | Frame Synchronization Word |
| THUFF | Transient Mode Quantizer Select |
| TIMES | Time Code Stamp |
| TIME | Embedded Time Stamp Flag |
| TMODE | Subband Transient Mode Data Array |
| UNSPEC | Unspecified |
| VERNUM | Encoder Software Revision No. |
| VQSUB | High Frequency VQ Band Start Number |

V Vital Information that is designed to change from frame-to-frame, and hence cannot be averaged over time. Corruption could lead to failure in decoding process leading to noise on outputs.

ACC Corruption of this information could cause decoding failure. However, the settings will ordinarily not change from frame-to-frame. Hence, bit errors can be compensated for by using a majority voter scheme over consecutive frames. If changes are detected, then muting should be activated.

NV Non-vital information in which corruption will gracefully degrade audio decoding performance.

Framing

A frame defines the bit stream boundaries in which sufficient information resides to properly decode a block of audio. Except for termination frames the audio frame will decode either 4096, 2048, 1024, 512 or 256 PCM samples per audio channel. Restrictions (Table 1) exist as to the maximum number of PCM samples per frame against the bit stream bit rate. The absolute maximum physical frame size is 65536 bits or 8192 bytes (Table 2).

Synchronization

Frame Synchronization Word SYNC 32 bits

Sync word=0×7ffe8001

(0×7ffe8001+0×3f for normal frames)

The frame synchronization word 192 is placed at the beginning of each audio frame. Sync words can occur at the maximum number of PCM samples per frame, or shorter intervals, depending on the application.

Frame Header Information

The frame header information 194 primarily gives information regarding the construction of the frame 186, the configuration of the encoder which generated the stream and various optional operational features such as embedded dynamic range control and time code.

Frame Type Identifier V FTYPE 1 Bit

1=Normal frame (4096, 2048, 1024, 512 or 256 PCM sample s/ch)

0=Termination frame

Termination frames are used when it is necessary to accurately align the end of an audio sequence with a video frame end point. A termination block carries n*32 audio samples where block length 'n' is adjusted to just exceed the video end point. Two termination frames may be transmitted sequentially to avoid transmitting one excessively small frame.

Surplus Sample Count V SURP 5 Bits

Defines the number of samples by which the termination frame exceeds the original file length defined at the encoder. This number applies to all channels. These surplus samples may be simply ignored once decoded or they may be 'cross-faded' with the start samples from the next block to produce a smoother transition. The number of surplus samples equals $\text{Modulo}_{32}$(SURP index plus 1).

The frame byte size is indicated by the FSIZE specifier. Concatenating the sync word with FTYPE and SURP gives an effective word length of 38 bits. For bit synchronization the unreliability factor will be 1 in 1.0E07 attempts.

Number of 32 PCM Sample-Blocks Coded in Current Frame per ch V NBLKS 7 Bits

Valid Range=5–127

Invalid Range=0–4

NBLKS+1 indicates the number of 32 sample PCM audio blocks per channel encoded in the current frame per channel. The actual encoder audio window size is 32*(NBLKS+1) PCM samples per channel. For normal frames this will indicate a window size of either 4096, 2048, 1024, 512 or 256 samples per channel. For termination frames NBLKS can take any value in its range.

Frame Byte Size V FSIZE 14 Bits

0–94=Invalid

95–8191=Valid range−1 (ie. 96 bytes to 8192 bytes)

8192–16383=Invalid

FSIZE defines the byte size of the current audio frame. Where the transmission rate and sampling rate are indivisible, the byte size will vary by 1 from block to block to produce a time average.

| Audio Channel | Arrangement | ACC AMODE 6 bits |
|---|---|---|
| 0b000000 = 1-ch | A | |
| 0b000001 = 2-ch | A + B | (dual mono) |
| 0b000010 = 2-ch | L + R | (stereo) |
| 0b000011 = 2-ch | (L + R) + (L − R) | (sum-difference) |
| 0b000100 = 2-ch | Lt + Rt | (total) |
| 0b000101 = 3-ch | L + R + C | |

-continued

| Audio Channel | Arrangement | ACC AMODE 6 bits |
|---|---|---|
| 0b000110 = 3-ch | L + R + S | |
| 0b000111 = 4-ch | L + R + C + S | |
| 0b001000 = 4-ch | L + R + SL + SR | |
| 0b001001 = 5-ch | L + R + C + SL + SR | |
| 0b001010 = 6-ch | L + R + CL + CR + SL + SR | |
| 0b001011 = 6-ch | Lf + Rf + Cf + Cr + Lr + Rr | |
| 0b001100 = 7-ch | L + CL + C + CR + R + SL + SR | |
| 0b001101 = 8-ch | L + CL + CR + R + SL1 + SL2 + SR1 + SR2 | |
| 0b001110 = 8-ch | L + CL + C + CR + R + SL + S + SR | |
| 0b001111 - 0b110000 = User defined codes | | |
| 0b110001 - 0b111111 = Invalid | | |

The channel arrangement describes the number of audio channels and the audio playback mode. Unspecified modes may be defined at a later date (user defined code) and the control data required to implement them, i.e. channel assignments, down mixing etc, can be input to the decoder locally.

| |
|---|
| 0b0000 = Invalid |
| 0b0001 = 8 kHz |
| 0b0010 = 16 kHz |
| 0b0011 = 32 kHz |
| 0b0100 = 64 kHz |
| 0b0101 = 128 kHz |
| 0b0110 = 11.025 kHz |
| 0b0111 = 22.05 kHz |
| 0b1000 = 44.01 kHz |
| 0b1001 = 88.02 kHz |
| 0b1010 = 176.4 kHz |
| 0b1011 = 12 kHz |
| 0b1100 = 24 kHz |
| 0b1101 = 48 kHz |
| 0b1110 = 96 kHz |
| 0b1111 = 192 kHz |

This specifies the source sampling rate. If the decoder is unable to make use of the over sampled data this may be discarded and the baseband audio converted normally using a standard sampling rate (32,44.1 or 48 k). If the decoder is receiving data coded at sampling rates lower than that available at playback then sample interpolation (2× or 4×) will be required.

| Transmission Bit Rate ACC RATE 5 bits |
|---|
| 0b00000 = 32 kbps |
| 0b00001 = 56 kbps |
| 0b00010 = 64 kbps |
| 0b00011 = 96 kbps |
| 0b00100 = 112 kbps |
| 0b00101 = 128 kbps |
| 0b00110 = 192 kbps |
| 0b00111 = 224 kbps |
| 0b01000 = 256 kbps |
| 0b01001 = 320 kbps |
| 0b01010 = 384 kbps |
| 0b01011 = 448 kbps |
| 0b01100 = 512 kbps |
| 0b01101 = 576 kbps |
| 0b01110 = 640 kbps |
| 0b01111 = 768 kbps |
| 0b10000 = 896 kbps |
| 0b10001 = 1024 kbps |
| 0b10010 = 1152 kbps |
| 0b10011 = 1280 kbps |
| 0b10100 = 1344 kbps |
| 0b10101 = 1408 kbps |
| 0b10110 = 1411.2 kbps |
| 0b10111 = 1472 kbps |

-continued

| Transmission Bit Rate ACC RATE 5 bits |
|---|
| 0b11000 = 1536 kbps |
| 0b11001 = 1920 kbps |
| 0b11010 = 2048 kbps |
| 0b11011 = 3072 kbps |
| 0b11100 = 3840 kbps |
| 0b11101 = 4096 kbps |
| 0b11110 = Variable |
| 0b11111 = Lossless |

RATE specifies the average transmission rate for the current audio frame. Variable and lossless modes imply that the transmission rate changes from frame to frame.

Embedded Down Mix Enabled V MIX 1 Bit

0=mix parameters not present

1=CHS*2 mix parameters present (8-bits each)

This indicates whether embedded down mixing coefficients are included at the end of the header (see "optional header information").

Embedded Dynamic Range Flag V DYNF 2 Bits

0=dynamic range parameters not present

1=1 set of range parameters are present and are valid for the entire block.

2=2 sets of range parameters present and are valid for each ½ block

3=4 sets of range parameters are present and are valid for each ¼ block

This indicates if embedded dynamic range coefficients are included at the end of the header (see "optional header information")

Embedded Time Stamp Flag V TIME 1 Bit

0=time stamp not present

1=present

This indicates if an embedded time stamp is included at the end of the header (see "optional header information")

Auxiliary Data Byte Count V AUXCNT 6 Bit

0=no bytes present

1–63=number of bytes-1

This indicates if embedded auxiliary data bytes are included at the end of the header (see "optional header information")

Low Frequency Effects Flag V LFF 1 Bit

0=No effects channel present

1=Effects channel present

This indicates if low frequency effects audio data is included in the audio subframes Predictor History Flag Switch NV HFLAG 1 Bit 0=Reconstructed history from previous frame is ignored in generating predictions for current frame.

1=Reconstructed history from previous frame is used as normal.

If frames are to be used as possible entry points into the data stream or as audio sequence "start frames" the predictor history may not be contiguous. Hence these frames can be coded without the previous frame predictor history, ensuring a faster ramp-up on entry.

Header Reed Solomon Check Word HCRC 8 Bits ×2

Multirate Interpolator Switch NV FILTS 1 Bit

0=Non perfect reconstructing

1=Perfect Reconstructing

Indicates which set of 32-band interpolation FIR coefficients are to be used to reconstruct the subband audio.

Encoder Software Revision No. ACC VERNUM 4 Bits

0–6=Future revision which will be compatible with this specification

7=Current

8–15=Future revision which is incompatible with this specification

Copy History NV CHIST 2 Bits

0×00=Copy Prohibited

0×01=First Generation

0×10=Second Generation

0×11=original Material

Indicates the generation history of the audio material within the bit stream.

| Source PCM coding Resolution NV PCMR 3 bits |
|---|
| 0x000 = 16 bits |
| 0x001 = 18 bits |
| 0x010 = 20 bits |
| 0x011 = 21 bits |
| 0x100 = 22 bits |
| 0x101 = 23 bits |
| 0x110 = 24 bits |
| 0x111 = INVALID |

Indicates the PCM resolution of the encoded source digital audio samples.

Unspecified NV UNSPEC 6 Bits

This header is presently unspecified.

Optional Header Information

The optional header information 196 tells the decoder if downmixing is required, if dynamic range compensation was done and if auxiliary data bytes are included in the data stream.

| | |
|---|---|
| Time Code Stamp | ACC TIMES 32 bits |
| Down Mix Coefficients | V MCOEFF 8bit*CHS*2 |
| Dynamic Range Coefficients *CHS*no. of sets | V DCOEFF 8 bit |
| Auxiliary Data Bytes | NV AUXD 8bit*AUXCT |
| Optional Reed Solomon Check Word | OCRC 8 bits X 2 |

Optional check bytes will be inserted only if mix, or dynamic range coefficients are present.

Audio Coding Header

The audio coding headers 198 indicate the packing arrangement and coding formats used at the encoder to assemble the coding 'side information', i.e. bit allocations, scale factors, PMODES, TMODES, codebooks, etc. Many of the headers are repeated for each audio channel.

Number of Subframes SUBFS 4 Bits

One SUBFS index is transmitted per audio frame. The index indicates the number of discreet data blocks or audio subframes contained within the main audio frame. Each subframe may be decoded independent from any other subframe. SUBS is valid for all audio channels (CHS). The number of subframes equals the SSUBFS index plus 1.

Number of Audio Channels CHS 3 Bits

A single CHS index is transmitted to indicate the number of separate audio channels for which data may be found in the current audio frame. The number of audio channels equals the CHS index plus 1.

Subband Activity Count SUBS 5 Bits×CHS

A SUBS index is transmitted for each audio channel. The index indicates the number of active subbands in each audio channel, SUBS index plus 2. Samples in subbands located above SUBS are reset prior to computing the 32-band interpolation filter, provided that intensity coding in that band is disabled. SUBS are not transmitted if SFREQ is greater than 48 kHz.

High Frequency VQ Band

Start Number VQSUB 4 Bits×CHS

A VQSUB index is transmitted for each audio channel. The index indicates the starting subband number, VQSUB index+18, for which high frequency vector quantizer code book addresses are present in the data packets. VQSUBS are not transmitted if SFREQ is greater than 48 kHz. VQSUBS should be ignored for any audio channel using intensity coding.

Intensity Coding Index JOINX 3 bit×CHS

An intensity coding index is transmitted for each audio channel. The index in Table 6 indicates whether joint intensity coding is enabled and which audio channels carry the joint audio data. If enabled, the SUBS index changes to indicate the first subband from which intensity coding begins, SUBS index plus 2. Intensity coding will not be enabled if SFREQ is greater than 48 kHz.

TABLE 6

Joint Frequency Coding

| JOINX index | Joint Coding | Channel Source |
|---|---|---|
| 0 | off | n/a |
| 1 | on | Ch no. +1 |
| 2 | on | Ch no. +2 |
| 3 | on | Ch no. +3 |
| 4 | on | Ch no. +4 |
| 5 | on | Ch no. +5 |
| 6 | on | Ch no. +6 |
| 7 | on | Ch no. +7 |

Transient Mode Quantizer Select THUFF 2 Bits×CHS

A THUFF index is transmitted for each audio channel. The index selects either 4-level Huffman or fixed 4-level (2-bit) inverse quantizers for decoding the transient mode data.

Scale Factor Quantizer Select SHUFF 3 Bits×CHS

A SHUFF index is transmitted for each audio channel. The index selects either 129-level Huffman, fixed 64-level (6-bit), or fixed 128-level (7-bit) inverse quantizers for decoding the scale factor data.

Bit Allocation Index Quantizer Select BHUFF 3 Bits×CHS

A BHUFF index is transmitted for each audio channel. The index selects either 13-level Huffman, fixed 16-level (4-bit), or fixed 32-level (5-bit) inverse quantizers for decoding the bit allocation indexes.

5-level Quantizer Select SEL5 1 Bit×CHS

A SEL5 index is transmitted for each audio channel. The index indicates which 5-level inverse Huffman quantizer will be used to decode audio codes which have a bit allocation index of 2.

7/8-level Quantizer Select SEL7 2 Bits×CHS

A SEL7 index is transmitted for each audio channel. The index indicates which 7-level inverse Huffman quantizer will be used to decode audio codes which have a bit allocation index of 3. When SEL7=3 an 8-level (3-bit) fixed rate quantizer is used.

9-level Quantizer Select SEL9 2 Bits×CHS

A SEL9 index is transmitted for each audio channel. The index indicates which 9-level inverse Huffman quantizer will be used to decode audio codes which have a bit allocation index of 4.

13-level Quantizer Select SEL13 2 Bits×CHS

A SEL13 index is transmitted for each audio channel. The index indicates which 13-level inverse Huffman quantizer will be used to decode audio codes which have a bit allocation index of 5.

17/16-level Quantizer Select SEL17 3 Bits×CHS

A SEL17 index is transmitted for each audio channel. The index indicates which 17-level inverse Huffman quantizer will be used to decode audio codes which have a bit allocation index of 6. When SEL17=7 a 16-level (4-bit) fixed rate quantizer is used.

25-level Quantizer Select SEL25 3 Bits×CHS

A SEL25 index is transmitted for each audio channel. The index indicates which 25-level inverse Huffman quantizer will be used to decode audio codes which have a bit allocation index of 7.

33/32-level Quantizer Select SEL33 3 Bits×CHS

A SEL33 index is transmitted for each audio channel. The index indicates which 33-level inverse Huffman quantizer will be used to decode audio codes which have a bit allocation index of 8. When SEL33=7 a 32-level (5-bit) fixed rate quantizer is used.

65/64-level Quantizer Select SEL65 3 Bits×CHS

A SEL65 index is transmitted for each audio channel. The index indicates which 65-level inverse Huffman quantizer will be used to decode audio codes which have a bit allocation index of 9. When SEL65=7 a 64-level (6-bit) fixed rate quantizer is used.

129/128-level Quantizer Select SEL129 3 Bits×CHS

A SEL129 index is transmitted for each audio channel. The index indicates which 129-level inverse Huffman quantizer will be used to decode audio codes which have a bit allocation index of 10. When SEL129=7 a 128-level (7-bit fixed rate quantizer is used.

Audio Headers CRC Check Word AHCRC 8 Bits×2

Optional Reed Solomon check bytes to verify audio header validity.

Audio Subframes

The remainder of the frame is made up of SUBFS consecutive audio subframes 188. Each subframe begins with the audio coding side information, followed by the audio data itself. Each subframe is terminated with unpacking verification/synchronization bytes. Audio subframes are decoded entirely without reference to any other subframe.

Audio Coding Side Information

The audio coding side information 200 relays information regarding a number of key encoding systems used to compress the audio to the decoder. These include transient detection, predictive coding, adaptive bit allocation, high frequency vector quantization, intensity coding and adaptive scaling. Much of this data is unpacked from the data stream using the audio coding header information above.

Sub-Subframe Count SSC 2 Bits

Indicates the number of 256 sample blocks (sub-subframes) represented in the current audio subframe per channel, SSC index plus 1. The maximum sub-subframe count is 4 and the minimum 1. For a 32 band filter this gives either 1024, 512, 256 or 128 samples per subframe per audio channel. The SSC is valid for all audio channels.

Partial Sub-subframe Sample Count PSC 3 Bits

Indicates the number of subband samples in a partial sub-subframe (ie the SSCth+1). Normally PSC will be 0, i.e. a partial sub-subframe does not exist. Partial sub-subframes s frames will only exist in termination frames, (PSC is always 0 when SSC=4, ie subframe size cannot exceed 1024 samples). The PSC is valid for all audio channels.

Prediction Mode Array PMODE

Ordered as 1 bit per subband per channel, starting at subband 1 of channel 1 through to subband SUBS of channel 1 and repeating for CHS channels. When PMODE=1 then prediction mode is active, and prediction mode is inactive when PMODE=0. The SUBS indicates the last subband for the PMODES, in both non-intensity and intensity coding modes.

Prediction Coefficients VQ Index Array PVQ

A 12-bit prediction coefficient vector index will exist for each subband for which PMODE is active starting from subband 1 in channel 1 through to subband SUBS, and repeating for remaining channels. The predictor coefficients themselves are obtained by applying the index to the vector code book, which has 8192 different vectors. The predictor coefficients are valid for the current subframe. If PMODE=0 the predictor coefficients are held in reset.

Bit Allocation Index Data Array ABIT

This array is decoded using a Huffman/linear inverse quantizer as indicated by indexes BHUFF. Bit allocation indexes are not transmitted for subbands which are encoded using the high frequency vector quantizer or for subbands which are intensity coded. The index ordering begins with subband 1, channel 1, through to the last active subband of CHS channel.

Subband Transient Mode Data Array TMODE

This array does not exist if only one sub-subframe resides in the subframe (SSC). TMODES are decoded using a Huffman/linear inverse quantizer as indicated by indexes THUFF. TMODE data is not transmitted for subbands which are encoded using the high frequency vector quantizer. The array is ordered audio channel 1 to channel CHS. The transient modes are valid for the current sub-frame.

Subband Scale Factor Data Array SCALES

This array is decoded using a Huffman/linear inverse quantizer as indicated by indexes SHUFF. If Huffman inverse quantization is indicated the scale data is differentially encoded and must be converted to absolute by adding the current value to previous sum. Scale factors are then converted to rms values using the 6-bit or 7-bit look up tables. In any subband a single scale factor is transmitted when the corresponding tmode=0. Otherwise two scale factors are transmitted.

Side information CRC Check Word SICRC 8 bits×2

The validity of the subframe side information beginning from SSC can be optionally verified using the Reed Solomon check bytes SICRC.

Audio Data Arrays

High Frequency Vector Index Data Array HFREQ

This array 202 consists of 10-bit indexes per high frequency subband indicated by VQSUB indexes. 32 audio samples are obtained by mapping each 10-bit index to the high frequency code book, which has 1024 length 32 quantization vectors.

Low Frequency Effects PCM Data Array LFE

This array 204 is not present if LFF=0. It comprises a number of 8-bit effect samples plus one 7-bit scale factor. The number of effective bytes present in LFE is given by SSC*2 when PSC=0 or (SSC+1)*2 when PSC is non zero. This array represents the very low frequency data that can be used to drive, for example, a subwoofer.

Audio Data Array AUDIO

The audio array 206 is decoded using Huffman/fixed inverse quantizers as indicted by indexes ABITS (Table 8) and in conjunction with SEL indexes when ABITS are less than 11. This array is divided into a number of sub-subframes (SSC), each decoding up to 256 PCM samples per audio channel.

High Frequency Sampled Audio OVER_AUDIO

This array 208 is only present if SFREQ is greater than 48 kHz. The first 2 bytes of the array indicate the total number of bytes present in the data array. The decoding specification for the high frequency sampled audio will be defined in future revisions. To remain compatible, decoders which cannot operate at sampling rates above 48 kHz should skip this audio data array.

Data Synchronization Word DSYNC 16 Bits

DSYNC=0×ffff

DSYNC 210 is used to verify the end of the subframe position in audio frame. If the position does not verify, the audio decoded in the subframe is declared unreliable. As a result, either that frame is muted or the previous frame is repeated.

Subband Decoder

Figure 26:
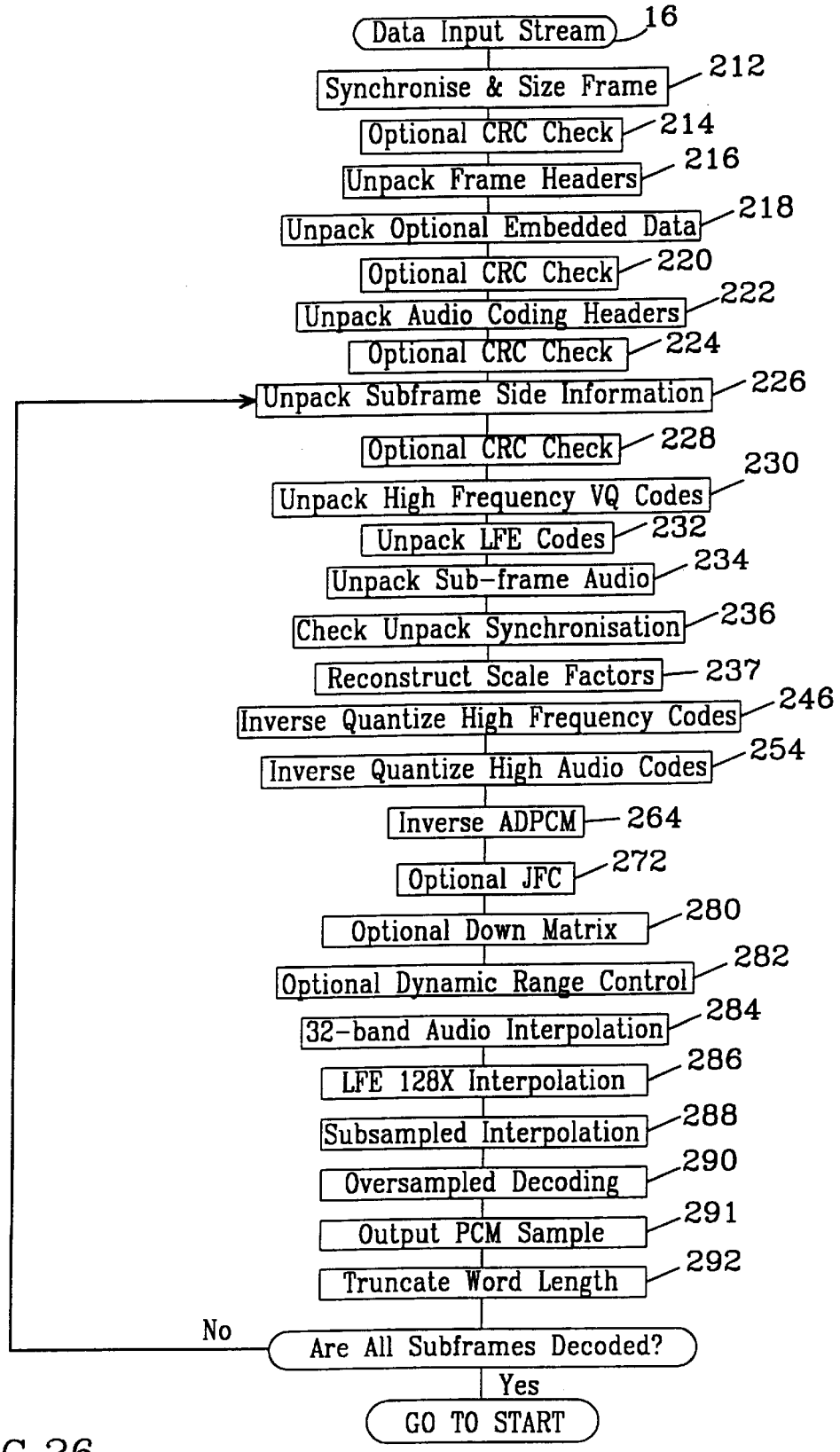
FIG. 26 is a flowchart of the decoding process.
Figure 27:
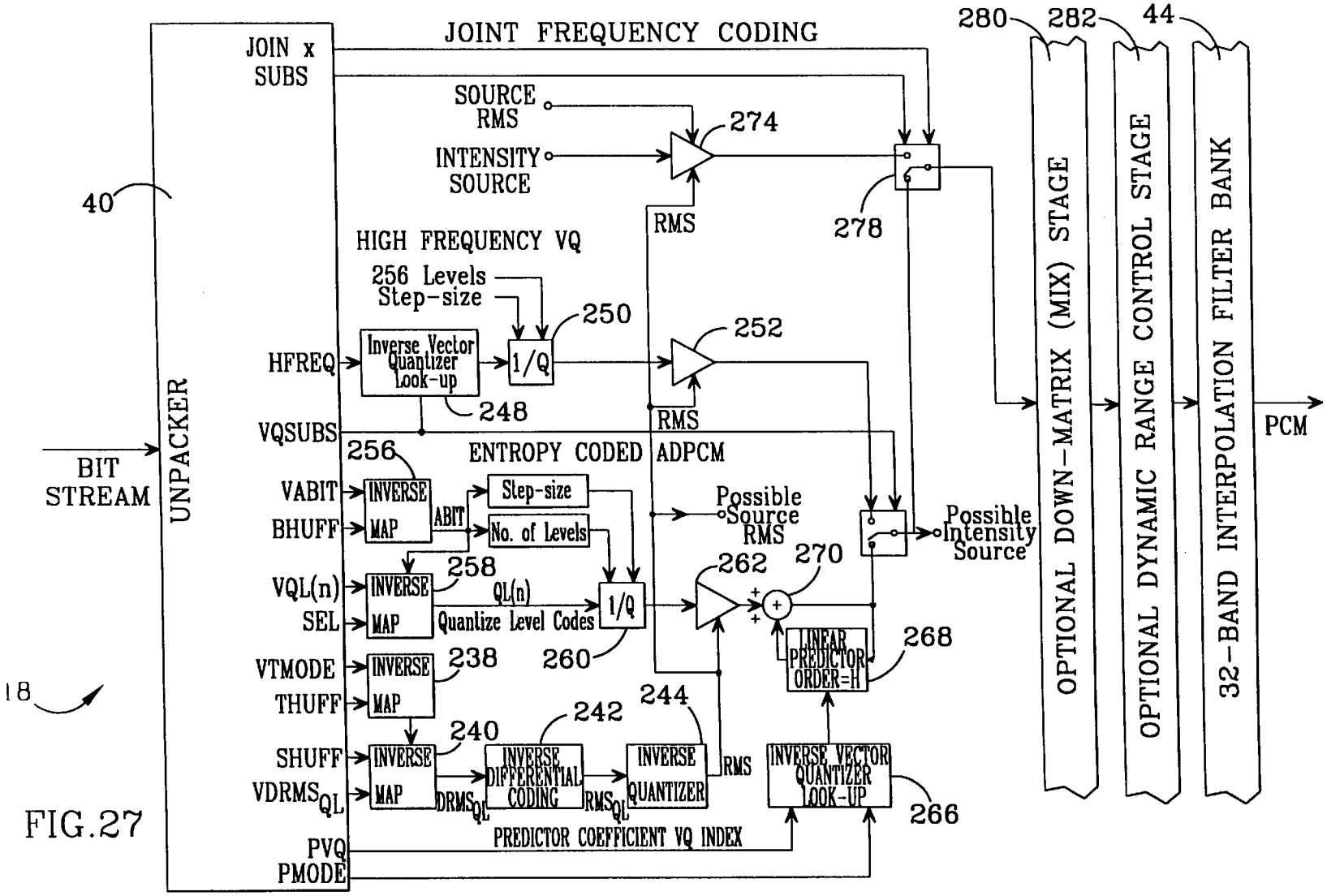
FIG. 27 is a schematic diagram of the decoder.
Figure 28:
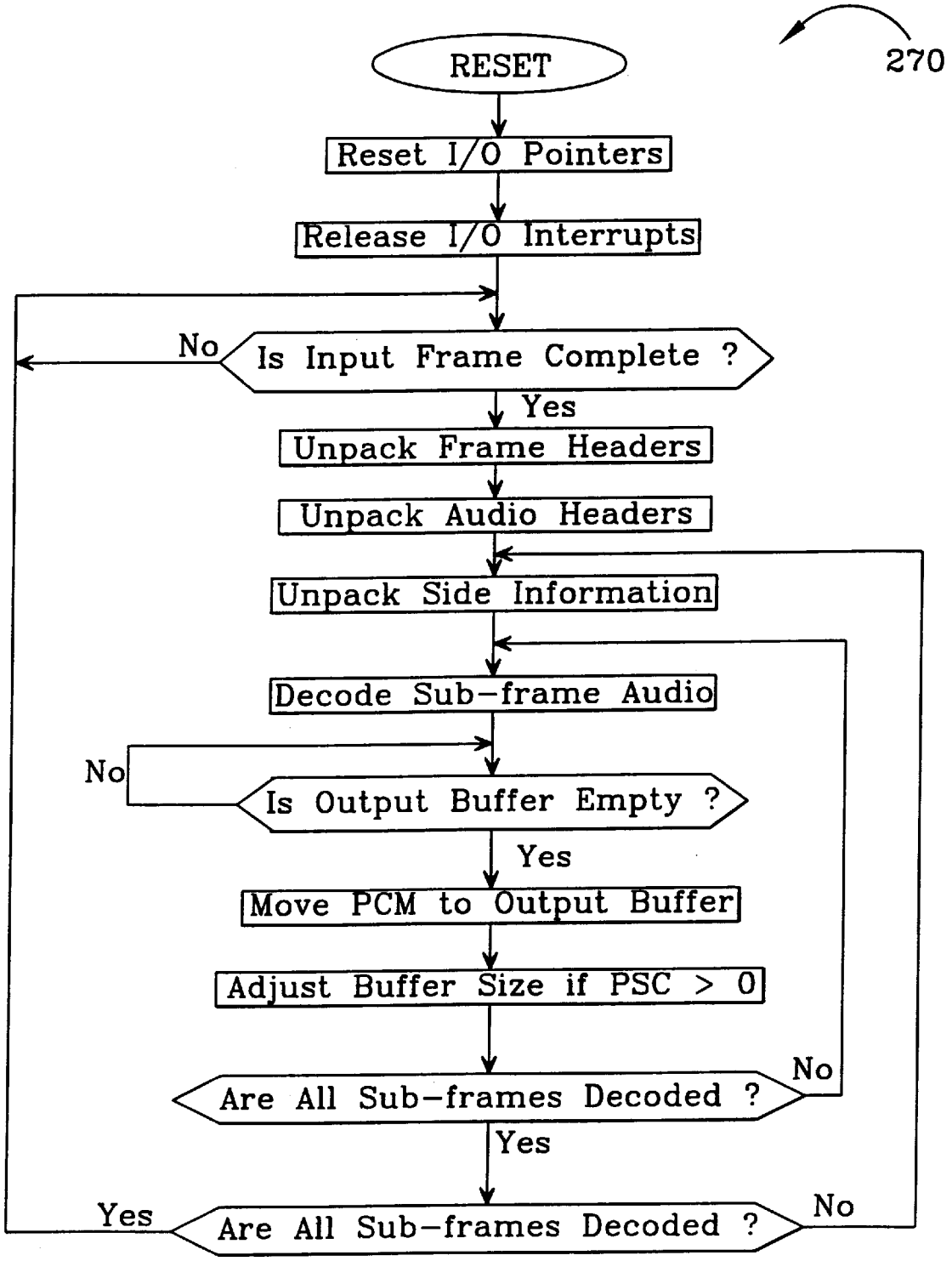
FIG. 28 is a flowchart of the I/O procedure.

FIGS. 26 and 27 are a flowchart and a block diagram of the subband sample decoder 18, respectively. The decoder is quite simple compared to the encoder and does not involve calculations that are of fundamental importance to the quality of the reconstructed audio such as bit allocations. After synchronization the unpacker 40 unpacks the compressed audio data stream 16, detects and if necessary corrects transmission induced errors, and demultiplexes the data into individual audio channels. The subband differential signals are requantized into PCM signals and each audio channel is inverse filtered to convert the signal back into the time domain.

Receive Audio Frame and Unpack Headers

The coded data stream is packed (or framed) at the encoder and includes in each frame additional data for decoder synchronization, error detection and correction, audio coding status flags and coding side information, apart from the actual audio codes themselves.

In the first step 212, the unpacker 40 detects the SYNC word and extracts the frame size FSIZE:

Find Sync [sync]

The coded bit stream consists of consecutive audio frames, each beginning with a 32-bit (0×7ffe8001) synchronization word (SYNC). Since the frame type will almost always be normal (FTYPE=1 and SURP=0×1f) the sync word may be reliably concatenated with 0×3f increasing the effective sync word size to 38 bits. To compensate for bit errors the position of SYNC may be averaged with previous frames or it may be verified using the Reed Solomon check word HCRC.

Determine Size of Data Frame and Audio Window [fsize] [Nblks]

Once SYNC has been detected the physical size of the audio frame, FSIZE is extracted from the bytes following the sync word. This allows the programmer to set an 'end of frame' timer to reduce software overheads. As a result, the decoder can read in a complete frame without having to unpack the frame on-line. The actual frame size may vary from frame to frame, for example in the case when Fsamp=44.1. However, to enable practical buffer management, certain limitations exist as to the maximum number of bytes that is to be expected in any given audio frame for fixed rate coding as shown in Tables 1,2. For example, for audio encoded at 48 kHz sampling, with a bit rate of 384 kbps, the largest audio window at the encoder is 4096 samples, giving a maximum transmitted frame size of approximately 5.3 k bytes, irrespective of the number of audio channels being coded. The 'worst case' frame size is always 8 k bytes for 8,16,32,64,128 kHz sampling rate modes. This limit does not apply for the variable or lossless coding modes since due to the burst nature of the input data, on-chip buffering would prove impractical in any case.

Next NBlks is extracted which allows the decoder to compute the Audio Window Size (32(Nblks+1)). This tells the decoder what side information to extract and how many reconstructed samples to generate.

The next steps are to optionally Read Solomon (CRC) check 214 the header bytes, unpack the frame headers 216, unpack the optional embedded data 218, and optionally CRC check 220 the optional header bytes:

Verify Validity of Audio frame Readers

[sync, ftype, surp, nblks, fsize, amode, sfreq, rate, mixt, dyn f, dynct, time, auxcnt, lff, hflag]

As soon as the frame header bytes have been received (or the entire audio frame) the validity of the first 12 bytes may checked using the Reed Solomon check bytes, HCRC. These will correct 1 erroneous byte out of the 14 bytes or flag 2 erroneous bytes. After error checking is complete the header information is used to update the decoder flags.

Extract Non-critical Frame Headers

[filts,vernum,chist,pcmr,unspec]

The headers following HCRC and up to the optional information, may be extracted and used to update the decoder flags. Since this information will not change from frame to frame, a majority vote scheme may be used to compensate for bit errors.

Extract Optional Headers

[times,mcoeff,dcoeff,auxd,ocrc]

The optional header data is extracted according to the mixct, dynf, time and auxcnt headers. The optional data may be verified using the optional Reed Solomon check bytes OCRC.

The final steps 222 and 224 involved in unpacking the headers are to:

Extract and Verify Audio Coding Frame Headers

[subfs, subs,chs,vqsub,joinx,thuff,shuff,bhuff, sel5,sel7, sel9,sel13,sel17,sel25,sel33,sel65,sel129,ahcrc]

The audio coding frame headers are transmitted once in every frame. They may be verified using the audio Reed Solomon check bytes AHCRC. Most headers are repeated for each audio channel as defined by CHS.

Unpack Subframe Coding Side Information

The audio coding frame is divided into a number of subframes (SUBFS). The number of PCM samples represented in each subframe is given by ((SSC+1)*256)+(PSC*32). All the necessary side information (pmode, pvq, tmode, scales, abits, hfreq) is included to properly decode each subframe of audio without reference to any other subframe.

Each successive subframe is decoded by first unpacking its side information 226:

Unpack Prediction Modes [pmodes]

A 1-bit prediction mode (PMODE) flag is transmitted for every active subband (SUBS) and across all audio channel (CHS). The PMODE flags are valid for the current subframe. PMODE=0 implies that the predictor coefficients are not included in the audio frame for that subband. In this case the predictor coefficients in this band are reset to zero for the duration of the subframe. PMODE=1 implies that the side information contains predictor coefficients for this subband. In this case the predictor coefficients are extracted and installed in its predictor for the duration of the subframe. The pmodes are packed, starting with audio channel 1, in ascending subband number up to SUBS specifier, followed by those from channel 2 etc.

Unpack Prediction VQ Index Array [pvq]

The predictors used in audio coder are all-pole 4th order linear. The predictor coefficients are encoded using a 12-bit 4-element vector quantizer. To reconstruct the coefficients at the decoder an identical 4096×4 vector look-up table is stored at the decoder. The coefficients address information is hence transmitted to the decoder as indexes (PVQ). The predictor coefficients are valid for the entire subframe.

For every PMODE=1 in the pmode array a corresponding prediction coefficient VQ address index is located in array PVQ. The indexes are fixed unsigned 12-bit integer words and the 4 prediction coefficients are extracted from the look-up table by mapping the 12-bit integer to the vector table. The ordering of the 12-bit indexes matches that of the pmodes. The coefficients in LUT are stored as 16-bit signed fractional (Q13) binary.

Unpack Bit Allocation Index Array [abit]

The bit allocation indexes (ABIT) indicate the number of levels in the inverse quantizer which will convert the subband audio codes back to absolute values. ABITs are transmitted for each subband subframe, starting at the first and stopping at the SUBS or VQSUB subband limit, which ever is smaller. The unpacking format differs for the ABITs in each audio channel, depending on the BHUFF index and a specific VABIT code. The ABITs are packed, starting with audio channel 1, in ascending subband number up to the SUBS/VQSUB limit, followed by those from channel 2, and so on. For intensity coded audio channels ABIT indexes are transmitted only for subbands up to the SUBS limit.

BHUFF=6

In this mode the ABIT indexes are packed as fixed 5-bit unsigned integers, giving a range of indexes between 0–31.

BHUFF=5

In this mode the ABIT indexes are packed as fixed 4-bit unsigned integers, giving a range of indexes between 0–15.

BHUFF=4–0

In this mode the ABIT indexes are unpacked using a choice of five 13-level unsigned Huffman inverse quantizers giving a range of indexes between 0–12.

Unpack Subband Transient Mode Array [tmode]

The transient mode side information (TMODE) is used to indicate the position of transients in each subband with respect to the subframe. Each subframe is divided into 1 to 4 sub-subframes. In terms of subband samples each sub-subframe consists of 8 samples. The maximum subframe size is 32 subband samples. If a transient occurs in the first sub-subframe then tmode=0. A transient in the second sub-subframe is indicated when tmode=1, and so on. To control transient distortion, such as pre-echo, two scale factors are transmitted for subframe subbands where TMODE is greater then 0. The first scale factor is used to scale the subband audio in the sub-subframes up to the one which contains the transient. The second scale factor is used to scale the subband audio in the sub-subframe which contains the transient and in any following sub-subframes.

However, if only one sub-subframe exists in the current subframe (SSC=0) then no TMODEs are transmitted for any of the audio channels. This is because the position of transients in a single sub-subframe need not be resolved and TMODEs can be assumed to be zero. Hence, when SSC=0, a single scale factor will exist per subband up to the normal SUBS limit.

For non-intensity coded channels, TMODE indexes are not transmitted for subbands which use high frequency vector quantization (VQSUB), subbands in which the subframe bit allocation index is zero, or for subbands beyond the SUBS limit. In the case of VQSUB subbands, the TMODE indexes default to zero.

For intensity coded channels where SUBS is used to indicate the first joined subband, even though bit allocation indexes do not exist above SUBS, TMODES are still transmitted for subbands above the SUBS limit. The actual number of subbands for which TMODES are transmitted in intensity coded channels is the same as that in the source audio channel, i.e. use the SUBS for the audio channel indicated by the JOINX.

The THUFF indexes extracted from the audio headers determine the method required to decode the TMODEs.

When THUFF=3, the TMODEs are unpacked as un-signed 2-bit integers. When THUFF is any other value then they are decoded using a choice of three 4-level Huffman inverse quantizers. specifically the THUFF index selects a particular table and the VTMODE index selects a code from that table.

The TMODES are packed, starting with audio channel 1, in ascending subband number, followed by those from channel 2, and so on.

Unpack Subband Scale Factor Array [Scales]

Scale factor indexes are transmitted to allow for the proper scaling of the subband audio codes within each subframe. If TMODE is equal to zero (or defaults to zero, as is the case with VQSUBS subbands) then one scale factor is transmitted. If TMODE is greater than zero for any subband, then two scale factors are transmitted together.

For non-intensity coded channels, scale factors are always transmitted except for subbands beyond the SUBS limit, or for subbands in which the subframe bit allocation index is zero. For intensity coded channels, scale factors are transmitted up to the SUBS limit of the source channel given in JOINX.

The SHUFF indexes extracted from the audio headers determine the method required to decode the SCALES for each separate audio channel. The $VDRMS_{QL}$ indexes determine the value of the RMS scale factor. The scale indexes are packed, starting with audio channel 1, in ascending subband number, followed by those from channel 2, and so on.

SHUFF=6

SCALES indexes are unpacked for this channel as un-signed 7-bit integers. The indexes are converted to rms values by mapping to the nearest 7-bit quantizer level. At 127 levels, the resolution of the scale factors is 1.25 dB and the dynamic range 158 dB. The rms values are unsigned 20-bit fractional binary, scaled with 4 different Q factors depending on the magnitude.

SHUFF=5

SCALES indexes are unpacked for this channel as un-signed 6-bit integers. The indexes are converted to rms values by mapping to the nearest 6-bit quantizer level. At 63 levels, the resolution of the scale factors is 2.25 dB and the dynamic range 141 dB. The rms values are unsigned 20-bit fractional binary, scaled with 4 different Q factors depending on the magnitude.

SHUFF=4-0

SCALES indexes are unpacked for this channel using a choice of five 129-level signed Huffman inverse quantizers. The resulting inverse quantized indexes are, however, differentially encoded and are converted to absolute as follows;

ABS_SCALE(n+1)=SCALES(n)−SCALES(n+1) where n is the nth differential scale factor in the audio channel starting from the first subband.

Note, the first differential scale factor (n=1) for each channel is copied directly into the absolute array, and subbands for which there is no scale index are dropped from the calculation. The absolute indexes are then converted to rms values by mapping to the nearest 6-bit quantizer level. At 63 levels, the resolution of the scales factors is 2.25 dB and the dynamic range 141 dB. The rms values are unsigned 20-bit fractional binary, scaled with 4 different Q factors depending on the magnitude.

The remaining steps include an optional CRC check 228, unpacking high frequency VQ codes 230, and unpacking the LFE codes 232:

Verify Subframe Side Information with SICRC Check Bytes

The validity of the subframe side information data beginning from SSC can be optionally verified using the extracted Reed Solomon check bytes SICRC 228. This check is only practical when the side information is linearly encoded ie Huffman quantizers are not used. This is normally the case for high bit-rate coding modes.

Unpack High Frequency VQ Index Array [hfreq]

At low bit-rate audio coding modes, the audio coder uses vector quantization to efficiently encode high frequency subband audio samples directly. No differential encoding is used in these subbands and all arrays relating to the normal ADPCM processes must be held in reset. The first subband which is encoded using VQ is indicated by VQSUB and all subbands up to SUBS are also encoded in this way. The VQSUB index is meaningless when the audio channel is using intensity coding (JOINX).

The encoder uses a 10-bit 32-element vector look-up table. Hence, to represent 32 subband samples a 10-bit address index is transmitted to the decoder. Using an identical look-up table at the decoder, the same 32 samples are extracted 230 by mapping the index to the table. Only one index is transmitted for each subband per subframe. If a termination frame (FTYPE) is flagged and the current subframe is less than 32 subband samples (PSC) then the surplus samples included in the vector should be ignored.

The high frequency indexes (HFREQ) are unpacked as fixed 10-bit unsigned integers. The 32 samples required for each subband subframe are extracted from the Q4 fractional binary LUT by applying the appropriate indexes. This is repeated for each channel in which the high frequency VQ mode is active.

The high frequency indexes are packed starting with the lowest audio channel for which VQSUBS is active and in ascending subbands, followed by those from the next active channel, and so on.

Unpack Low Frequency Effects PCM Array [lfe]

The decimation factor for the effects channel is always ×128. The number of 8-bit effect samples present in LFE is given by SSC*2 when PSC=0 or (SSC+1)*2 when PSC is non zero. An additional 7-bit scale factor (unsigned integer) is also included at the end of the LFE array and this is converted to rms using a 7-bit LUT.

Unpack Sub-Subframe Audio Codes Array

Unpack Baseband Audio Codes [audio]

The extraction process 234 for the subband audio codes is driven by the ABIT indexes and, in the case when ABIT<11, the SEL indexes also. The audio codes are formatted either using variable length Huffman codes or fixed linear codes. Generally ABIT indexes of 10 or less will imply a Huffman variable length codes, which are selected by codes VQL(n), while ABIT above 10 always signify fixed codes (Table 7). All quantizers have a mid-tread, uniform characteristic. For the fixed code ($y^2$) quantizers the most negative level is dropped.

TABLE 7

Audio Inverse Quantizer Table vs. ABIT and SEL[xx] indexes

| ABIT | Number of | Choice of quantizer tables (SELxx indexes) | | | | | | | |
|---|---|---|---|---|---|---|---|---|---|
| index | Q levels | 0 | 1 | 2 | 3 | 4 | 5 | 6 | 7 |
| 0 | 0 | | | | | | | | |
| 1 | 3 | A3 | | | | | | | |
| 2 | 5 | A5 | B5 | | | | | | |
| 3 | 7(8) | A7 | B7 | C7 | Y8 | | | | |
| 4 | 9 | A9 | B9 | C9 | D9 | | | | |
| 5 | 13 | A13 | B13 | C13 | D13 | | | | |
| 6 | 17(16) | A17 | B17 | C17 | D17 | E17 | F17 | G17 | Y16 |
| 7 | 25 | A25 | B25 | C25 | D25 | E25 | F25 | G25 | H25 |
| 8 | 33(32) | A33 | B33 | C33 | D33 | E33 | F33 | G33 | Y32 |
| 9 | 65(64) | A65 | B65 | C65 | D65 | E65 | F65 | G65 | Y64 |
| 10 | 129(128) | A129 | B129 | C129 | D129 | E129 | F129 | G129 | Y128 |
| 11 | 256 | Y256 | | | | | | | |
| 12 | 512 | Y512 | | | | | | | |
| 13 | 1024 | Y1024 | | | | | | | |
| 14 | 2048 | Y2048 | | | | | | | |
| 15 | 4096 | Y4096 | | | | | | | |
| 16 | 8192 | Y8192 | | | | | | | |
| 17 | 16384 | Y16384 | | | | | | | |
| 18 | 32768 | Y32768 | | | | | | | |
| 19 | 65536 | Y65536 | | | | | | | |
| 20 | 131072 | Y131072 | | | | | | | |
| 21 | 262144 | Y262144 | | | | | | | |
| 22 | 524288 | Y524288 | | | | | | | |
| 23 | 1048576 | Y1048576 | | | | | | | |
| 24 | 2097152 | Y2097152 | | | | | | | |
| 25 | 4194304 | Y4194304 | | | | | | | |
| 26 | 8388608 | Y8388608 | | | | | | | |
| 27 | 16777216 | Y16777216 | | | | | | | |
| 28–31 | invalid | invalid | | | | | | | |

where Y=uniform mid-tread fixed-code quantizer and A,B,C,D,E,F,G=uniform mid-tread variable-code (Huffman) quantizer.

The audio codes are packed into sub-subframes, each representing a maximum of 8 subband samples, and these sub-subframes are repeated up to four times in the current subframe. Hence the above unpacking procedure must be repeated SSC times in each subframe. The reason for packing the audio in this way is to allow a single sub-subframe to be unpacked and decoded without having to unpack the entire subframe. This reduces the computational overhead when using a sub-subframe size output buffer (256 samples per channel).

In the case of termination frame where PSC is non zero, the unpacking is repeated a further time, except that the number of codes for each subband is now equal to PSC. In this case also, the ABIT indexes are reused from the previous sub-subframe.

Unpack High Frequency Audio Codes [Over_Audio]

If the sampling rate flag (SFREQ) indicates a rate higher than 48 kHz then the over_audio data array will exist in the audio frame. The first two bytes in this array will indicate the byte size of over_audio. The higher frequency sampled audio decoding specification is currently being finalized and will be the subject of future drafts. Presently this array should be ignored and the base-band audio decoded as normal. Further, the sampling rate of the decoder hardware, should be set to operate at SFREQ/2 or SFREQ/4 depending on the high frequency sampling rate.

Unpack Synchronization Check [dsync]

A data unpacking synchronization check word DSYNC=0×ffff is detected 236 at the end of every subframe to allow the unpacking integrity to be verified. The use of variable code words in the side information and audio codes, as is the case for low audio bit rates, can lead to unpacking mis-alignment if either the headers, side information or audio arrays have been corrupted with bit errors. If the unpacking pointer does not point to the start of DSYNC then it can be assumed the previous subframe audio is unreliable. If the headers and side information are known to be error free, the unpacking of the next subframe should begin from the first bit following DSYNC.

Once all of the side information and audio data is unpacked, the decoder reconstructs the multi-channel audio signal a subframe at a time. FIG. 27 illustrates the baseband decoder portion for a single subband in a single channel.

Reconstruct RMS Scale Factors

In step 237, the decoder reconstructs the RMS scale factors (SCALES) for the ADPCM, VQ and JFC algorithms. In particular, the VTMODE and THUFF indexes are inverse mapped (step 238) to identify the transient mode (TMODE) for the current subframe. Thereafter, the SHUFF index, $VDRMS_{QL}$ codes and TMODE are inverse mapped (step 240) to reconstruct the differential RMS code. The differential RMS code is inverse differential coded (step 242) to select the RMS code, which is them inverse quantized (step 244) to produce the RMS scale factor.

Inverse Quantize High Freguency Vectors

In step 246 the decoder inverse quantizes the high frequency vectors to reconstruct the subband audio signals. In particular, the extracted high frequency samples (HFREQ), which are signed 8-bit fractional (Q4) binary number, as identified by the start VQ subband (VQSUBS) are mapped (step 248) to an inverse VQ lut. The selected table value is inverse quantized (step 250), and scaled by the RMS scale factor (step 252).

Inverse Quantize Audio Codes

Before entering the ADPCM loop the audio codes are inverse quantized 254 and scaled to produce reconstructed subband difference samples. The inverse quantization is achieved by first inverse mapping (step 256) the VABIT and BHUFF index to specify the ABIT index which determines the step-size and the number of quantization levels and inverse mapping (step 258) the SEL index and the VQL(n) audio codes which produces the quantizer level codes QL(n). Thereafter, the code words QL(n) are mapped to the inverse quantizer look-up table specified by ABIT and SEL indexes (step 260). Although the codes are ordered by ABIT, each separate audio channel will have a separate SEL specifier. The look-up process results in a signed quantizer level number which can be converted to unit rms by multiplying with the quantizer step-size. The unit rms values are then converted to the full difference samples by multiplying with the designated RMS scale factor (SCALES) (step 262).

1. QL[n]=1/Q[code[n]] where 1/Q is the inverse quantizer look-up table
2. Y[n]=QL[n]*StepSize[abits]
3. Rd[n]=Y[n]*scale_factor where Rd=reconstructed difference samples Inverse ADPCM The ADPCM decoding process 264 is executed for each subband difference sample as follows;

1. Load the prediction coefficients from the inverse VQ lut (step 266).
2. Generate the prediction sample by convolving the current predictor coefficients with the previous 4 reconstructed subband samples held in the predictors history array (step 268).

P[n]=sum (Coeff[i]*R[n−i]) for i=1, 4 where n=current sample period

3. Add the prediction sample to the reconstructed difference sample to produce a reconstructed subband sample (step 270).

R[n]=Rd[n]+P[n]

4. Update the history of the predictor, ie copy the current reconstructed subband sample to the top of the history list.

R[n−i]=R[n−i+1] for I=4, 1

In the case when PMODE=0 the predictor coefficients will be zero, the prediction sample zero, and the reconstructed subband sample equates to the differential subband sample. Although in this case the calculation of the prediction is unnecessary, it is essential that the predictor history is kept updated in case PMODE should become active in future subframes. Further, if the HFLAG is active in the current audio frame, the predictor history should be cleared prior to decoding the very first sub-subframe in the frame. The history should be updated as usual from that point on.

In the case of high frequency VQ subbands or where subbands are deselected (i.e. above SUBS limit) the predictor history should remain cleared until such time that the subband predictor becomes active.

Joint Freguency (Intensity) Coding in Subbands

The presence of intensity coding in any audio channel is flagged 272 when JOINX is non zero. JOINX indicates the channel number where the amalgamated or joined subband audio is located (Table 6). The reconstructed subband samples in the source channel are copied over to the corresponding subbands in the intensity channels, beginning at the subband indicated by the SUBS of the intensity channel itself. During the process of transferring the source subband audio to the intensity subbands, the amplitude of the samples are multiplied by the ratio of the source subband rms and the intensity subband rms (step 274). The source subband rms must be explicitly calculated in subframes where PMODE=1 since the scale factors for these bands represent the differential signal energy, not the absolute. However, for all intensity subbands the scale factor (SCALES) will represent the absolute rms and so they can be used directly. The ratio is calculated once for the entire subframe, or for the sub-subframe combinations when TMODE is non zero.

Selection Control of ADPCM, VQ and JFC Decoding

A first "switch" controls the selection of either the ADPCM or VQ output (step 276). The VQSUBS index identifies the start subband for VQ encoding. Therefore if the current subband is lower than VQSUBS, the switch selects the ADPCM output. Otherwise it selects the VQ output. A second "switch" controls the selection of either the direct channel output or the JFC coding output. The JOINX index identifies which channels are joined and in which channel the reconstructed signal is generated. The reconstructed JFC signal forms the intensity source for the JFC inputs in the other channels. Therefore, if the current subband is part of a JFC and is not the designated channel than, the switch selects the JFC output (step 278). Normally, the switch selects the channel output.

Down Matrixing

The audio coding mode for the data stream is indicated by AMODE. Using Table 8 the audio channel assignment is obtained for chs 1 to 8. The decoded audio channels can then be redirected to match the physical output channel arrangement on the decoder hardware.

TABLE 8

Audio Modes (AMODE) vs. Channel Assignment

| | | Physical Channel | | | | | | | |
|---|---|---|---|---|---|---|---|---|---|
| AMODE | CHS | 1 | 2 | 3 | 4 | 5 | 6 | 7 | 8 |
| 0 | 1-ch | A | | | | | | | |
| 1 | 2-ch | A | B | | | | | | |
| 2 | 2-ch | L | R | | | | | | |
| 3 | 2-ch | (L + R) | (L − R) | | | | | | |
| 4 | 2-ch | Lt | Rt | | | | | | |
| 5 | 3-ch | L | R | C | | | | | |
| 6 | 3-ch | L | R | S | | | | | |
| 7 | 4-ch | L | R | C | S | | | | |
| 8 | 4-ch | L | R | SL | SR | | | | |

TABLE 8-continued

| | | Audio Modes (AMODE) vs. Channel Assignment | | | | | | | |
|---|---|---|---|---|---|---|---|---|---|
| | | Physical Channel | | | | | | | |
| AMODE | CHS | 1 | 2 | 3 | 4 | 5 | 6 | 7 | 8 |
| 9 | 5-ch | L | R | C | SL | SR | | | |
| 10 | 6-ch | L | R | CL | CR | SL | SR | | |
| 11 | 6-ch | Lf | Rf | Cf | Cr | Lr | Rr | | |
| 12 | 7-ch | L | CL | C | CR | R | SL | SR | |
| 13 | 8-ch | L | CL | CR | R | SL1 | SL2 | SR1 | SR2 |
| 14 | 8-ch | L | CL | C | CR | R | SL | S | SR |

In the case when the physical playback arrangement has fewer channels then there are decoded channels, the decoded audio must be down matrixed 280 to match the playback system. A fixed down matrix table for 8-ch decoded audio is given in Table 9. Due to the linear nature of the down matrixing, this process can operate directly on the subband samples in each channel and retain the alias cancellation properties of the filterbank (with the appropriate scaling). This avoids having to run the interpolation filterbanks for redundant channels.

TABLE 9

| | | Down-mix coefficients for 8-channel source audio (5 + 3 format) | | | | | | | |
|---|---|---|---|---|---|---|---|---|---|
| | | lt | lt center | ctr | rt center | rt | lt srd | ctr srd | rt srd |
| 1 | | 0.71 | 0.71 | 1.0 | 0.71 | 0.71 | 0.58 | 0.58 | 0.58 |
| 2 | left | 1.0 | 0.89 | 0.71 | 0.46 | | 0.71 | 0.50 | |
| | rt | | 0.45 | 0.71 | 0.89 | 1.0 | | 0.50 | 0.71 |
| 3 | lt | 1.0 | 0.89 | 0.71 | 0.45 | | | | |
| | rt | | 0.45 | 0.71 | 0.89 | 1.0 | | | |
| | srd | | | | | | 0.71 | 0.71 | 0.71 |
| 4 | lt | 1.0 | 0.89 | 0.71 | 0.45 | | | | |
| | rt | | 0.45 | 0.71 | 0.89 | 1.0 | | | |
| | lt srd | | | | | | 1.0 | 0.71 | |
| | rt srd | | | | | | | 0.71 | 0.71 |
| 4 | lt | 1.0 | 0.5 | | | | | | |
| | ctr | | 0.87 | 1.0 | 0.87 | | | | |
| | rt | | | | 0.5 | 1.0 | | | |
| | srd | | | | | | 0.71 | 0.71 | 0.71 |
| 5 | lt | 1.0 | 0.5 | | | | | | |
| | ctr | | 0.87 | 1.0 | 0.87 | | | | |
| | rt | | | | 0.5 | 1.0 | | | |
| | lt srd | | | | | | 1.0 | 0.71 | |
| | rt srd | | | | | | | 0.71 | 1.0 |
| 6 | lt | 1.0 | 0.5 | | | | | | |
| | lt ctr | | 0.87 | 0.71 | | | | | |
| | rt ctr | | | 0.71 | 0.87 | | | | |
| | rt | | | | 0.5 | 1.0 | | | |
| | lt srd | | | | | | 1.0 | 0.71 | |
| | rt srd | | | | | | | 0.71 | 1.0 |
| 6 | lt | 1.0 | 0.5 | | | | | | |
| | ctr | | 0.86 | 1.0 | 0.86 | | | | |
| | rt | | | | 0.5 | 1.0 | | | |
| | lt srd | | | | | | 1.0 | | |
| | ctr srd | | | | | | | 1.0 | |
| | rt srd | | | | | | | | 1.0 |
| 7 | lt | 1.0 | | | | | | | |
| | lt ctr | | 1.0 | | | | | | |
| | ctr | | | 1.0 | | | | | |
| | rt ctr | | | | 1.0 | | | | |
| | rt | | | | | 1.0 | | | |
| | lt srd | | | | | | 1.0 | 0.71 | |
| | rt srd | | | | | | | 0.71 | 1.0 |
| 7 | lt | 1.0 | 0.5 | | | | | | |
| | lt ctr | | 0.87 | 0.71 | | | | | |
| | rt ctr | | | 0.71 | 0.87 | | | | |

TABLE 9-continued

| | | Down-mix coefficients for 8-channel source audio (5 + 3 format) | | | | | | | |
|---|---|---|---|---|---|---|---|---|---|
| | | lt | lt center | ctr | rt center | rt | lt srd | ctr srd | rt srd |
| | rt | | | | 0.5 | 1.0 | | | |
| | lt srd | | | | | | 1.0 | | |
| | ctr srd | | | | | | | 1.0 | |
| | rt srd | | | | | | | | 1.0 |
| 8 | lt | 1.0 | 0.5 | | | | | | |
| | lt ctr | | 0.87 | 0.71 | | | | | |
| | rt ctr | | | 0.71 | 0.87 | | | | |
| | rt | | | | 0.5 | 1.0 | | | |
| | lt 1 srd | | | | | | 0.87 | 0.35 | |
| | lt 2 srd | | | | | | 0.5 | 0.61 | |
| | rt 2 srd | | | | | | | 0.61 | 0.50 |
| | rt 2 srd | | | | | | | 0.35 | 0.87 |

Generation of Lt Rt

In the case when the playback system has analog or digital surround multi-channel capability, a down matrix from 5, 4, or 3 channel to Lt Rt may be desirable. In the case when the number of decoded audio channels exceeds 5, 4 or 3 respectively a first stage down mix to 5, 4 or 3 chs should be used as described above.

The down matrixing equations for 5-channel source audio to a two-channel Lt Rt playback system are given by:

Left=left+0.7*center−0.7*(lt surround+rt surround)

Right=right+0.7*center+0.7*(lt surround+rt surround)

Embedded Mixing to 2-Channel

One concern arising from the proliferation of multi-channel audio systems is that most home systems presently have only two channel playback capability. To accommodate this a fixed 2-channel down matrix processes is commonly used following the multi-channel decoding stage. However, for music only applications the image quality etc. of the down matrixed signal may not match that of an equivalent stereo recording found on CD.

The concept of embedded mixing is to allow the producer to dynamically specify the matrixing coefficients within the audio frame itself. In this way the stereo down mix at the decoder may be better matched to a 2-channel playback environment.

CHS*2, 7-bit down mix indexes (MCOEFFS) are transmitted along with the multi-channel audio once in every frame. The indexes are converted to attenuation factors using a 7 bit LUT. The 2-ch down mix equations are as follows, Left Ch=sum (MCOEFF[n]*Ch[n]) for n=1, CHS Right Ch=sum (MCOEFF[n+CHS]*Ch[n]) for n=1, CHS where Ch(n) represents the subband samples in the (n)th audio channel.

Dynamic Range Control Data

Dynamic range coefficients DCOEFF may be optionally embedded in the audio frame at the encoding stage. The purpose of this feature is to allow for the convenient compression of the audio dynamic range at the output of the decoder. Dynamic range compression 282 is particularly important in listening environments where high ambient noise levels make it impossible to discriminate low level signals without risking damaging the loudspeakers during loud passages. This problem is further compounded by the growing use of 20-bit PCM audio recordings which exhibit dynamic ranges as high as 110 dB.

Depending on the window size of the frame (NBLKS) either one, two or four coefficients are transmitted per audio channel for any coding mode (DYNF). If a single coefficient is transmitted, this is used for the entire frame. With two coefficients the first is used for the first half of the frame and the second for the second half of the frame. Four coefficients are distributed over each frame quadrant. Higher time resolution is possible by interpolating between the transmitted values locally.

Each coefficient is 8-bit signed fractional Q2 binary, and represents a logarithmic gain value as shown in table (53) giving a range of +/−31.75 dB in steps of 0.25 dB. The coefficients are ordered by channel number. Dynamic range compression is affected by multiplying the decoded audio samples by the linear coefficient.

The degree of compression can be altered with the appropriate adjustment to the coefficient values at the decoder or switched off completely by ignoring the coefficients.

32-Band Interpolation Filterbank

The 32-band interpolation filter bank 44 converts the 32 subbands for each audio channel into a single PCM time domain signal (step 284). Non-perfect reconstruction coefficients (512-tap FIR filters) are used when FILTS=0. Perfect reconstruction coefficients are used when FILTS=1. Normally the cosine modulation coefficients will be precalculated and stored in ROM. The interpolation procedure can be expanded to reconstruct larger data blocks to reduce loop overheads. However, in the case of termination frames, the minimum resolution which may be called for is 32 PCM samples. The interpolation algorithm is as follows:

A) Create cosine modulation coefficients
B) Read in 32 new subband samples to array XIN
C) Multiply by cosine modulation coefficients and create temporary arrays SUM and DIFF.
D) Store history
E) Multiply by filter coefficients
F) Create 32 PCM output samples
G) Update working arrays
H) Output 32 new PCM samples Lossless or Near-lossless Reconstruction Requirements Depending on the bit rate and the coding scheme in operation, the bit stream can specify either non-perfect or perfect reconstruction interpolation filter bank coefficients (FILTS). Since the encoder decimation filter banks are computed with 40-bit floating precision, the ability of the decoder to achieve the maximum theoretical reconstruction precision will depend on the source PCM word length and the precision of DSP core used to compute the convolutions and the way that the operations are scaled.

Low Frequency Effects PCM Interpolation

The audio data associated with the low-frequency effects channel is independent of the main audio channels. This channel is encoded using an 8-bit APCM process operating on a ×128 decimated (120 Hz bandwidth) 20-bit PCM input. The decimated effects audio is time aligned with the current subframe audio in the main audio channels. Hence, since the delay across the 32-band interpolation filterbank is 256 samples (512 taps), care must be taken to ensure that the interpolated low-frequency effect channel is also aligned with the rest of the audio channels prior to output. No compensation is required if the effects interpolation FIR is also 512 taps.

The LFT algorithm uses a 512 tap 128× interpolation FIR to execute step 286 as follows:

1. Map 7-bit scale factor to rms.
2. Multiply by step-size of 7-bit quantizer.
3. Generate sub sample values from the normalized values.
4. Interpolate by 128 using a low pass filter such as that given for each sub sample.

During termination frames the time resolution of the decimated effect samples is not sufficient to allow the low-frequency audio length to be adjusted in the decimated domain. The interpolation convolution can either be stopped at the appropriate point, or it can be completed and the surplus PCM samples deleted from the effects output buffer.

Auxiliary Data

Auxiliary data bytes AUXD may be optionally embedded in the frame at the encoding stage. The number of bytes in the array if given by the flag AUXCT.

Time Code Stamp

A time code word TIMES may be optionally embedded in the frame at the encoding stage. The 32 bit word consists of 5 fields each representing hours, minutes, seconds, frames, subframes as with the SMPTE time code format. The time code stamp represents the time measured at the start of the audio frame, at the encoder.

| Field | Unit | Range |
|---|---|---|
| bits 0–7 | subframes 1/80 frame | 0–79 |
| bits 8–13 | frames (1/30 sec) | 0–20 |
| bits 14–19 | seconds | 0–59 |
| bits 20–25 | minutes | 0–59 |
| bits 26–31 | hours | 0–23 |

Sub-sampled Audio Interpolation

If the encoded bit stream has been produced using source PCM sampling rates lower than that available at the decoder then interpolation (step 288) of the PCM will be necessary to correct for the sample rate mis-match. The specification assumes that decoder hardware sample rates of 32, 44.1 and 48 kHz will all be mandatory and that encoding sub-sample rates will be limited to 8, 11.02, 12, 16, 22.05 and 24 kHz. The procedure is similar to that shown for the low-frequency effects, except for the lower interpolation factor.

High Frequency Sampled Audio Decoding

The present audio encoder is expandable to allow the encoding of audio data at frequencies above baseband (SFREQ) 290. Decoders do not need to implement this aspect of the audio coder to be able to receive and properly decode audio data streams encoded with higher sample rates. The current specification separates the audio data required to decode the 'base-band' audio, i.e. 0–24 kHz and that for the high frequency sampled audio, 24–48 kHz or 24–96 kHz. Since only encoded audio above 24 kHz will reside in the OVER_AUDIO data array, decoders without the high frequency capability need only recognize the presence of this data array, and bypass it to remain compatible.

Output Sub-subframe PCM Samples

In step 291, the reconstructed PCM samples for the current sub-subframe are output.

PCM Output Word Length Truncation

The word length of the source PCM audio input to the encoder is flagged at the decoder by PCMR. The purpose of transmitting this information is to allow for an improved truncation strategy 292 in decoders whose output PCM word length is less than PCMR. For example, if a ultra high quality 22-bit source audio is used to produce the encoded bit stream (PCMR=4) and the maximum decoder output word length is 20-bits, the reconstructed PCM would ordinarily be truncated to 20-bits. It is well known that rounding, dithering and recursive noise shaping schemes (ie UV22, Sony SBM etc) can make use of the extra bits in order to improve the perceived quality of the truncated audio.

PCM Output Buffer Strategies

The audio encoder data stream format specification is designed to reduce processing latencies and to minimize output buffer requirements. The core coding packet is the sub-subframe which consists normally of 256 PCM samples per channel. It is possible therefore to refresh the PCM output buffer every 256 output samples. However, to realize this advantage, a slightly higher processing overhead is entailed. Since in the time available to decode the first sub-subframe, additional processes such as subframe header and side information unpacking are performed, the time which remains to decode the 256 audio samples is less than that in following sub-subframes. If a higher decode latency and/or output buffer sizes are permissible then output PCM refreshing rates can be decreased to extend up to the maximum audio window encoded in the frame. This effectively averages out the computational load over a longer time and allows for a lowering in DSP processing cycle time.

Termination Frame Management

The purpose of a termination frame is to allow the encoder to arbitrarily adjust the end of the coding window such that the coded audio object length matches, to within a sample period, the duration of the video object. In effect, a termination frame forces the encoder to use an arbitrary audio window size. Hence the length of the audio frame may not be devisable by the 256 sample sub-subframes. A partial sub-subframe (PSC) may be specified within a termination frame (FTYPE) and this may also include surplus samples (SURP). In this event the partial frame is decoded as normal, except using side information from the previous 256 sample sub-subframe. Finally, any surplus samples are deleted from the end of the reconstructed PCM array or held over to cross-fade into the next 256 sample array. Since the number of samples to be output in this instance is less than 256, the output buffer 'empty' interrupt will need to be modified to reflect the smaller PCM array.

Decoder Processing Latency

The decoding processing latency (or delay) is defined as the time between the audio frame entering the decoder processor and the first PCM sample to leave. The latency depends on the way the audio frame is input to the decoder, the method of buffering the frame and the output buffering strategy deployed within.

Real-time Serial I/O

When the audio frame is input serially to the decoder at a rate equal to the bit rate of the data stream (real-time), the decoder is not permitted to begin processing the data until the frame has been completely loaded (an earlier entry point will be specified in later revisions). Assuming the input/and output is double buffered, the first sub-subframe is decoded and loaded to the idle output buffer over the 256 sample periods which follow. Hence the first PCM sample from the new frame appears at the output (((NBLKS+1)*32)+256)/Fsamp seconds after the input frame first appeared at the decoder input (Fsamp=sampling rate of PCM). For arbitrary output buffers sizes the latency becomes (((NBLKS+1)*32)+output buffer size)/Fsamp seconds.

Burst Serial Input—Real-time Serial Output

In this case an improvement in latency is achieved since the time to load the input audio frame to the input buffer is reduced. The latency is now, (time to input audio frame to buffer)+(output buffer size/sample rate).

Parallel Input—Real-time Serial Output

This configuration is identical to the burst serial input case in that the improvement over the real-time input depends on how must faster the input buffer can be loaded.

Real-time Management

Due to the real-time nature of the audio decoding process, certain considerations must be made relating to the handling of the I/O data, the buffer management and the coding modes. A flow chart of one possible decoder I/O implementation 294 is described in FIG. 37. In this example the audio is decoded and output for each and every sub-subframe. For example, in the case of a fixed audio frame which contains 4 subframes, within which 4 normal sub-subframes reside, the decoder will output 16 blocks of 256 samples (per channel) over the duration of each input frame. The critical real-time process is the time taken to decode the first sub-subframe of the first subframe, since the decoder must unpack the headers, subframe side information, as well as decode the 256 PCM samples. To a lesser extent the processing times for the first sub-subframes in the remaining subframes are also critical due to the additional side information unpacking overhead. If in the event that sub-subframe decoding process exceeds the time limit then, in the case of cyclic buffering, the last 256 sample block will be repeated. More importantly, if the decoder on processing all 16 blocks of 256 samples exceeds the input frame period then frame synchronization will be jeopardized and global muting of the outputs initiated.

Lossless and Variable Real-time Decoding

It is anticipated that lossless or variable decoding implementations will deploy appropriate buffers external to the decoder processor and that these buffers will be accessible using a fast input port. Real-time issues relating to variable rate decoding depend on specifications such as the maximum allowable frame (FSIZE) and encoding window sizes (NBLKS) against the number of audio channels (CHS) and source PCM word lengths (PCMR). These are currently being finalized and will be the subject of future drafts.

Bit Error Management Strategies

This specification assumes that the bit error rate of the medium being used to transport or store the bit stream is extremely low. This is generally the case for LD, CDA, CD ROM, DVD and computer storage. Transmission systems such as ISDN, T1, E1 and ATM are also inherently error free.

The specification does include certain error detection and correction schemes in order to compensate for occasional errors.

Non Vital Data

The hflag, filts, chist, pcmr, unspec, auxd data only effect the audio fidelity and do not cause the audio to become unstable. Hence, this information would not normally need any protection from errors.

Majority Vote

Certain flags [amode, sfreq, rate, vernum] do not change often and any changes will usually occur when the audio is muted. These flags can effectively be averaged from frame to frame to check for consistency. If changes are detected, audio muting may be activated until the values re-stabilize.

Vital Data

In the audio frame header vital information includes ftype, surp, nblks, fsize, mix, dynf, dyct, time, auxcnt, lff. This information may change from frame to frame and cannot be averaged. To reduce error sensitivity the header data may be optionally Reed Solomon encoded with the HCRC check bytes. Otherwise the HCRC bytes should be ignored. If errors are detected and cannot be corrected decoding should proceed as normal since it is possible that the errors will not effect the decoding integrity. This can be checked later in the audio frame itself.

If optional header information is also included, this can be checked against the optional Reed Solomon check bytes OCRC.

The audio coding frame contains certain coding headers [subs, thuff, shuff, bhuff, subs, chs, vqsub, sel5, sel7, sel9, sel13, sel17, sel25, sel33, sel65, sel129, joinx] which indicate the packet formatting of the side information and audio codes themselves. By definition these headers continually change from frame to frame and can only be reliably error corrected using the audio header Reed Solomon check bytes AHCRC. If errors were found but could not be corrected decoding may proceed since it is possible that the errors will not effect the decoding integrity. If checking is not performed, AHCRC bytes are ignored.

Finally the subframes themselves can be checked for errors in two ways.

1. If variable length coding (Huffman) is used to code the side information and/or the audio codes, then only error detection is possible. Detection is achieved using the DSYNC 16-bit synchronization word appended at the end of each subframe. On completion of the subframe unpacking the extraction array pointer should point to the first bit of DSYNC.

Case A: If un-correctable errors were detected in either the frame or audio headers and DSYNC has not been verified, it is recommended that the entire frame be aborted and all audio channels muted.

Case B: If un-correctable errors were detected in either the frame or audio headers and DSYNC is verified, it is recommended that the decoder output the subframe PCM as normal and proceed to the next subframe.

Case C: If no errors were detected in the frame and audio headers but DSYNC is not verified, the subframe audio should be muted and the unpacking of the next subframe started from the first bit following DSYNC.

Case D: If no errors were detected in the frame and audio headers and DSYNC is also verified, the decoder should proceed as normal.

Case E: If CRC checking was not performed on the frame or audio headers and DSYNC is verified, the decoder should proceed as normal.

Case F: If CRC checking was not performed on the frame or audio headers and DSYNC is not verified, the decoder should abort the entire frame and mute all channels.

2. If variable length coding (Huffman) is not used then the side information bytes can be checked using the SICRC Reed Solomon check bytes. The audio codes (AUDIO), low frequency effects (LFE) and high frequency sampled audio codes (OVER_AUDIO) are not specifically protected since the data itself is perceptually insensitive to minor error corruption. The DSYNC synchronization check can still be performed, however, on the audio subframes.

Case A: If un-correctable errors were detected in either the frame, audio headers or the side information and DSYNC has not been verified, it is recommended that the entire frame be aborted and all audio channels muted.

Case B: If un-correctable errors were detected in either the frame or audio headers and un-correctable errors were also detected in the side information the entire frame should be aborted.

Case C: If no errors were detected in the frame, audio headers or side information and DSYNC is also verified, the decoder should proceed as normal.

Case D: If CRC checking was not performed on any/all of the frame, audio headers or side information and DSYNC is verified, the decoder should proceed as normal.

Case E: If CRC checking was not performed on any/all of the frame, audio headers or side information and DSYNC is not verified, the decoder should abort the frame.

Hardware Implementation

Figure 29:
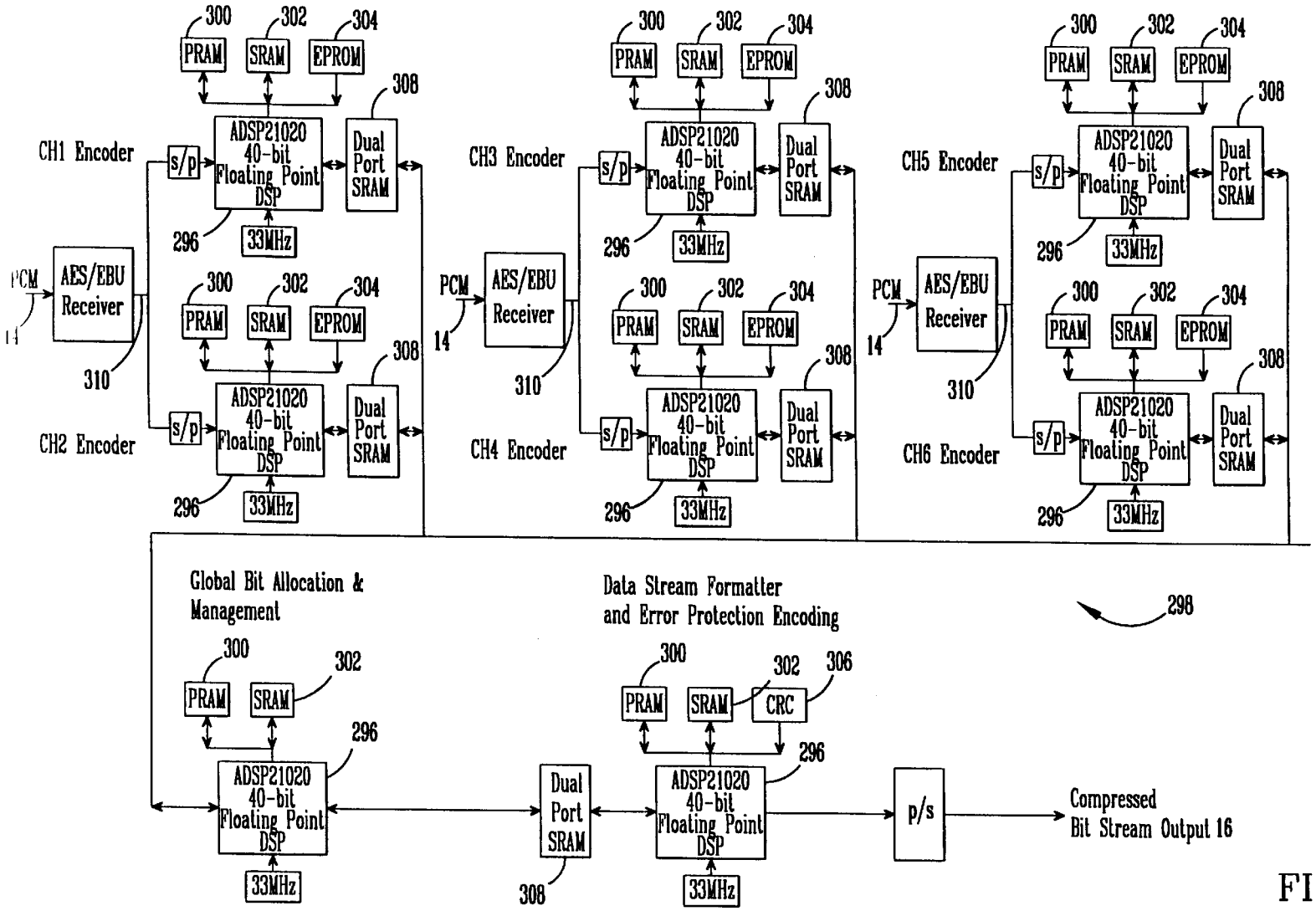
FIG. 29 is a block diagram of a hardware implementation for the encoder.
Figure 30:
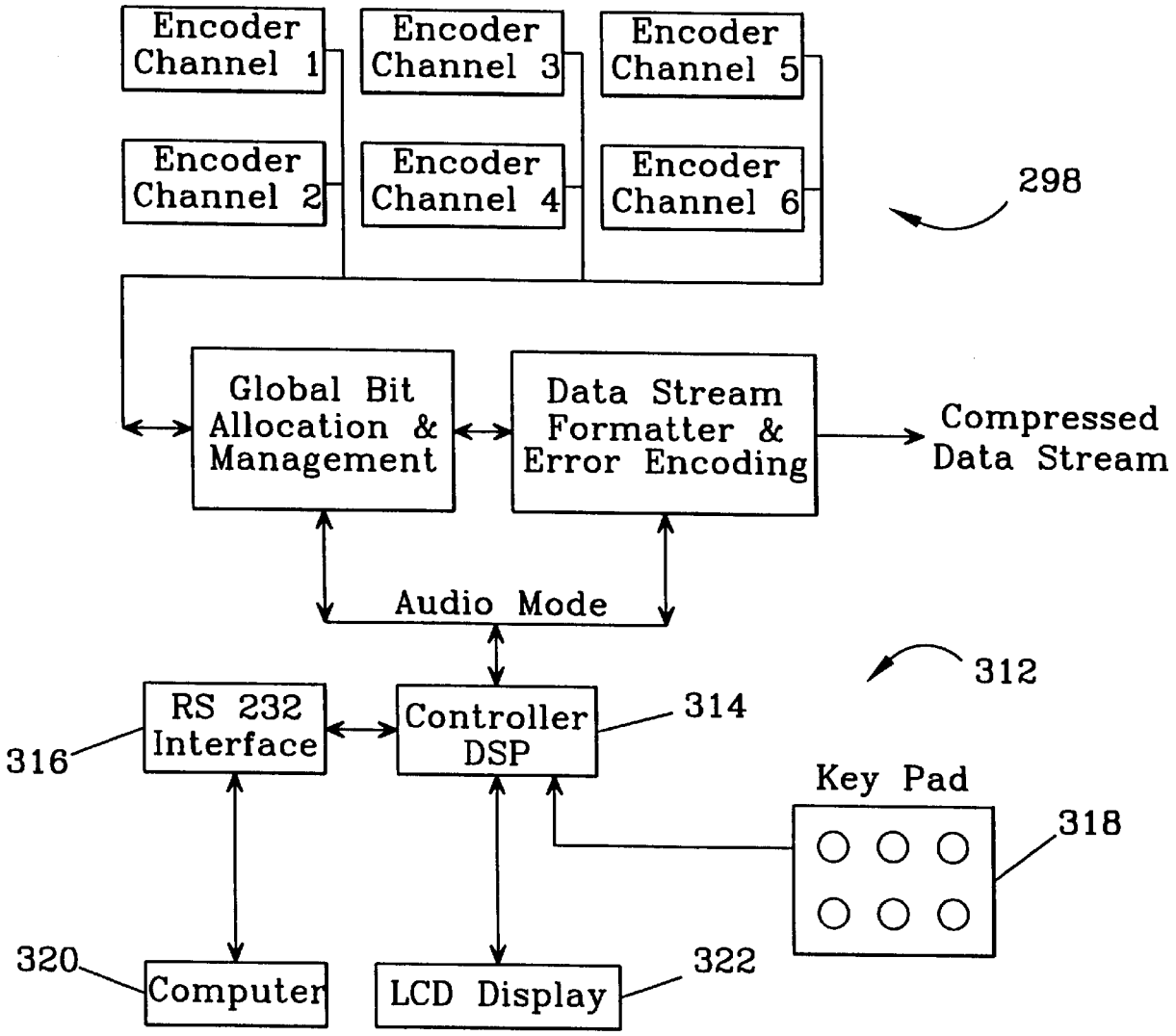
FIG. 30 is a block diagram of the audio mode control interface for the encoder shown in FIG. 29.
Figure 31:
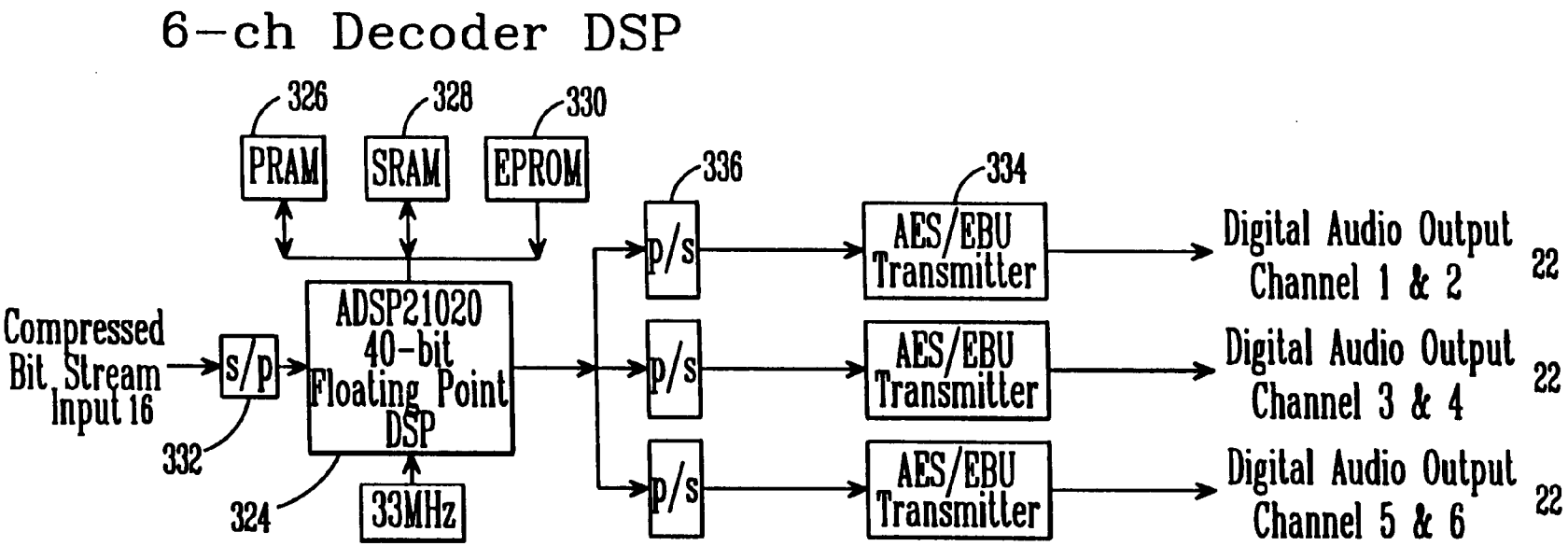
FIG. 31 is a block diagram of a hardware implementation for the decoder.

FIGS. 29, 30 and 31 describe the basic functional structure of the hardware implementation of a six channel version of the encoder and decoder for operation at 32, 44.1 and 48 kHz sampling rates.

Referring to FIG. 29, Eight Analog Devices ADSP21020 40-bit floating point digital signal processor (DSP) chips 296 are used to implement a six channel digital audio encoder 298. Six DSPs are used to encode each of the channels while the seventh and eighth are used to implement the "Global Bit Allocation and Management" and "Data Stream Formatter and Error Encoding" functions respectively. Each ADSP21020 is clocked at 33 MHz and utilize external 48bit×32 k program ram (PRAM) 300, 40 bit×32 k data ram (SRAM) 302 to run the algorithms. In the case of the encoders an 8 bit×512 k EPROM 304 is also used for storage of fixed constants such as the variable length entropy code books. The data stream formatting DSP uses a Reed Solomon CRC chip 306 to facilitate error detection and protection at the decoder. Communications between the encoder DSPs and the global bit allocation and management is implemented using dual port static RAM 308.

The encode processing flow is as follows. A 2-channel digital audio PCM data stream 310 is extracted at the output of each of the three AES/EBU digital audio receivers. The first channel of each pair is directed to CH1, 3 and 5 Encoder DSPs respectively while the second channel of each is directed to CH2, 4 and 6 respectively. The PCM samples are read into the DSPs by converting the serial PCM words to parallel (s/p). Each encoder accumulates a frame of PCM samples and proceeds to encode the frame data as described previously. Information regarding the estimated difference signal (ed(n) and the subband samples (x(n)) for each channel is transmitted to the global bit allocation and management DSP via the dual port RAM. The bit allocation strategies for each encoder are then read back in the same manner. Once the encoding process is complete, the coded data and side information for the six channels is transmitted to the data stream formatter DSP via the global bit allocation and management DSP. At this stage CRC check bytes are generated selectively and added to the encoded data for the purposes of providing error protection at the decoder. Finally the entire data packet 16 is assembled and output.

FIG. 30 illustrates an audio mode control interface 312 to the encoder DSP implementation shown in FIG. 29. An additional controller DSP 314 is used to manage the RS232 316 and key pad 318 interfaces and relay the audio mode information to both the global bit allocation and management and the data stream formatter DSPs. This allows parameters such as the desired bit rate of the coding system, the number of audio channels, the window size, the sampling rate and the transmission rate to be dynamically entered via the key pad or from a computer 320 through the RS232 port. The parameters are then shown on an LCD display 322.

A six channel hardware decoder implementation is described in FIG. 31. A single Analog Devices ADSP21020 40-bit floating point digital signal processor (DSP) chip 324 is used to implement the six channel digital audio decoder. The ADSP21020 is clocked at 33 MHz and utilize external 48 bit×32 k program ram (PRAM) 326, 40 bit×32 k data ram (SRAM) 328 to run the decoding algorithm. An additional 8 bit×512 k EPROM 330 is also used for storage of fixed constants such as the variable length entropy and prediction coefficient vector code books.

The decode processing flow is as follows. The compressed data stream 16 is input to the DSP via a serial to parallel converter (s/p) 332. The data is unpacked and decoded as illustrated previously. The subband samples are reconstructed into a single PCM data stream 22 for each channel and output to three AES/EBU digital audio transmitter chips 334 via three parallel to serial converters (p/s) 335.

While several illustrative embodiments of the invention have been shown and described, numerous variations and alternate embodiments will occur to those skilled in the art. For example, as processor speeds increase and the cost of memory is reduced, the sampling frequencies, transmission rates and buffer size will most likely increase. Such variations and alternate embodiments are contemplated, and can be made without departing from the spirit and scope of the invention as defined in the appended claims.

We claim:

1. A multi-channel audio decoder for reconstructing multiple audio channels up to a decoder sampling rate from a data stream, in which each audio channel was sampled at an encoder sampling rate that is at least as high as the decoder sampling rate, subdivided into a plurality of frequency subbands, compressed and multiplexed into the data stream at a transmission rate, comprising:

an input buffer for reading in and storing the data stream a frame at a time, each of said frames including a sync word, a frame header, an audio header, and at least one subframe, which includes audio side information, a plurality of sub-subframes having baseband audio codes over a baseband frequency range, a block of high sampling rate audio codes over a high sampling rate frequency range, and an unpack sync;

a demultiplexer that a) detects the sync word, b) unpacks the frame header to extract a window size that indicates a number of audio samples in the frame and a frame size that indicates a number of bytes in the frame, said window size being set as a function of the ratio of the transmission rate to the encoder sampling rate so that the frame size is constrained to be less than the size of the input buffer, c) unpacks the audio header to extract the number of subframes in the frame and the number of encoded audio channels, and d) sequentially unpacks each subframe to extract the audio side information including the number of sub-subframes, demultiplex the baseband audio codes in each sub-subframe into the multiple audio channels and unpack each audio channel into its subband audio codes, demultiplex the high sampling rate audio codes into the multiple audio channels up to the decoder sampling rate and skip the remaining high sampling rate audio codes up to the encoder sampling rate, and detects the unpack sync to verify the end of the subframe;

a baseband decoder that uses the side information to decode the subband audio codes into reconstructed subband signals a subframe at a time without reference to any other subframes;

a baseband reconstruction filter that combines each channel's reconstructed subband signals into a reconstructed baseband signal a subframe at a time;

a high sampling rate decoder that uses the side information to decode the high sampling rate audio codes up to the decoder sampling rate into a reconstructed high sampling rate signal for each audio channel a subframe at a time; and a channel reconstruction filter that combines the reconstructed baseband and high sampling rate signals into a reconstructed multi-channel audio signal a subframe at a time.

2. The multi-channel audio decoder of claim 1, wherein the baseband decoder comprises a plurality of inverse adaptive differential pulse code modulation (ADPCM) coders for decoding the respective subband audio codes, said side information including prediction coefficients for the respective ADPCM coders and a prediction mode (PMODE) for controlling the application of the prediction coefficients to the respective ADPCM coders to selectively enable and disable their prediction capabilities.

3. The multi-channel audio decoder of claim 1, wherein said side information comprises:

a bit allocation table for each channel's subbands, in which each subband's bit rate is fixed over the subframe;

at least one scale factor for each subband in each channel; and a transient mode (TMODE) for each subband in each channel that identifies the number of scale factors and their associated sub-subframes, said baseband decoder scaling the subbands' audio codes by the respective scale factors in accordance with their TMODEs to facilitate decoding.

4. The multi-channel audio decoder of claim 1, wherein said baseband decoder comprises:

an inverse predictive coder for decoding the lower frequency subbands; and an inverse vector quantizer (VQ) for decoding the higher frequency subbands.

5. The multi-channel audio decoder of claim 1, wherein the baseband frequency range extends from DC to a first break frequency, the high sampling rate frequency range extends from the first break frequency to one-half the encoder sampling rate, and the decoder sampling rate lies between twice the first break frequency and the encoder sampling rate.

6. The multi-channel audio decoder of claim 5, wherein the high sampling rate frequency range is subdivided into a plurality of frequency subranges at successively higher break frequencies, said decoder sampling rate being equal to one of said break frequencies.

7. The multi-channel audio decoder of claim 1, wherein said audio header includes a joint frequency coding (JFC) index that indicates whether JFC is enabled, which subbands are joint frequency coded, and in which audio channel the subband audio code is located, further comprising:

a JFC controller that responds to the JFC index by directing the baseband audio codes for the designated subbands from the one designated audio channel to the other JFC channels.

8. A multi-channel audio decoder for reconstructing multiple audio channels up to a decoder sampling rate from a data stream, in which each audio channel was sampled at an encoder sampling rate that is at least as high as the decoder sampling rate, subdivided into a plurality of frequency subbands, compressed and multiplexed into the data stream at a transmission rate, comprising:

an input buffer for reading in and storing the data stream a frame at a time, each of said frames including a sync word, a frame header, an audio header, and at least one subframe, which includes audio side information, a plurality of sub-subframes having baseband audio codes over a baseband frequency range, a block of high sampling rate audio codes over a high sampling rate frequency range, and an unpack sync;

a demultiplexer that a) detects the sync word, b) unpacks the frame header to extract a window size that indicates a number of audio samples in the frame and a frame size that indicates a number of bytes in the frame, said window size being set as a function of the ratio of the transmission rate to the encoder sampling rate so that the frame size is constrained to be less than the size of the input buffer, c) unpacks the audio header to extract the number of subframes in the frame and the number of encoded audio channels, and d) sequentially unpacks each subframe to extract the audio side information, demultiplex the baseband audio codes in each sub-subframe into the multiple audio channels and unpack each audio channel into its subband audio codes, demultiplex the high sampling rate audio codes into the multiple audio channels up to the decoder sampling rate and skip the remaining high sampling rate audio codes up to the encoder sampling rate, and detects the unpack sync to verify the end of the subframe;

a baseband decoder that uses the side information to decode the subband audio codes into reconstructed subband signals a subframe at a time without reference to any other subframes;

a baseband reconstruction filter that combines each channel's reconstructed subband signals into a reconstructed baseband signal a subframe at a time, the baseband reconstruction filter comprising a non-perfect reconstruction (NPR) filterbank and a perfect reconstruction (PR) filterbank, and said frame header including a filter code that selects one of said NPR and PR filterbanks;

a high sampling rate decoder that uses the side information to decode the high sampling rate audio codes into a reconstructed high sampling rate signal for each audio channel a subframe at a time; and a channel reconstruction filter that combines the reconstructed baseband and high sampling rate signals into a reconstructed multi-channel audio signal a subframe at a time.

9. A multi-channel audio decoder for reconstructing multiple audio channels from a data stream, in which each audio channel was sampled at an encoder sampling rate, subdivided into a plurality of frequency subbands, compressed and multiplexed into the data stream, comprising:

an input buffer for reading in and storing the data stream a frame at a time, each of said frames including a sync word, a frame header, an audio header, and at least one subframe, which includes a block of baseband audio codes over a baseband frequency range and a block of high sampling rate audio codes over an high sampling rate frequency range;

a demultiplexer that a) detects the sync word, b) unpacks the frame header to extract an encoder sampling rate, c) unpacks the audio header to extract a packing arrangement and a coding format for the audio frame, and d) successively unpacks each subframe by demultiplexing each block of baseband audio codes into the multiple audio channels and unpacking each audio channel into its subband audio codes, demultiplexing the block of high sampling rate audio codes into the multiple audio channels up to a decoder sampling rate and skipping the remaining high sampling rate audio codes up to the encoder sampling rate;

a baseband decoder that decodes the subband audio codes into respective reconstructed subband signals a subframe at a time;

a baseband reconstruction filter that combines each channel's reconstructed subband signals into a reconstructed baseband signal a subframe at a time;

a high sampling rate decoder that decodes the high sampling rate audio codes up to the decoder sampling rate into a reconstructed high sampling rate signal for each audio channel a subframe at a time; and a channel reconstruction filter that combines the reconstructed baseband and high sampling rate signals into a reconstructed multi-channel audio signal a subframe at a time.

10. The multi-channel audio decoder of claim 9, wherein the baseband frequency range extends from DC to a first break frequency and the high sampling rate frequency range is subdivided into a plurality of frequency subranges at successively higher break frequencies, said decoder sampling rate being equal to one of said break frequencies.

11. The multi-channel audio decoder of claim 9, wherein each subframe includes side information for that subframe and only that subframe so that the baseband and high sampling rate decoders decode the subband audio codes and high sampling rate audio codes, respectively, a subframe at a time without reference to any of the other subframes.

12. A multi-channel audio decoder for reconstructing multiple audio channels from a data stream, in which each audio channel was sampled at an encoder sampling rate, subdivided into a plurality of frequency subbands, compressed and multiplexed into the data stream at a transmission rate, comprising:

an input buffer for reading in and storing the data stream a frame at a time, each of said frames including a sync word, a frame header, an audio header, and at least one subframe, which includes audio side information, and a plurality of sub-subframes having audio codes;

a demultiplexer that a) detects the sync word, b) unpacks the frame header to extract a window size that indicates a number of audio samples in the frame and a frame size that indicates a number of bytes in the frame, said window size being set as a function of the ratio of the transmission rate to the encoder sampling rate so that the frame size is constrained to be less than the size of the input buffer, c) unpacks the audio header to extract the number of subframes in the frame and the number of encoded audio channels, and d) sequentially unpacks each subframe to extract the audio side information including the number of sub-subframes, and demultiplex the audio codes in each sub-subframe into the multiple audio channels and unpack each audio channel into its subband audio codes;

a decoder that uses the side information to decode the subband audio codes into reconstructed subband signals a subframe at a time without reference to any other subframes; and a reconstruction filter that combines each channel's reconstructed subband signals into a reconstructed multi-channel audio signal a subframe at a time.

13. The multi-channel audio decoder of claim 12, wherein the baseband decoder comprises a plurality of inverse adaptive differential pulse code modulation (ADPCM) coders for decoding the respective subband audio codes, said side information including prediction coefficients for the respective ADPCM coders and a prediction mode (PMODE) for controlling the application of the prediction coefficients to the respective ADPCM coders to selectively enable and disable their prediction capabilities.

14. The multi-channel audio decoder of claim 13, wherein said side information comprises:

a bit allocation table for each channel's subbands, in which each subband's bit rate is fixed over the subframe;

at least one scale factor for each subband in each channel; and a transient mode (TMODE) for each subband in each channel that identifies the number of scale factors and their associated sub-subframes, said baseband decoder scaling the subbands' audio codes by the respective scale factors in accordance with their TMODEs to facilitate decoding.

15. The multi-channel audio decoder of claim 13, wherein said baseband decoder comprises:

an inverse predictive coder for decoding the lower frequency subbands; and an inverse vector quantizer (VQ) for decoding the higher frequency subbands.

16. A multi-channel audio decoder for reconstructing multiple audio channels from a data stream, in which each audio channel was sampled at an encoder sampling rate, subdivided into a plurality of frequency subbands, compressed and multiplexed into the data stream, comprising:

an input buffer for reading in and storing the data stream a frame at a time, each of said frames including a sync word, a frame header that includes a filter code that selects one of a non-perfect reconstruction (NPR) filterbank and a perfect reconstruction (PR) filterbank, an audio header, and at least one subframe, which includes a block of baseband audio codes over a baseband frequency range, and a block of high sampling rate audio codes over an high sampling rate frequency range, and an unpack sync;

a demultiplexer that a) detects the sync word, b) unpacks the frame header to extract an encoder sampling rate, c) unpacks the audio header to extract a packing arrangement and a coding format for the audio frame, and d) successively unpacks each subframe by demultiplexing each block of baseband audio codes into the multiple audio channels and unpacking each audio channel into its subband audio codes, demultiplexing the block of high sampling rate audio codes into the multiple audio channels up to a decoder sampling rate and skipping the remaining high sampling rate audio codes up to the encoder sampling rate;

a baseband decoder that uses the selected NPR or PR filterbank to decode the subband audio codes into respective reconstructed subband signals a subframe at a time;

a baseband reconstruction filter that combines each channel's reconstructed subband signals into a reconstructed baseband signal a subframe at a time;

a high sampling rate decoder that decodes the high sampling rate audio codes into a reconstructed high sampling rate signal for each audio channel a subframe at a time; and a channel reconstruction filter that combines the reconstructed baseband and high sampling rate signals into a reconstructed multi-channel audio signal a subframe at a time.

17. The multi-channel audio decoder of claim 16, wherein the baseband frequency range extends from DC to a first break frequency, the high sampling rate frequency range extends from the first break frequency to one-half the encoder sampling rate, and the decoder sampling rate lies between twice the first break frequency and the encoder sampling rate.

18. The multi-channel audio decoder of claim 17, wherein the high sampling rate frequency range is subdivided into a plurality of frequency subranges at successively higher break frequencies, said decoder sampling rate being equal to one of said break frequencies.

19. A multi-channel audio decoder for reconstructing multiple audio channels from a data stream, in which each audio channel was sampled at an encoder sampling rate, subdivided into a plurality of frequency subbands, compressed and multiplexed into the data stream at a transmission rate, comprising:

an input buffer for reading in and storing the data stream a frame at a time, each of said frames including a frame header, an audio header, and at least one subframe, which includes audio side information and audio codes;

a demultiplexer that a) unpacks the frame header to extract a window size that indicates a number of audio samples in the frame, said window size being set as a function of the ratio of the transmission rate to the encoder sampling rate so that the frame size is constrained to be less than the size of the input buffer, b) unpacks the audio header to extract the number of subframes in the frame and the number of encoded audio channels, and c) sequentially unpacks each subframe to extract the audio side information, and demultiplex the audio codes into the multiple audio channels and unpack each audio channel into its subband audio codes;

a decoder that uses the side information to decode the audio codes into reconstructed subband signals a subframe at a time; and a reconstruction filter that combines each channel's reconstructed subband signals into a reconstructed multi-channel audio signal a subframe at a time.

20. The multi-channel audio decoder of claim 19, wherein each subframe includes side information for that subframe and only that subframe so that the baseband and high sampling rate decoders decode the subband audio codes and high sampling rate audio codes, respectively, a subframe at a time without reference to any of the other subframes.

21. The multi-channel audio decoder of claim 20, wherein the reconstruction filter comprises a non-perfect reconstruction (NPR) filterbank and a perfect reconstruction (PR) filterbank, and said frame header includes a filter code that selects one of said NPR and PR filterbanks.

22. The multi-channel audio decoder of claim 9, wherein each said subframe in the data stream includes an unpack sync, said demultiplexer detecting the unpack sync to verify the end of the subframe.

* * * * *